US005462849A

United States Patent [19]

Kuromoto et al.

[11] Patent Number: 5,462,849

[45] **Date of Patent: * Oct. 31, 1995**

[54] SILVER HALIDE EMULSIONS WITH DOPED EPITAXY

[75] Inventors: Traci Y. Kuromoto, West Henrietta; Eric L. Bell, Wesbter; Woodrow G. McDugle, Rochester; Raymond S. Eachus, Rochester; Sherrill A. Puckett, Rochester; Myra T. Olm, Webster; Robert D. Wilson, Rochester, all of N.Y.

[73] Assignee: Eastman Kodak Company, Rochester, N.Y.

[ * ] Notice: The portion of the term of this patent subsequent to Nov. 1, 2011, has been disclaimed.

[21] Appl. No.: 330,280

[22] Filed: Oct. 27, 1994

[51] Int. Cl.[6] ..... G03C 1/08; G03C 1/09; G03C 1/035

[52] U.S. Cl. ..... 430/567; 430/604; 430/605

[58] Field of Search ..... 430/567, 604, 430/605

[56] References Cited

U.S. PATENT DOCUMENTS

| | | | |
|---|---|---|---|
| 3,672,901 | 6/1972 | Ohkubo et al. | 430/569 |
| 3,790,390 | 2/1974 | Shiba et al. | 430/567 |
| 3,890,154 | 6/1975 | Ohkubo et al. | 430/434 |
| 3,901,711 | 8/1975 | Iwaosa et al. | 430/608 |
| 4,092,171 | 5/1978 | Bigelow | 430/550 |
| 4,173,483 | 11/1979 | Habu et al. | 430/575 |
| 4,835,093 | 5/1989 | Janusonis et al. | 430/567 |
| 4,933,272 | 6/1990 | McDugle et al. | 430/567 |
| 4,937,180 | 1/1990 | Marchetti et al. | 430/567 |
| 4,945,035 | 7/1990 | Keevert, Jr. et al. | 430/567 |
| 4,981,781 | 1/1991 | McDugle et al. | 430/605 |
| 5,037,732 | 8/1991 | McDugle et al. | 430/567 |
| 5,112,732 | 5/1992 | Hayashi | 430/604 |
| 5,284,745 | 2/1994 | Ohshima | 430/605 |
| 5,360,712 | 11/1994 | Olm et al. | 430/604 |

FOREIGN PATENT DOCUMENTS

513748A1 11/1992 European Pat. Off. .

OTHER PUBLICATIONS

Research Disclosure, vol. 176, Dec. 1978, Item 17643, Section 1, subsection A.

Disclosure, vol. 308, Dec. 1989, Item 308119, Section I, subsection D.

Disclosure, vol. 365, Sep. 1994, Item 36544, Section I, subsection D.

*Primary Examiner*—Charles L. Bowers, Jr.
*Assistant Examiner*—Mark F. Huff
*Attorney, Agent, or Firm*—Carl O. Thomas

[57] ABSTRACT

A photographic silver halide emulsion is disclosed comprised of radiation sensitive composite silver halide grains including host grain portions accounting for at least 50 percent of total silver and surface portions epitaxially deposited on the host grain portions. The epitaxially deposited surface portions on the host grain portions exhibit a face centered cubic crystal lattice structure containing a hexacoordination complex of a metal from periods 4, 5 and 6 of groups 3 to 14 inclusive of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands.

20 Claims, No Drawings

SILVER HALIDE EMULSIONS WITH DOPED EPITAXY

FIELD OF THE INVENTION

The invention relates to photography. More specifcally, the invention relates to photographic silver halide emulsions and to processes for their preparation.

BACKGROUND OF THE INVENTION a. Definition of Terms

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and the A and B group designations (having opposite meanings in the U.S. and Europe) were replaced by a simple left to right 1 through 18 numbering of the groups.

The term "dopant" is employed herein to designate any element or ion other than silver or halide incorporated in a face centered silver halide crystal lattice.

The term "metal" in referring to elements includes all elements other than those of the following atomic numbers: 2, 5–10, 14–18, 33–36, 52–54, 85 and 86.

The term "Group VIII metal" refers to an element from period 4, 5 or 6 and any one of groups 8 to 10 inclusive.

The term "Group VIII noble metal" refers to an element from period 5 or 6 and any one of groups 8 to 10 inclusive.

The term "palladium triad metal" refers to an element from period 5 and any one of groups 8 to 10 inclusive.

The term "platinum triad metal" refers to an element from period 6 and any one of groups 8 to 10 inclusive.

The term "halide" is employed in its conventional usage in silver halide photography to indicate chloride, bromide or iodide.

In referring to silver halide grains containing two or more halides, the halides are named in their order of ascending concentrations.

The term "pseudohalide" refers to groups known to approximate the properties of halides—that is, monovalent anionic groups sufficiently electronegative to exhibit a positive Hammett sigma value at least equaling that of a halide—e.g., $CN^-$, $OCN^-$, $SCN^-$, $SeCN^-$, $TeCN^-$, $N_3^-$, $C(CN)_3^-$ and $CH^-$.

The term "C—C, H—C or C—N—H organic" refers to groups that contain at least one carbon-to-carbon bond, at least one carbon-to-hydrogen bond or at least one carbon-to-nitrogen-to-hydrogen bond sequence.

The term "epitaxial deposition" refers to crystal growth onto a substrate of a detectibly different crystal structure wherein the substrate controls the crystalline orientation of the crystal growth. Since each silver halide forms a crystal structure that is either different in kind or in unit cell dimensions from the remaining silver halides, detectable differences in halide composition of the substrate and oriented crystal growth satisfy the "different crystal structure" requirement to qualify as epitaxial deposition. The term "epitaxy" is employed to indicate the crystal growth epitaxially deposited.

To avoid repetition, it is understood that all references to photographic emulsions are to negative-working photographic emulsions, except as otherwise indicated.

Research Disclosure is published by Kenneth Mason Publications, Ltd., Dudley House, 12 North St., Emsworth, Hampshire P010 7DQ, England (b) Prior Art

*Research Disclosure*, Vol. 176, December 1978, Item 17643, Section I, sub-section A, states that "sensitizing compounds, such as compounds of copper, thallium, lead, bismuth, cadmium and Group VIII noble metals, can be present during precipitation of silver halide" emulsions. The quoted passage is followed by citations to demonstrate the general knowledge of the art that metals incorporated as dopants in silver halide grains during precipitation are capable of acting to improve grain sensitivity.

*Research Disclosure*, Vol. 308, December 1989, Item 308119, Section I, sub-section D, states that "compounds of metals such as copper, thallium, lead, mercury, bismuth, zinc, cadmium, rhenium, and Group VIII metals (e.g., iron, ruthenium, rhodium, palladium, osmium, iridium and platinum) can be present during the precipitation of silver halide" emulsions. The quoted passage is essentially cumulative with *Research Disclosure* 17643, Section I, sub-section A, except that the metals have been broadened beyond sensitizers to include those that otherwise modify photographic performance when included as dopants during silver halide precipitation.

*Research Disclosure* 308119, sub-section D, proceeds further to point out a fundamental change that occurred in the art between the 1978 and 1989 publication dates of these silver halide photography surveys. *Research Disclosure* 308118, I-D states further:

> The metals introduced during grain nucleation and/or growth can enter the grains as dopants to modify photographic properties, depending on their level and location within the grains. When the metal forms a part of a coordination complex, such as a hexacoordination complex or a tetracoordination complex, the ligands can also be occluded within the grains. Coordination ligands, such as halo, aquo, cyano, cyanate, thiocyanate, nitrosyl, thionitrosyl, oxo, and carbonyl ligands are contemplated and can be relied upon to vary emulsion properties further.

*Research Disclosure*, Vol. 365, September 1994, Item 36544, Section I, sub-section D, paragraphs (3), (4) and (5), are considered cumulative with *Research Disclosure* Item 308119.

Although it was known for many years that the photographic performance of silver halide emulsions can be modified by the introduction of dopant metal ions during grain precipitation, it was generally assumed that the anion paired with the metal ion, except when it happened to be a halide ion, did not enter the grain structure and that the counterion selection was unrelated to photographic performance. Janusonis et al U.S. Pat. No. 4,835,093; McDugle et al U.S. Pat. Nos. 4,933,272, 4,981,781 and 5,037,732; Marchetti et al U.S. Pat. No. 4,937,180; and Keevert et al U.S. Pat. No. 4,945,035 were the first to demonstrate that ligands capable of forming coordination complexes with dopant metal ions are capable of entering the grain crystal structure and producing modifications of photographic performance that are not realized by incorporation of the transition metal ion alone. In each of these patents emphasis is placed on the fact that the coordination complex steric configuration allows the metal ion in the complex to replace a silver ion in the crystal lattice with the ligands replacing adjacent halide ions.

Thereafter, by hindsight, it was realized that earlier disclosures of the addition of dopant metal ions, either as simple salts or as coordination complexes, had inadvertently disclosed useful ligand incorporations. Of these inadvertent teachings, the incorporation of iron hexacyanide during grain precipitation is the most notable and is illustrated by Shiba et al U.S. Pat. No. 3,790,390; Ohkubo et al U.S. Pat. No. 3,890,154; Iwaosa et al U.S. Pat. No. 3,901,711 and Habu et al U.S. Pat. No. 4,173,483.

Ohya et al European patent application 513 748 A1, published Nov. 19, 1992, discloses photographic silver halide emulsions precipitated in the presence of a metal complex having an oxidation potential of from −1.34 V to +1.66 V and a reduction potential not higher than −1.34 V and chemically sensitized in the presence of a gold-containing compound. On page 2 of the patent a table of illustrative complexes satisfying the oxidation and reduction potentials are listed. This listing includes, in addition to the complexes consisting of halide and pseudohalide ligands, $K_2[Fe(EDTA)]$, where EDTA is an acronym for ethylenediaminetetraacetic acid. In a preferred variation it is taught to employ in combination with a required metal complex an iridium containing compound. Examples of useful iridium compounds include, in addition to simple halide salts and coordination complexes containing halide ligands, hexaamine iridium (III) salt (i.e., a $[(NH_3)_6Ir]^{+3}$ salt), hexaamine iridium (IV) salt (i.e., a $[(NH_3)_6Ir]^{+4}$ salt), a trioxalate iridium (III) salt and a trioxalate iridium (IV) salt. While offering a somewhat broader selection of ligands for use with the metals disclosed, Ohya et al does not attach any importance to ligand selection and does not address whether ligands are or are not incorporated into the grain structures during precipitation.

Ohkubo et al U.S. Pat. No. 3,672,901 (hereinafter designated Ohkubo et al '901) discloses silver halide precipitation in the presence of iron compounds. Ohkubo et al states, "Specific examples include: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous sulfate, potassium hexacyanoferrate (II), potassium pentacyanoamine-ferrate (II), basic ferric acetate, ferric albuminate, ammonium ferric acetate, ferric bromide, ferric chloride, ferric chromate, ferric citrate, ferric fluoride, ferric formate, ferric glycero phosphate, ferric hydroxide, acidic ferric phosphate, sodium ferric ethylenedinitrilotetraacetate, sodium ferric pyrophosphate, ferric thiocyanate, ferric sulfate, ammonium ferric sulfate, guanidine ferric sulfate, ammonium ferric citrate, potassium hexacyanoferrate (III), tris(dipyridyl) iron (III) chloride, potassium ferric pentacyanonitrosyl, and hexaurea iron (III) chloride. The only compounds reported in the Examples are hexacyanoferrate (II) and (III) and ferric thiocyanate.

Hayashi U.S. Pat. No. 5,112,732 discloses useful results to be obtained in internal latent image forming direct positive emulsions precipitated in the presence of potassium ferrocyanide, potassium ferricyanide or an EDTA iron complex salt. Doping with iron oxalate is demonstrated to be ineffective.

While the art noted above has heretofore achieved useful photographic performance modifications through adding dopant metal salts and coordination complexes during grain precipitation, the photographic effects that have heretofore been achieved have been attributable to the dopant metal alone or to the metal dopant in combination with coordination complex ligands chosen from only a few restricted categories: halo, pseudohalo, aquo, nitrosyl, thionitrosyl, carbonyl and oxo ligands.

Prior to the present invention reported introductions during grain precipitation of metal coordination complexes containing organic ligands have not demonstrated photographically useful modifying effects attributable to the presence of the organic ligands, and, in fact, such coordination complexes have limited the photographic modifications that would be expected from introducing the metal in the form of a simple salt. Performance modification failures employing ethylenediamine and trioxalate metal coordination complexes of types analogous to those suggested by Ohya et al and Ohkubo et al '901 are presented below as comparative Examples.

Bigelow U.S. Pat. No. 4,092,171 discloses the use of tetracoordination complexes of platinum and palladium with organophosphine ligands to be useful chemical sensitizers. The relationship of tetracoordination complexes to silver halide crystal structures is fundamentally different than that of hexacoordination complexes in that tetracoordination complexes, if they are incorporated, occupy intersticial sites within the crystal lattice rather than substitutionally displacing silver and halide ions in the manner of the hexacoordination metal complexes.

Photographic emulsions containing composite grains comprised of host grain portions and surface portions epitaxially deposited on the host grain portions are well known in the art. An illustrative listing of emulsions containing composite grains appears in Research Disclosure, Vol. 365, September 1994, Item 36544, I. Emulsion grains and their preparation, A. Grain halide composition, paragraph (5).

RELATED FILINGS

Olm et al U.S. Ser. No. 08/091,148, filed Jul. 13, 1993, to be issued Nov. 1, 1994, as U.S. Pat. No. 5,360,712, titled INTERNALLY DOPED SILVER HALIDE EMULSIONS AND PROCESSES FOR THEIR PREPARATION, commonly assigned, discloses silver halide photographic emulsions in which the grains are doped with a hexacoordination complex containing at least one organic ligand.

Olm et al U.S. Ser. No. 08/296,562, filed Aug. 26, 1994, titled ULTRATHIN TABULAR GRAIN EMULSIONS WITH NOVEL DOPANT PLACEMENT, discloses silver iodobromide ultrathin (<0.07 gm) tabular grain emulsions with epitaxial sensitization containing dopants, which can include hexacoordination complexes with one more C—C, H—C or C—N—H organic ligands.

SUMMARY OF THE INVENTION

The present invention has for the first time introduced during epitaxial deposition dopant metal hexacoordination complexes containing one or more organic ligands and obtained modifications in photographic performance that can be attributed specifically to the presence of the organic ligand or ligands. The result is to provide the art with additional and useful means for tailoring photographic performance to meet specific application requirements.

In one aspect this invention is directed to a photographic silver halide emulsion comprised of radiation sensitive composite silver halide grains including host grain portions accounting for at least 50 percent of total silver and surface portions epitaxially deposited on the host grain portions wherein the epitaxially deposited surface portions on the host grain portions exhibit a face centered cubic crystal lattice structure containing a hexacoordination complex of a metal from periods 4, 5 and 6 of groups 3 to 14 inclusive of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands.

DESCRIPTION OF PREFERRED EMBODIMENTS

The present invention is directed toward the improvement of photographic silver halide emulsions comprised of radiation sensitive composite silver halide grains. The composite grains are formed by epitaxially depositing surface portions onto a host grain population. The host grain portions account for at least 50 percent (preferably at least 90 percent) of the total silver forming the composite grains. The epitaxially deposited surface portions of the composite grains can form a shell, but are preferably nonuniformly distributed on the host grains. In a specific preferred form the epitaxially deposited surface portions are located principally adjacent at least one of the edges and corners of the host grains.

The host grains can be chosen of any convenient conventional silver halide composition. Maskasky U.S. Pat. No. 4,094,684, the disclosure of which is here incorporated by reference, discloses composite grains in which silver iodide host grains serve as substrates for the epitaxial deposition of silver chloride. However, it is preferred that the host grain portions and required that the epitaxially deposited grain surface portions be selected from among those individual and mixed silver halides that form a face centered cubic crystal lattice structure, such as silver chloride, silver bromide, silver chlorobromide, silver bromochloride, silver iodobromide, silver iodochloride, silver iodochlorobromide and silver iodobromochloride.

To qualify definitionally as epitaxy the surface portions of the grains must exhibit a detectibly different crystal lattice structure than the host portions of the grains. This is most conveniently satisfied by employing different halide compositions in precipitating the host and surface portions of the grains. Thus, the composite grains can take any of the varied forms disclosed by Maskasky U.S. Pat. Nos. 4,435,501, 4,463,087 and 5,275,930, Ogawa et al U.S. Pat. No. 4,735,894, Yamashita et al U.S. Pat. No. 5,011,767, Haugh et al U.K. Patent 2,038,792, Koitabashi EPO 0 019 917, Ohya et al EPO 0 323 215, Takada EPO 0 434 012, Chen EPO 0 498 302 and Berry and Skillman, "Surface Structures and Epitaxial Growths on AgBr Microcrystals", Journal of Applied Physics, Vol. 35, No. 7, July 1964, pp. 2165–2169.

In one specifically preferred form of the invention the host grains are formed of silver bromide or iodobromide and the epitaxially deposited surface portions are formed by the precipitation of silver chloride. By relying on either the iodide level in the host grains or an adsorbed site director the silver chloride can then be sited at the edges or corners of the host grains. Corner epitaxy produces higher speed composite grains than edge epitaxy and much higher speed composite grains than simply shelling the host grains. Maskasky U.S. Pat. Nos. 4,435,501 and 4,463,087, cited above and here incorporated by reference, disclose tabular and nontabular composite grains, respectively, of this preferred form.

In another preferred form the emulsions of this invention contain high (at least 90 mole percent) chloride grains and contain from 0 to 10 mole percent bromide and from 0 to 2 mole percent iodide. Preferably the composite grains contain at least 0.5 mole percent bromide. The host portion of the grains can consist essentially of silver chloride. The epitaxially deposited surface portions of the grains contain a higher proportion of halides other than chloride than the host grains. Preferably the surface portions of the grains contain a higher proportion of bromide than the host portions of the grains. Composite grains containing higher portions of the halides other than chloride in the surface portions of the grains are illustrated by Tanaka EPO 0 080 905, Hasebe et al U.S. Pat. No. 4,865,962, Asami EPO 0 295 439, Suzumoto et al U.S. Pat. No. 5,252,454, Ohshima et al U.S. Pat. No. 5,252,456, and Maskasky U.S. Pat. No. 5,275,930. The disclosures of these U.S. patents are here incorporated by reference.

The present invention has achieved modifications of photographic performance that can be specifically attributed to the presence of metal coordination complexes containing one or more C—C, H—C or C—N—H organic ligands during the epitaxial deposition portion of composite grain precipitation. The photographic effectiveness of these C—C, H—C or C—N—H organic ligand metal complexes is attributed to the recognition of criteria for selection never previously appreciated by those skilled in the art. Location of the complexes in epitaxially formed surface portions of composite grains has been observed to be a favored location.

The complexes are chosen from among hexacoordination complexes to favor steric compatibility with the face centered cubic crystal structures of silver halide grains. Metals from periods 4, 5 and 6 and groups 3 to 14 inclusive of the periodic table of elements are known to form hexacoordination complexes and are therefore specifically contemplated. Preferred metals for inclusion in the coordination complexes are Group VIII metals. Non-noble Group VIII metals (i.e., the period 4 Group VIII metals) are contemplated for grain incorporation, with iron being a specifically preferred dopant metal. Noble Group VIII metals (those from the palladium and platinum triads) are contemplated, with ruthenium and rhodium being specifically preferred period 5 metal dopants and iridium being a specifically preferred period 6 dopant.

Further defining the coordination complexes are the ligands they contain. The coordination complexes contain a balance of halide and/or pseudohalide ligands (that is, ligands of types well known to be useful in photography) and C—C, H—C or C—N—H organic ligands. To achieve performance modification attributable to the presence of the C—C, H—C or C—N—H organic ligands at least half of the coordination sites provided by the metal ions must be satisfied by pseudohalide, halide or a combination of halide and pseudohalide ligands and at least one of the coordination sites of the metal ion must be occupied by an organic ligand. When the organic ligands occupy all or even the majority of coordination sites in the complex, photographic modifications attributable to the presence of the organic ligand have not been identified.

A surprising discovery has been that the selection of the organic ligands is not limited by steric considerations in the manner indicated by Janusonis et al, McDugle et al, Marchetti et al and Keevert et al, all cited above. Whereas each of these patents teach replacing a single halide ion the crystal lattice structure with a nonhalide ligand occupying exactly the same lattice position, C—C, H—C or C—N—H organic ligands of varied steric configurations have been observed to be effective. While it seems plausible that the smaller of these organic ligands lend themselves to one-for-one displacement of halide ions in the crystal lattice structure, the demonstration of the effectiveness of larger organic ligands and C—C, H—C or C—N—H organic ligands of varied steric forms clearly demonstrates a much broader tolerance for geometrical configuration divergence of the host face centered cubic crystal lattice structure and the ligands of the metal dopant coordination complexes than had heretofore been thought feasible. In fact, the variation of steric forms of C—C, H—C or C—N—H organic ligands observed has led to the conclusion that neither the steric form nor size of the C—C, H—C or C—N—H organic ligand is in itself a determinant of photographic utility.

Metal hexacoordination complexes suitable for use in the practice of this invention have at least one C—C, H—C or C—N—H organic ligand and at least half of the metal coordination sites occupied by halide or pseudohalide ligands. A variety of such complexes are known. The specific embodiments are listed below. Formula acronyms are defined at their first occurrence.

| | |
|---|---|
| MC-1 | $[Sc(NCS)_3(py)_3]$<br>py = pyridine |

Tris(pyridine tris(thiocyanato) scandium (III) Reported by G. Wilkinson, R. D. Gillard and J. A. McCleverty (eds.), Comprehensive Coordination Chemistry, Pergamon 1987.

| | |
|---|---|
| MC-2 | $[M(Cl_3)$ (1,10-phenanthroline) $(H_2O)]$<br>M = La, Ce, Pr, Nd, Sa |

Aquotrichloro(1,10-phenanthroline)lanthanide (III ) Reported by F. A. Hart and F. P. Lamin g, *J. Inorg. Nucl. Chem.*, 26, 579 (1964).

| | |
|---|---|
| MC-3 | $(Et_4N)[TiCl_4(MeCN)_2]$<br>Et = ethyl, Me = methyl<br>Tetraethylammonium bis(acetonitrile)<br>tetrachloro titanium (III) |

Reportedby B. T. Russ and G. W. A. Fowles, *Chem. Comm.*, 1, 19 (1966).

| | |
|---|---|
| MC-4 | $(R_4N)[TiCl_4(EtO)(MeCN)]$<br>$EtO = CH_3CH_2O$ |
| MC-4a | R = Me<br>Tetramethylammonium (acetonitrile)<br>ethoxytetrachloro titanate (IV) |
| MC-4b | R = Et<br>Tetraethylammonium (acetonitrile)<br>ethoxytetrachloro titanate (IV) |

a–b Reported by F. Von Adalbert, *Z. Anorg. Allgem. Chem.*, 338, 147 (1965).

| | |
|---|---|
| MC-5 | $(Et_4N)[TiCl_5(MeCN)]$<br>Tetraethylammonium (acetonitrile)<br>pentachloro titanate (IV) |

Reported by J. M. Kolthoff and F. G. Thomas, *J. Electrochem. Soc.*, 111, 1065 (1964).

| | |
|---|---|
| MC-6 | Pyridinium $[V(NCS)_4(py)_2]$<br>Pyridinium bis(pyridine)<br>tetra(thiocyanato) vanadate (III) |

Reported by R. J. H. Clark, *Comprehensive Inorganic Chemistry*, Vol. 3, pp. 544–545, edited by A. F. Trotman-Dickerson, Pergoman Press, Oxford, 1973.

| | |
|---|---|
| MC-7 | $(Et_4N)[VCl_4(MeCN)_2]$<br>Tetraethylammonium bis(acetonitrile)<br>tetrachloro vanadate (III) |

Reported by R. J. H. Clark, *Comprehensive Inorganic Chemistry*, Vol. 3, pp. 544–545, edited by A. F. Trotman-Dickerson, Pergoman Press, Oxford, 1973.

| | |
|---|---|
| MC-8 | $[WCl_4(en)]$<br>en = ethylenediamine<br>(Ethylenediamine)tetrachloro<br>tungsten (IV) |

Reported by C. D. Kennedy and R. D. Peacock, *J. Chem. Soc.*, 3392 (1963).

| | |
|---|---|
| MC-9 | $(Bu_4N)[Cr(NCO)_4(en)]$<br>Bu = butyl<br>Tetrabutylammonium (ethylenediamine)<br>tetra(cyanato) chromate (III) |

Reported by E. Blasius and G. Klemm, *Z. Anorg. Allgem. Chem.*, 428, 254 (1977).

| | |
|---|---|
| MC-10 | $(Bu_4N)[Cr(NCO)_4(1,2\text{-propanediamine})]$<br>Tetrabutylammonium tetra(cyanato)-<br>(1,2-propanediamine) chromate (III) |

Reported by E. Blasius and G. Klemm, *Z. Anorg. Allgem. Chem.*, 443, 265 (1978).

| | |
|---|---|
| MC-11 | $(Bu_4N)[Cr(NCO)_4(1,2\text{-cyclohexanediamine})]$<br>Tetrabutylammonium tetra(cyanato)-<br>(1,2-cyclohexanediamine) chromate (III) |

Reported by E. Blasius and G. Klemm, *Z. Anorg. Allgem. Chem.*, 443, 265 (1978).

| | |
|---|---|
| MC-12 | $[ReOCl_3(en)]$<br>Trichloro(ethylenediamine)oxo rhenium (V) |

Reported by D. E. Grove and G. Wilkinson, *J. Chem. Soc. (A)*, 1224 (1966).

| | |
|---|---|
| MC-13 | $[ReI_4(py)_2]$<br>Tetraiodobis(pyridine) rhenium (IV) |

Reported by R. Colton, R. Levitus and G. Wilkinson, *J. Chem. Soc.*, 4121 (1960).

| | |
|---|---|
| MC-14 | $Na_3[Fe(CN)_5L]$ |
| MC-14a | L = (py)<br>Sodium pentacyano(pyridine) ferrate (II) |
| MC-14b | L = pyrazine = (pyz)<br>Sodium pentacyano(pyrazine) ferrate (II) |
| MC-14c | L = 4,4'-bipyridine<br>Sodium pentacyano(4,4'-bipyridine) ferrate (II) |
| MC-14d | L = 3,3'-dimethyl-4,4'-bipyridine<br>Sodium pentacyano(3,3'-dimethyl-4,4'-bipyridine) ferrate (II) |
| MC-14e | L = 3,8-phenanthroline<br>Sodium pentacyano(3,8-phen anthroline) ferrate (II) |
| MC-14f | L = 2,7-diazapyrene<br>Sodium pentacyano(2,7-diazapyrene) ferrate (II) |
| MC-14g | L = 1,4-bis(4-pyridyl)butadiyne<br>Sodium pentacyano[1,4-bis(4-pyridyl)butadiyne) ferrate (II) |

a–g Reported by G. H. Lee, L. D. Ciana, A. Haim, *J. Am. Chem. Soc.*, 111, 1235–41 (1989).

| | |
|---|---|
| MC-14h | L = (4-py)pyridinium<br>Sodium pentacyano(4-pyridylpyridinium) ferrate (II) |
| MC-14i | L = 1-methyl-4-(4-py)pyridinium<br>Sodium pentacyano[1-methyl-4-(4-pyridyl)pyridium] ferrate (II) |
| MC-14j | L = N—Me-pyrazinium<br>Sodium pentacyano(N-methyl pyrazinium) ferrate (II) |
| MC-14k | L = 4-Cl(py)<br>Sodium pentacyano(4-chloro pyridine) ferrate (II) |

h–k Reported by H. E. Toma and J. M. Malin, *Inorg. Chem.* 12, 1039 (1973).

| | |
|---|---|
| MC-14l | L = $Ph_3P$<br>Ph = phenyl<br>Sodium pentacyano(tri phenylphosphine) ferrate (II) |

Reported by M. M. Monzyk and R. A. Holwerda, *Polyhedron*, 2433 (1990).

| | |
|---|---|
| MC-14m | L = thiourea<br>Sodium pentacyano (thiourea) ferrate (II) |
| MC-14n | L = pyrazole<br>Sodium pentacyano (pyrazole) ferrate (II) |
| MC-14o | L = imidazole<br>Sodium pentacyano (imidazole) ferrate (II) |

m–o Reported by C. R. Johnson, W. W. Henderson and R. E. Shepherd, *Inorg. Chem.*, 23, 2754 (1984).

| | |
|---|---|
| MC-14p | L = $MeNH_2$<br>Sodium pentacyano (methylamine) ferrate (II) |

-continued

| | |
|---|---|
| MC-14q | L = $Me_2NH$<br>Sodium pentacyano (dimethylamine) ferrate (II) |
| MC-14r | L = $Me_3NH$<br>Sodium pentacyano (trimethylamine) ferrate (II) |
| MC-14s | L = $EtNH_2$<br>Sodium pentacyano (ethylamine) ferrate (II) |
| MC-14t | L = $BuNH_2$<br>Sodium pentacyano (butylamine) ferrate (II) |
| MC-14u | L = cyclohexylamine<br>Sodium pentacyano (cyclohexylamine) ferrate (II) |
| MC-14v | L = piperidine<br>Sodium pentacyano (piperidine) ferrate (II) |
| MC-14w | L = aniline<br>Sodium pentacyano (aniline) ferrate (II) |
| MC-14x | L = morpholine<br>Sodium pentacyano (morpholine) ferrate (II) |
| MC-14y | L = ethanolamine<br>Sodium pentacyano (ethanolamine) ferrate (II) |

p–y Reported by N. E. Klatz, P. J. Aymoneno, M. A. Blesa and J. A. Olabe, *Inorg. Chem.* 17, 556 (1978).

| | |
|---|---|
| MC-14z | L = $P(OBu)_3$<br>Sodium pentacyano(tributyl phosphite) ferrate (II) |
| MC-14aa | L = $P(Bu)_3$<br>Sodium pentacyano[(tri butyl)phosphine] ferrate (II) |

z–aa Reported by V. H. Inouye, E. Fluck, H. Binder and S. Yanagisawa, *Z. Anorg. Allgem. Chem.*, 483, 75–85 (1981).

| | |
|---|---|
| MC-14bb | L = p-nitroso-N,N-dimethylaniline<br>Sodium pentacyano(p-nitroso N,N-dimethylaniline) ferrate (II) |
| MC-14cc | L = nitrosobenzene<br>Sodium pentacyano(nitroso benzene) ferrate (II) |
| MC-14dd | L = 4-CN-(py)<br>Sodium pentacyano(4-cyano pyridine) ferrate (II) |

bb–dd Reported by Z. Bradic, M. Pribanic and S. Asperger, *J. Chem. Soc.*, 353 (1975).

| | |
|---|---|
| MC-14ee | L = 3-[$(H_5C_2)_2NC(O)$](py)<br>Sodium pentacyano-(nicotinamide) ferrate (II) |
| MC-14ff | L = 4-[$NH_2NHC(O)$](py)<br>Sodium pentacyano(iso nicotinoylhydrazine) ferrate (II) |
| MC-14gg | L = 3-CHO-(py)<br>Sodium pentacyano (nicotinaldehyde) ferrate (II) |
| MC-14hh | L = 3-[$NH_2C(O)$](py)<br>Sodium pentacyano (nicotinamide) ferrate (II) |
| MC-14ii | L = 4-[$NH_2C(O)$](py)<br>Sodium pentacyano(iso nicotinamide) ferrate (II) |

-continued

| | |
|---|---|
| MC-14jj | L = 3-[$^-$OC(O)](py)<br>Sodium pentacyano<br>(nicotinato) ferrate (II) |
| MC-14kk | L = 4-[$^-$OC(O)](py)<br>Sodium pentacyano(iso<br>nicotinato) ferrate (II) |
| MC-14ll | L = 3-[$^-$OC(O)$CH_2$NHC(O)](py)<br>Sodium pentacyano(nico<br>tinoylglycinato) ferrate (II) |
| MC-14mm | L = $H_2$NC(O)](pyz)<br>Sodium pentacyano(pyrazine<br>amide) ferrate (II) |
| MC-14nn | L = (pyz)-mono-N-oxide<br>Sodium pentacyano(pyrazine<br>mono-N-oxide) ferrate (II) |

ee–nn Reported by P. J. Morando, U. I. E. Bruyere and M. A. Blesa, *Transition Metal Chem.*, 8, 99 (1983).

| | |
|---|---|
| MC-14oo | L = 4-Ph(py)<br>Sodium pentacyano(4-phenyl<br>pyridine) ferrate (II) |
| MC-14pp | L = pyridazine<br>Sodium pentacyano<br>(pyridazine) ferrate (II) |
| MC-14qq | L = pyrimidine<br>Sodium pentacyano<br>(pyrimidine) ferrate (II) |

oo–qq Reportedby D. K. Lavallee and E. B. Fleischer, *J. Am. Chem. Soc.*, 94 (8), 2583 (1972).

| | |
|---|---|
| MC-14rr | L = $Me_2SO$<br>Sodium pentacyano(dimethyl<br>sulfoxide) ferrate (II) |

Reported by H. E. Toma, J. M. Malin and E. Biesbrecht, *Inorg. Chem.*, 12, 2884 (1973).

| | |
|---|---|
| MC-15<br>MC-15a | $K_3[Ru(CN)_5L]$<br>L = (pyz)<br>Potassium pentacyano<br>(pyrazine) ruthenate (II) |

Reportedby C. R. Johnson and R. E. Shepherd, *Inorg. Chem.*, 22, 2439 (1983).

| | |
|---|---|
| MC-15b | L = methylpyrazinium<br>Potassium pentacyano<br>(methylpyrazinium) ruthenate (II) |
| MC-15c | L = imidazole<br>Potassium pentacyano<br>(imidazole) ruthenate (II) |
| MC-15d | L = 4-pyridylpyridinium<br>Potassium pentacyano-<br>(4-pyridylpyridinium) ruthenate (II) |
| MC-15e | L = 4,4'-bipyridine<br>Potassium pentacyano-<br>(4,4'-bipyridine) ruthenate (II) |
| MC-15f | L = $Me_2SO$<br>Potassium pentacyano<br>(dimethylsulfoxide) ruthenate (II) |
| MC-15g | L = (py)<br>Potassium pentacyano<br>(pyridine) ruthenate (II) |
| MC-15h | L = 4-[$^-$OC(O)](py)<br>Potassium pentacyano<br>(isonicotinato) ruthenate (II) |

b–h Reported by M. A. Hoddenbagh and D. A. McCartney, *Inorg. Chem.*, 25, 2099 (1986).

| | |
|---|---|
| MC-16<br>MC-16a | $K_2[Co(CN)_5L]$<br>L = Me<br>Potassium pentacyano(methyl)<br>cobaltate (III) |
| MC-16b | L = Et<br>Potassium pentacyano(ethyl)<br>cobaltate (III) |
| MC-16c | L = tolyl<br>Potassium pentacyano(tolyl)<br>cobaltate (III) |
| MC-16d | L = acetamide<br>Potassium pentacyano(acetamide)<br>cobaltate (III) |
| MC-16e | L = —$CH_2C(O)O^-$<br>Potassium pentacyano(acetato)<br>cobaltate (III) |
| MC-16f | L = —$CH_2C(O)OCH_3$<br>Potassium pentacyano(methyl<br>acetate) cobaltate (III) |
| MC-16g | L = —$CH_2CH_2C(O)OCH_3Me$<br>Potassium pentacyano(methyl<br>proponato) cobaltate (III) |

a–g Reported by J. Halpern and J. P. Maher, *J. Am. Chem. Soc.*, 87, 5361 (1965).

| | |
|---|---|
| MC-17 | K $[Co(CN)_4(en)]$<br>Potassium tetracyano<br>(ethylenediamine) cobaltate (III) |

Reported by K. Ohkawa, J. Fujita and Y. Shimura, *Bulletin of the Chemical Society of Japan*, 42, 3184–9 (1969).

| | |
|---|---|
| MC-18 | $Ba[Co(CN)_4(tn)]$<br>(tn) = trimethylenediamine<br>Barium tetracyano<br>(trimethylenediamine) cobaltate (III) |

Reported by K. Ohkawa, J. Fujita and Y. Shimura, *Bulletin of the Chemical Society of Japan*, 42, 3184–9 (1969).

| | |
|---|---|
| MC-19<br>MC-19a | $[RhL_3Cl_3]$<br>L = MeCN<br>Tris(acetonitrile)<br>trichloro rhodium (III) |
| MC-19b | L = PhCN<br>Tris(benzonitrile)<br>trichloro rhodium (III) |

a–b Reported by G. Beech and G. Marr, *J. Chem. Soc. (A)*, (1970).

| | |
|---|---|
| MC-20 | $Na_2[RhCl_5(SMe_2)]$<br>Sodium pentachloro(di<br>methylsulfide) rhodate (III) |

Reported by S. J. Anderson, J. R. Barnes, P. L. Goggin and R. S. Goodfellow, *J. Chem. Res. (M)*, 3601 (1978).

| | |
|---|---|
| MC-21 | cis,trans-$[RhX_4(SMe_2)_2]$<br>X = halo<br>cis or trans-Tetrahalobis<br>(dimethylsulfide) rhodate (III) |

Reported by S. J. Anderson, J. R. Barnes, P. L. Goggin and R. S. Goodfellow, *J. Chem. Res. (M),* 3601 (1978).

| | |
|---|---|
| MC-22 | mer,fac-$[RhX_3(SMe_2)_3]$<br>met or fac-Trihalotris(di-<br>methylsulfide) rhodate (III) |

Reported by S. J. Anderson, J. R. Barnes, P. L. Goggin and R. S. Goodfellow, *J. Chem. Res. (M),* 3601 (1978).

| | |
|---|---|
| MC-23 | cis,trans-$[N(C_3H_7)_4][RhCl_4(Me_2SO)_2]$<br>Tetrapropylammonium tetrachloro<br>bis(dimethylsulfoxide) rhodium (III) |

Reported by Y. N. Kukushkin, N. D. Rubtsora and N. Y. Irannikova, *Russ. J. Inorg. Chem.* (Trans. Ed.), 15, 1032 (1970).

| | |
|---|---|
| MC-24 | $[RhCl_3(Me_2SO)_3]$<br>Trichlorotris(di<br>methylsulfoxide) rhodium (III) |

Reported by Y. N. Kukushkin, N. D. Rubtsora and N. Y. Irannikova, *Russ. J. Inorg. Chem.* (Trans. Ed.), 15, 1032 (1970).

| | |
|---|---|
| MC-25 | $K[RhCl_4L]$ |
| MC-25a | L = 1,10-phenanthroline<br>Potassium tetrachloro(1,10-<br>phenanthroline) rhodate (III) |
| MC-25b | L = 5-methyl(1,10-phenanthroline)<br>Potassium tetrachloro[5-methyl(1,10-<br>phenanthroline)] rhodate (III) |
| MC-25c | L = 5,6-dimethyl(1,10-phenanthroline)<br>Potassium tetrachloro[5,6-dimethy-<br>(1,10-phenanthroline)] rhodate (III) |
| MC-25d | L = 5-bromo(1,10-phenanthroline)<br>Potassium tetrachloro[5-bromo(1,10-<br>phenanthroline)] rhodate (III) |
| MC-25e | L = 5-chloro(1,10-phenanthroline)<br>Potassium tetrachloro[5-chloro(1,10-<br>phenanthroline)] rhodate (III) |
| MC-25f | L = 5-nitro(1,10-phenanthroline)<br>Potassium tetrachloro[5-nitro(1,10-<br>phenanthroline)] rhodate (III) |
| MC-25g | L = 4,7-diphenyl(1,10-phenanthroline<br>Potassium tetrachloro(1,10-<br>phenanthroline) rhodate (III) |

a–g Reported by R. J. Watts and J. Van Houten, *J. Am. Chem. Soc.,* 96, 4334 (1974).

| | |
|---|---|
| MC-26 | $K[IrX_4(en)]$ |
| MC-26a | X = Cl<br>Potassium tetrachloro(ethyl<br>enediamine) iridate (III) |
| MC-26b | X = Br |

-continued

| | |
|---|---|
| | Potassium tetrabromo(ethyl<br>enediamine) iridate (III) |

a–b Reported by I. B. Barnovskii, R. E. Sevast'ynova, G. Y. Mazo and V. I. Nefadov, *Russ. J. of Inorg. Chem.,* (Trans. Ed.) 19, 1974.

| | |
|---|---|
| MC-27 | $K[IrCl_x(MeCN)_y]$ |
| MC-27a | x = 4, y = 2<br>Potassium tetrachloro<br>bis(acetonitrile) iridate (III) |
| MC-27b | x = 5, y = 1<br>(acetonitrile) iridate (III) |

a–b Reported by B. D. Catsikis and M. L. Good, *Inorg. Nucl. Chem. Lett.,* 9, 1129–30 (1973).

| | |
|---|---|
| MC-28 | $[N(Me)_4][IrCl_4(MeSCH_2CH_2SMe)]$<br>Tetramethylammonium tetrachloro-<br>(2,5-dithiahexane) iridate (III) |

Reported by D. J. Gulliver, W. Levason, K. G. Smith and M. J. Selwood, *J. Chem. Soc.* Dalton trans, 1872–8 (1980).

| | |
|---|---|
| MC-29 | $K_m[IrX_x(pyz)_yL_n]$ |
| MC-29a | X = Cl, m = 2, n = 0, x = 5, y = 1<br>Potassium pentachloro<br>(pyrazine) iridate (III) |
| MC-29b | X = Cl, m = 1, n = 0, x = 4,<br>y = 2, cis isomer<br>Potassium tetrachloro<br>biscis(pyrazine) iridate (III) |
| MC-29c | X = Cl, m = 1, n = 0, x = 4,<br>y = 2, trans isomer<br>Potassium tetrachloro<br>bistrans(pyrazine) iridate (III) |
| MC-29d | X = Cl, m = 1, n = 0, x = 3, y = 3<br>Potassium trichloro<br>tris(pyrazine) iridate (III) |

a–d Reported by F. Lareze, *C. R. Acad. Sc. Paris,* 261, 3240 (1965).

| | |
|---|---|
| MC-30 | $K_2[IrCl_5(pyrimidine)]$<br>Potassium pentachloro<br>(pyrimidine) iridate (III) |

Reported by F. Larese and L. Bokobza-Sebagh, *C. R. Acad. Sc. Paris,* 277, 459 (1973).

| | |
|---|---|
| MC-31 | $K_4[Ir_2Cl_{10}(pyz)]$<br>Potassium decachloro<br>(μ-pyrazine) bis[pentachloroiridate (III)] |

Reported by F. Lareze, C. R. Acad. Sc.Paris, 282, 737 (1976).

| | |
|---|---|
| MC-32 | $K_m[IrCl_x(py)_yL_n]$ |

-continued

| | |
|---|---|
| MC-32a | m = 2, n = 0, x = 5, y = 1<br>Potassium pentachloro<br>(pyridine) iridate (III) |
| MC-32b | m = 1, n = 0, x = 4, y = 2<br>Potassium tetrachloro<br>bis(pyridine) iridate (III) |
| MC-32c | m = 0, n = 0, x = 3, y = 3<br>Trichlorotris(pyridine)<br>iridate (III) |
| MC-32d | L = pyridazine, m = 0, n = 1,<br>x = 5, y = 0<br>Potassium pentachloro<br>(pyridazine) iridate (III) |

a–d Reported by G. Rio and F. Larezo, *Bull. Soc. Chim. France,* 2393 (1975).

| | |
|---|---|
| MC-32e | L = ($C_2O_4$), m = 2, n = 1, x = 3, y = 1,<br>Potassium trichloro(oxalate)<br>(pyridine) iridate (III) |

Reported by Y. Inamura, *Bull. Soc. China,* 7, 750 (1940).

| | |
|---|---|
| MC-32f | L = (HOH), m = 0, n = 1, x = 3, y = 2<br>Trichloromonoaquo<br>(pyridine iridium (III) |

Reported by M. Delepine, *Comptes Rendus,* 200, 1373 (1935).

| | |
|---|---|
| MC-33 | $K_3[IrCl_4(C_2O_4)]$<br>Potassium tetrachloro<br>oxalato iridate (III) |

Reported by A. Duffour, *Comptes Rendus,* 152, 1393 (1911).

| | |
|---|---|
| MC-34 | $[In(thiourea)_3(NCS)_3]$<br>Tris(isothiocyanato)<br>trithiourea indium (III) |

Reported by S. J. Patel, D. B. Sowerby and D. G. Tuck, *J. Chem. Soc. (A),* 1188 ( 1967) .

| | |
|---|---|
| MC-35 | $[In(dimac)_3(NCS)_3]$<br>dimac = N,N-dimethylacetamide<br>Tris(N,N-dimethylacetamide)<br>tris(isothiocyanato) indium (III) |

Reported by S. J. Patel, D. B. Sowerby and D. G. Tuck, *J. Chem. Soc. (A),* 11–88 (1967).

| | |
|---|---|
| MC-36 | $[Et_4N]_2[Me_mSn(SCN)_n]$ |

a–b Reported by A. Cassal, R. Portanova and Barbieri, *J. Inorg. Nucl. Chem.,* 27, 2275 (1965).

| | |
|---|---|
| MC-37 | $Na_6[Fe_2(CN)_{10}(pyz)]$ |

-continued

| | |
|---|---|
| | Sodium decacyano(μ-pyrazine)<br>diferrate (II) |

Reported by J. M. Malin, C. F. Schmitt, H. E. Toma, *Inorg. Chem.,* 14, 2924 (1975)

| | |
|---|---|
| MC-38 | $Na_6[Fe_2(CN)_{10}$(μ-4,4'-bipyridine)]<br>Sodium decacyano(μ-4,4'-bipyridine)<br>diferrate (II) |

Reported by J. E. Figard, J. V. Paukstelis, E. F. Byrne and J. D. Peterson, *J. Am. Chem. Soc.,* 99, 8417 (1977).

| | |
|---|---|
| MC-39 | $Na_6[Fe_2(CN)_{10}L]$<br>L = trans-1,2-bis(4-pyridyl)ethylene<br>Sodium decacyano[μ-trans-1,2-<br>bis(4-pyridyl)ethylene]<br>diferrate (II) |

Reported by N. E. Katz, *An. Quim. Ser. B,* 77(2), 154–6.

| | |
|---|---|
| MC-40 | $Na_5[(CN)_5FeLCo(CN)_5]$ |
| MC-40a | L = (pyz)<br>Sodium decacyano(μ-pyrazine)<br>ferrate (II) cobaltate (III) |
| MC-40b | L = 4,4'-bipyridine<br>Sodium decacyano(μ-4,4'-bipyridine)<br>ferrate (II) cobaltate (III) |
| MC-40c | L = 4-cyanopyridine<br>Sodium decacyano(μ-4-cyanopyridine)<br>ferrate (II) cobaltate (III) |

Reported by K. J. Pfenning, L. Lee, H. D. Wohlers and J. D. Peterson, *Inorg. Chem.,* 21, 2477 (1982).

In addition to the illustrative known compounds, compounds not located in the literature have been synthesized and employed in the practice of the invention. These compounds include the following:

| | |
|---|---|
| MC-41 | $K_2[IrCl_5$(thiazole)]<br>Potassium pentachloro<br>(thiazole) iridate (III) |
| MC-42 | $Na_3K_2[IrCl_5(pyz)Fe(CN)_5]$<br>Potassium sodium<br>pentachloro iridate (III)<br>(μ-pyrazine) pentacyano ferrate (II) |
| MC-43 | $K_5[IrCl_5(pyz)Ru(CN)_5]$<br>Potassium pentachloro<br>iridate (III) (μ-pyrazine)<br>pentacyano ruthenate (II) |
| MC-44 | $Na_3K_3[Fe(CN)_5(Pyz)Ru(CN)_5]$<br>Potassium sodium<br>decacyano(μ-pyrazine)<br>ferrate (II) ruthenate (II) |
| MC-45 | $K_2[Rh(CN)_5(tz)]$<br>tz = thiazole<br>Potassium pentacyano<br>(thiazole) rhodate (III) |
| MC-46 | $Na_4[Rh_2Cl_{10}(pyz)]$<br>Sodium decachloro<br>(pyrazine) rhodate (III) |
| MC-47 | $Rh[Cl_3(oxazole)_3]$<br>Trichloro<br>tris(oxazole) rhodium (III) |
| MC-48 | $Na_3[Fe(CN)_5TQ]$ |

-continued

| | |
|---|---|
| | TQ = (5-triazolo[4,3-a]quinoline) Sodium pentacyano(5-triazolo-[(4,3-a]quinoline) ferrate (II) |
| MC-49 | $K[IrCl_4(tz)_2]$ Potassium tetrachloro (thiazole) iridate (III) |
| MC-50 | $K_2[IrBr_5(tz)]$ Potassium pentabromo (thiazole) iridate (III) |
| MC-51 | $K[IrBr_4(tz)_2]$ Potassium tetrabromo bis(thiazole) iridate (III) |
| MC-52 | $K[IrCl_4(H_2O)(tz)]$ Potassium aquo tetrachloro (thiazole) iridate (III) |
| MC-53 | $K[IrCl_4(4\text{-methylthiazole})_2]$ Potassium bis(4-methylthiazole) tetrachloro iridate (III) |
| MC-54 | $K_2[IrCl_5(5\text{-methylthiazole})]$ Potassium (5-methylthiazole) pentachloro iridate (III) |
| MC-55 | $K[IrCl_4(5\text{-methylthiazole})_2]$ Potassium bis(5-methylthiazole) tetrachloro iridate (III) |
| MC-56 | $K[IrCl_4(4,5\text{-dimethylthiazole})_2]$ Potassium bis(4,5-dimethylthiazole) tetrachloro iridate (III) |
| MC-57 | $K[IrCl_4(2\text{-bromothiazole})_2]$ Potassium bis(2-bromothiazole) tetrachloro iridate (III) |
| MC-58 | $K[IrCl_4(2\text{-methyl-2-thiazoline})_2]$ Potassium bis(2-methyl-2-thiazoline) tetrachloro iridate (III) |
| MC-59 | $K_2[IrCl_5(3\text{-chloropyrazine})]$ Potassium (3-chloropyrazine) pentachloro iridate (III) |
| MC-60 | $K_2[IrCl_5(3,5\text{-dichloropyrazine})]$ Potassium (3,5-dichloropyrazine) pentachloro iridate (III) |
| MC-61 | $K_2[IrCl_5(3\text{-methylpyrazine})]$ Potassium (3-methylpyrazine) pentachloro iridate (III) |
| MC-62 | $K_2[IrCl_5(3,5\text{-dimethylpyrazine})]$ Potassium (3,5-dimethylpyrazine) pentachloro iridate (III) |
| MC-63 | $K_2[IrCl_5(3\text{-methoxypyrazine})]$ Potassium (3-methoxypyrazine) pentachloro iridate (III) |
| MC-64 | $K_2[IrCl_5(3\text{-cyanopyrazine}))$ Potassium pentachloro (3-cyanopyrazine) iridate (III) |
| MC-65 | $K_2[IrCl_5(2,5\text{-dimethylpyrazine})].\frac{1}{3}CH_3OH$ Potassium (2,5-dimethylpyrazine) pentachloro iridate (III) methanol |
| MC-66 | $[N\text{—}CH_3N_2C_4H_4][IrCl_5(4\text{-}CH_3N_2C_4H_4)]$ N-Methylpyrazinium (N-methylpyrazinium) pentachloro iridate (III) |

Preparations of these compounds are presented below.

Generally any C—C, H—C or C—N—H organic ligand capable of forming a dopant metal hexacoordination complex with at least half of the metal coordination sites occupied by halide or pseudohalide ligands can be employed. This, of course, excludes coordination complexes such as metal ethylenediaminetetraacetic acid (EDTA) complexes, since EDTA itself occupies six coordination sites and leaves no room for other ligands. Similarly, tris(oxalate) and bis(oxalate) metal coordination complexes occupy too many metal coordination sites to allow the required inclusion of other ligands.

By definition, to be considered C—C, H—C or C—N—H organic a ligand must include at least one carbon-to-carbon bond, at least one carbon-to-hydrogen bond or at least one hydrogen-to-nitrogen-to-carbon bond linkage. A simple example of an organic ligand classifiable as such solely by reason of containing a carbon-to-carbon bond is an oxalate (—O(O)C—C(O)O—) ligand. A simple example of an organic ligand classifiable as such solely by reason of containing a carbon-to-hydrogen bond is a methyl (—$CH_3$) ligand. A simple example of a C—C, H—C or C—N—H organic ligand classifiable as such solely by reason of containing a hydrogen-to-nitrogen-to-carbon bond linkage is a ureido [—HN—C(O)—NH—] ligand. All of these ligands fall within the customary contemplation of C—C, H—C or C—N—H organic ligands. The organic ligand definition excludes compounds lacking C—C, H—C or C—N—H organic characteristics, such as ammonia, which contains only nitrogen-to-hydrogen bonds, and carbon dioxide, which contains only carbon-to-oxygen bonds.

The realization of useful photographic performance modifications through the use of C—C, H—C or C—N—H organic ligands is based on performance comparisons and is independent of any particular theory. By comparing the C—C, H—C or C—N—H organic ligand definition bonding requirements with the bonds present in ligands heretofore reported to have been incorporated in silver halide grain structures, it is recognized that the definitionally required bonding present in the organic ligands differentiates them structurally from known ligand dopants. The balancing of halide and pseudohalide ligands with one or more C—C, H—C or C—N—H organic ligands to achieve useful photographic effects is consistent with the halide and pseudohalide ligands occupying halide ion lattice sites in the crystal structure. On the other hand, the diversity of size and steric forms of the C—C, H—C or C—N—H organic ligands shown to be useful supports the position that photographic effectiveness extends beyond the precepts of prior substitutional models. It is now specifically contemplated that C—C, H—C or C—N—H organic ligand effectiveness can be independent of size or steric configuration and is limited only by their availability in metal dopant ion hexacoordination complexes. Nevertheless, since there is no known disadvantage for choosing C—C, H—C or C—N—H organic ligands based on host crystal lattice steric compatibility or approximations of steric compatibility nor have any advantages been identified for increasing ligand size for its own sake, the preferred C—C, H—C or C—N—H organic ligand selections discussed below are those deemed most likely to approximate host crystal lattice compatibility. In other words, while the precept of host crystal lattice matching as an essential prerequisite of ligand utility has been discredited, there are significant advantages to be gained by selecting C—C, H—C or C—N—H organic ligands on the basis of their exact or approximate conformation to the host crystal lattice.

In general preferred individual C—C, H—C or C—N—H organic ligands contain up to 24 (optimally up to 18) atoms of sufficient size to occupy silver or halide ion sites within the grain structure. Stated another way, the C—C, H—C or C—N—H organic ligands preferably contain up to 24 (optimally up to 18) nonmetallic atoms. Since hydrogen atoms are sufficiently small to be accommodated interstitially within a silver halide face centered cubic crystal structure, the hydrogen content of the organic ligands poses no selection restriction. While organic ligands can contain metallic ions, these also are readily sterically accommodated within the crystal lattice structure of silver halide, since metal ions are, in general, much smaller than nonmetallic ions of similar atomic number. For example, silver ion (atomic number 47) is much smaller than bromide ion (atomic number 35). In the overwhelming majority of instances the organic ligands consist of hydrogen and nonmetallic atoms selected from among carbon, nitrogen, oxygen, fluorine, sulfur, selenium, chlorine and bromine. The steric accommodation of iodide ions within silver bromide face centered cubic crystal lattice structures is well known in photography. Thus, even the heaviest non-metallic atoms, iodine and tellurium, can be included within the C—C, H—C or C—N—H organic ligands, although their occurrence is preferably limited (e.g., up to 2 and optimally only 1) in any single organic ligand.

Referring to the illustrations of C—C, H—C or C—N—H organic ligand containing coordination complexes above, it is apparent that a wide variety of C—C, H—C or C—N—H organic ligands are available for selection. Organic ligands can be selected from among a wide range of organic families, including substituted and unsubstituted aliphatic and aromatic hydrocarbons, secondary and tertiary amines (including diamines and hydrazines), phosphines, amides (including hydrazides), imides, nitriles, aldehydes, ketones, organic acids (including free acids, salts and esters), sulfoxides, and aliphatic and aromatic heterocycles including chalcogen (i.e., oxygen, sulfur, selenium and tellurium) and pnictide (particularly nitrogen) hetero ring atoms. The following are offered as nonlimiting illustrations of preferred organic ligand categories:

Aliphatic hydrocarbon ligands containing up to 10 (most preferably up to 6) nonmetallic (e.g., carbon) atoms, including linear, branched chain and cyclic alkyl, alkenyl, dialkenyl, alkynyl and dialkynyl ligands.

Aromatic hydrocarbon ligands containing 6 to 14 ring atoms (particularly phenyl and naphthyl).

Aliphatic azahydrocarbon ligands containing up to 14 nonmetallic (e.g., carbon and nitrogen) atoms. The term "azahydrocarbon" is employed to indicate nitrogen atom substitution for at least one, but not all, of the carbon atoms. The most stable and hence preferred azahydrocarbons contain no more than one nitrogen-to-nitrogen bond. Both cyclic and acyclic azahydrocarbons are particularly contemplated.

Aliphatic and aromatic nitriles containing up to 14 carbon atoms, preferably up to 6 carbon atoms.

Aliphatic ether and thioether ligands, the latter also being commonly named as thiahydrocarbons in a manner analogous to azahydrocarbon ligands. Both cyclic and acyclic ethers and thioethers are contemplated.

Amines, including diamines, most preferably those containing up to 12 (optimally up to 6) nonmetal (e.g., carbon) atoms per nitrogen atom organic substituent. Note that the amines must be secondary or tertiary amines, since a primary amine ($H_2N$—), designated by the term "amine" used alone, does not satisfy the organic ligand definition.

Amides, most preferably including up to 12 (optimally up to 6) nonmetal (e.g., carbon) atoms.

Aldehydes, ketones, carboxylates, sulfonates and phosphonates (including mono and dibasic acids, their salts and esters) containing up to 12 (optimally up to 7) nonmetal (e.g., carbon) atoms.

Aliphatic sulfoxides containing up to 12 (preferably up to 6) nonmetal (e.g., carbon) atoms per aliphatic moiety.

Aromatic and aliphatic heterocyclic ligands containing up to 18 ring atoms with heteroatoms typically being selected from among pnictides (e.g., nitrogen) and chalcogens (e.g., oxygen, sulfur, selenium and tellurium). The heterocyclic ligands contain at least one five or six membered heterocyclic ring, with the remainder of the ligand being formed by ring substituents, including one or more optional pendant or fused carbocyclic or heterocyclic rings. In their simplest form the heterocycles contain only 5 or 6 non-metallic atoms. Exemplary nonlimiting illustrations of heterocyclic ring structures include furans, thiophenes, azoles, diazoles, triazoles, tetrazoles, oxazoles, thiazoles, imidazoles, azines, diazines, triazines, as well as their dihydro (e.g., oxazoline, thiazoline and imidazoline), bis (e.g., bipyridine) and fused ring counterparts (e.g., benzo- and napthoanalogues). When a nitrogen hetero atom is present, each of trivalent, protonated and quaternized forms are contemplated. Among specifically preferred heterocyclic ring moieties are those containing from 1 to 3 ring nitrogen atoms and azoles containing a chalcogen atom.

All of the above C—C, H—C or C—N—H organic ligands can be either substituted or unsubstituted. Any of a broad range of stable and synthetically convenient substituents are contemplated. Halide, pseudohalide, hydroxyl, nitro and organic substituents that are linked directly or through divalent oxygen, sulfur or nitrogen linkages are specifically contemplated, where the organic substituents can be simple or composite forms of the types of organic substituents named above.

The requirement that at least one of the coordination complex ligands be a C—C, H—C or C—N—H organic ligand and that half of the ligands be halide or pseudohalide ligands permits one or two of the ligands in hexacoordination complexes to be chosen from among ligands other than C—C, H—C or C—N—H organic, halide and pseudohalide ligands. For example, nitrosyl (NO), thionitrosyl (NS), carbonyl (CO), oxo (O) and aquo (HOH) ligands are all known to form coordination complexes that have been successfully incorporated in silver halide grain structures. These ligands are specifically contemplated for inclusion in the coordination complexes satisfying the requirements of the invention.

In general any known dopant metal ion coordination complex containing the required balance of halo and/or pseudohalo ligands with one or more C—C, H—C or C—N—H organic ligands can be employed in the practice of the invention. This, of course, assumes that the coordination complex is structurally stable and exhibits at least very slight water solubility under silver halide precipitation conditions. Since silver halide precipitation is commonly practiced at temperatures ranging down to just above ambient (e.g., typically down to about 30° C.), thermal stability requirements are minimal. In view of the extremely low levels of dopants that have been shown to be useful in the art, only extremely low levels of water solubility are required.

The C—C, H—C or C—N—H organic ligand containing coordination complexes satisfying the requirements above can be present during silver halide emulsion precipitation in any conventional level known to be useful for the metal dopant ion. Evans U.S. Pat. No. 5,024,931, discloses effective doping with coordination complexes containing two or more Group VIII noble metals at concentrations that provide on average two metal dopant ions per grain. To achieve this, metal ion concentrations of $10^{-10}$M are provided in solution, before blending with the emulsion to be doped. Typically useful metal dopant ion concentrations, based on silver, range from $10^{-10}$ to $10^{-3}$ gram atom per mole of silver. A specific concentration selection is dependent upon the specific photographic effect sought. For example, Dostes et al Defensive Publication T962,004 teaches metal ion dopant concentrations ranging from as low as $10^{-10}$ gram atom/Ag mole for reducing low intensity reciprocity failure and kink desensitization in negative-working emulsions; Spence et al U.S. Pat. Nos. 3,687,676 and 3,690,891 teach metal ion dopant concentrations ranging as high as $10^{-3}$ gram atom/Ag mole for avoidance of dye desensitization. While useful metal ion dopant concentrations can vary widely, depending upon the halide content of the grains, the metal ion dopant selected, its oxidation state, the specific ligands chosen, and the photographic effect sought, concentrations of less than $10^{-6}$ gram atom/Ag mole are contemplated for improving the performance of surface latent image forming emulsions without significant surface desensitization. Concentrations of from $10^{-9}$ to $10^{-6}$ gram atom/Ag mole have been widely suggested. Graphic arts emulsions seeking to employ metal dopants to increase contrast with incidental or even intentionally sought speed loss often range somewhat higher in metal dopant concentrations than other negative-working emulsions, with concentrations of up to $10^{-4}$ gram atom/Ag mole being common. For internal electron trapping, as is commonly sought in direct-positive emulsions, concentrations of greater than $10^{-6}$ gram atom/Ag mole are generally taught, with concentrations in the range of from $10^{-6}$ to $10^{-4}$ gram atom/Ag mole being commonly employed. For complexes that contain a single metal dopant ion molar and gram atom concentrations are identical; for complexes containing two metal dopant ions gram atom concentrations are twice molar concentrations; etc. Following the accepted practice of the art, stated dopant concentrations are nominal concentrations—that is, they are based on the dopant and silver added to the reaction vessel prior to and during emulsion precipitation.

The metal dopant ion coordination complexes can be introduced during emulsion precipitation employing procedures well known in the art. The coordination complexes can be introduced during precipitation of the host grain portions as well as during precipitation of the epitaxially deposited host grain portions. It is preferred, however, that the metal dopant coordination complexes containing one or more C—C, H—C or C—N—H organic ligands be introduced primarily and, most preferably, entirely during precipitation of the epitaxially deposited surface portions of the grains. Typically the coordination complexes are introduced at least in part during precipitation through one of the halide ion or silver ion jets or through a separate jet. Typical types of coordination complex introductions are disclosed by Janusonis et al, McDugle et al, Keevert et al, Marchetti et al and Evans et al, each cited above and here incorporated by reference. Another technique, demonstrated in the Examples below, for coordination complex incorporation is to precipitate Lippmann emulsion grains in the presence of the coordination complex followed by ripening the doped Lippmann emulsion grains onto host grains.

The emulsions prepared can, apart from the features described above, take any convenient conventional form. Conventional emulsion compositions and methods for their preparation are summarized in *Research Disclosure,* Item 36544, Section I, cited above, as well as in Vol. 308, December 1989, Item 308119, Section I. Other conventional photographic features are disclosed in the following sections of Item 308119:

II. Emulsion washing;
III. Chemical sensitization;
IV. Spectral sensitization and desensitization;
V. Brighteners;
VI. Antifoggants and stabilizers;
VII. Color materials;
VIII. Absorbing and scattering materials;
IX. Vehicles and vehicle extenders;
X. Hardeners;
XI. Coating aids;

-continued

XII. Plasticizers and lubricants;
XIII. Antistatic layers;
XIV. Methods of addition;
XV. Coating and drying procedures;
XVI. Matting agents;
XVII. Supports;
XVIII. Exposure;
XIX. Processing;
XX. Developing agents;
XXI. Development modifiers;
XXII. Physical development systems;
XXIII. Image-transfer systems;
XXIV. Dry development systems;

and in the following sections of Item 36544:

II. Vehicles, vehicle extenders, vehicle-like addenda and vehicle related addenda;
III. Emulsion washing;
IV. Chemical sensitization;
V. Spectral sensitization and desensitization
VII. Antifoggants and stabilizers;
VII. Color materials;
VIII. Absorbing and scattering materials;
IX. Coating physical property modifying materials;
X. Dye image formers and modifiers;
XI. Layers and layer arrangements;
XII. Features applicable only to color negative;
XIII. Features applicable only to color positive;
XIV. Scan facilitating features;
XV. Supports;
XVI. Exposure;
XVII. Physical development systems;
XVIII. Chemical development systems;
XIX. Development;
XX. Desilvering, washing, rinsing and stabilizing.

Although the invention has general applicability to the modification of photographic emulsions known to employ metal dopant ions for modification of photographic performance, specific applications have been observed that are particularly advantageous.

Rhodium hexahalides represent one well known and widely employed class of dopants employed to increase photographic contrast. Generally the dopants have been employed in concentration ranges of $10^{-6}$ to $10^{-4}$ gram atom of rhodium per mole of silver. Rhodium dopants have been employed in all silver halides exhibiting a face centered cubic crystal lattice structure. However, a particularly useful application for rhodium dopants is in graphic arts emulsions. Graphic arts emulsions typically contain at least 50 mole percent chloride based on silver and preferably contain more than 90 mole percent chloride.

One difficulty that has been encountered using rhodium hexahalide dopants is that they exhibit limited stability, requiring care in selecting the conditions under which they are employed. It has been discovered that the substitution of an C—C, H—C or C—N—H organic ligand for one or two of the halide ligands in rhodium hexahalide results in a more stable hexacoordination complex. Thus, it is specifically contemplated to substitute rhodium complexes of the type disclosed in this patent application for rhodium hexahalide complexes that have heretofore been employed in doping photographic emulsions.

In another specific application, it is recognized that spectral sensitizing dye, when adsorbed to the surface of a silver halide grain, allows the grain to absorb longer wavelength electromagnetic radiation. The longer wavelength photon is absorbed by the dye, which is in turn adsorbed to the grain surface. Energy is thereby transferred to the grain allowing it to form a latent image.

While spectral sensitizing dyes provide the silver halide grain with sensitivity to longer wavelength regions, it is quite commonly stated that the dyes also act as desensitizers. By comparing the native sensitivity of the silver halide grains with and without adsorbed spectral sensitizing dye it is possible to identify a reduction in native spectral region sensitivity attributable to the presence of adsorbed dye. From this observation as well as other, indirect observations it is commonly accepted that the spectral sensitizing dyes also are producing less than their full theoretical capability for sensitization outside the spectral region of native sensitivity.

It has been observed quite unexpectedly that increased spectral sensitivity of emulsions containing adsorbed spectral sensitizing dyes can be realized when the silver halide grains are doped with a group 8 metal dopant forming a hexacoordination complex containing at least one C—C, H—C or C—N—H organic ligand and pseudohalide ligands containing Hammett sigma values more positive than 0.50. The following pseudohalide meta Hammett sigma values are exemplary: CN 0.61, SCN 0.63 and SeCN 0.67. The meta Hammett sigma values for bromo, chloro and iodo ligands are in the range of from 0.35 to 0.39. The surprising effectiveness of the pseudohalide ligand containing complexes as compared to those that contain halide ligands is attributed to the greater electron withdrawing capacity of the pseudohalide ligands satisfying the stated Hammett sigma values. Further, the sensitizing effect has shown itself to be attainable with spectral sensitizing dyes generally accepted to have desensitizing properties either as the result of hole or electron trapping. On this basis it has been concluded that the dopants are useful in all latent image forming spectrally sensitized emulsions. The dopant can be located either uniformly or non-uniformly within the grains. For maximum effectiveness the dopants are preferably present within 500 Å of the grain surface, and are optimally separated from the grain surface by at least 50 Å. Preferred metal dopant ion concentrations are in the range of from $10^{-5}$ to $10^{-8}$ gram atom/Ag mole.

In another form it is contemplated to employ cobalt coordination complexes satisfying the requirements of the invention to reduce photographic speed with minimal (<5%) or no alteration in photographic contrast. One of the problems that is commonly encountered in preparing photographic emulsions to satisfy specific aim characteristics is that, in adjusting an emulsion that is objectionable solely on the basis of being slightly too high in speed for the specific application, not only speed but the overall shape of the characteristic curve is modified.

In has been discovered quite unexpectedly that cobalt hexacoordination complexes satisfying the general requirements of the invention are capable of translating a characteristic curve along the log E (E=lux-second) exposure axis without significantly altering the shape of the characteristic curve. Specifically, contrast and minimum and maximum densities can all be maintained while decreasing sensitivity by doping. Preferred cobalt complexes are those that contain, in addition to one or two organic ligands occupying up to two coordination sites, pseudohalide ligands that exhibit Hammett sigma values of that are more positive than 0.50. The cobalt complex can be uniformly or non-uniformly distributed within the grains. Cobalt concentrations are preferably in the range of from $10^{-6}$ to $10^{-9}$ gram atom/Ag mole.

In still another specific application of the invention it has been observed that group 8 metal coordination complexes satisfying the requirements of the invention that contain as the C—C, H—C or C—N—H organic ligand an aliphatic sulfoxide are capable of increasing the speed of high (>50 mole %) chloride emulsions and are capable of increasing the contrast of high (>50 mole %) bromide emulsions. Preferred aliphatic sulfoxides include those containing up to 12 (most preferably up to 6) nonmetal (e.g., carbon) atoms per aliphatic moiety. The coordination complex can occupy any convenient location within the grain structure and can be uniformly or non-uniformly distributed. Preferred concentrations of the group 8 metal are in the range of from $10^{-6}$ to $10^{-9}$ gram atom/Ag mole.

In still another specific application of the invention it has been observed that anionic $[MX_xY_yL_z]$ hexacoordination complexes, where M is a group 8 or 9 metal (preferably iron, ruthenium or iridium), X is halide or pseudohalide (preferably Cl, Br or CN), x is 3 to 5, Y is $H_2O$, y is 0 or 1, L is a C—C, H—C or C—N—H organic ligand, and z is 1 or 2, are surprisingly effective in reducing high intensity reciprocity failure (HIRF), low intensity reciprocity failure (LIRF) and thermal sensitivity variance and in improving latent image keeping (LIK). As herein employed HIRF is a measure of the variance of photographic properties for equal exposures, but with exposure times ranging from $10^{-1}$ to $10^{-4}$ second. LIRF is a measure of the variance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably ≧90 mole %) chloride emulsions. Preferred C—C, H—C or C—N—H organic ligands are aromatic heterocycles of the type previously described. The most effective C—C, H—C or C—N—H organic ligands are azoles and azines, either unsubstituted or containing alkyl, alkoxy or halide substituents, where the alkyl moieties contain from 1 to 8 carbon atoms. Particularly preferred azoles and azines include thiazoles, thiazolines and pyrazines. Further advantages of complexes containing these ligands are demonstrated in the Examples below.

Also found to be unexpectedly useful in producing the same types of photographic advantages noted above in connection with the anionic $[MX_xY_yL_z]$ hexacoordination complexes are anionic $[MZ_5L'M'Z'_5]$ hexacoordination complexes, where M and M' are group 8 or 9 metals (preferably iron, ruthenium or iridium or any combination), Z and Z' are independently selected from among X, Y and L with the proviso that Z and Z' are each X in at least 3 occurrences and Y in no more than one occurrence, and L' is a C—C, H—C or C—N—H organic bridging ligand, such as a substituted or unsubstituted aliphatic or aromatic diazahydrocarbon. Specifically preferred bridging C—C, H—C or C—N—H organic ligands include $H_2N$—R—$NH_2$, where R is a substituted or unsubstituted aliphatic or aromatic hydrocarbon containing from 2 to 12 nonmetal atoms, as well as substituted or unsubstituted heterocycles containing two ring nitrogen atoms, such as pyrazine, 4,4'-bipyridine, 3,8-phenanthroline, 2,7-diazapyrene and 1,4-[bis(4-pyridyl)]butadiyne. The preferred substituents of the heterocyclic ring atoms are alkyl, alkoxy or halide substituents, where the alkyl moieties contain from 1 to 8 carbon atoms.

The anionic $[MX_xY_yL_z]$ or $[MZ_5L'M'Z'_5]$ hexacoordination complex can be located either uniformly or non-uniformly within the grains; however, in the practice of this invention it is contemplated that the iridate complexes will be located either primarily or exclusively in the epitaxially deposited surface portions of the grains. Concentrations preferably range from $10^{-9}$ to $10^{-3}$ gram atom group 8 or 9 metal/Ag mole. When only group 8 metal is present, such as iron and/or ruthenium, preferred concentrations are in the range of from $10^{-7}$ to $10^{-3}$ gram atom/Ag mole. When a group 9 metal, such as iridium is present, preferred concentrations are in the range of from $10^{-5}$ to $10^{-9}$ gram atom/Ag mole.

Preparations

Since the preparation of metal coordination complexes can be undertaken by the procedures described in the articles in which they are reported, cited above, preparations are provided for only those metal coordination complexes for which no source citation is listed. All of the coordination complexes were characterized using $^1H$ NMR spectroscopy, infra-red spectroscopy, and uv-visible absorption spectroscopy. Thermogravimetric analysis (TGA) was also used.

Preparation of MC-41

$[IrCl_5(thiazole)]^2$: 0.2 g of $K_2IrCl_5(H_2O)$ was reacted with 2 ml thiazole (Aldrich) in 20 ml $H_2O$ and stirred for 3 days. The solution was then evaporated to a small volume and precipitated by adding to 50 ml ethanol. The precipitate was filtered and washed with ethanol. The identity of this compound was confirmed by infrared (IR), ultraviolet and visible (UV/Vis) and nuclear magnetic resonance (NMR) spectroscopies and carbon, hydrogen and nitrogen (CHN) chemical analyses.

Preparation of MC-42

$[IrCl_5(pyz)Fe(CN)_5]^{5-}$: $Na_3K_2[IrCl_5(pyrazine)Fe(CN)_5]$ was prepared by reacting equimolar amounts of $K_2[IrCl_5(pyrazine)]$ and $Na_3[Fe\ (CN)_5(NH_3)].3H_2O$ in a small amount of $H_2O$ at room temperature for 24 hours. The volume was decreased with flowing nitrogen, and ethyl alcohol added to precipitate the final product. The product was assigned a formula of $Na_3K_2[IrCl_5(pyrazine)Fe(CN)_5]$ by IR, UV/VIS and NMR spectroscopies and by CHN chemical analyses.

Preparation of MC-43

$[IrCl_5(pyz)Ru(CN)_5]^{5-}$: The mixed metal dimer $KS[IrCl_5(pyrazine)Ru(CN)_5]$ was prepared by reacting equimolar amounts of $K_3[Ru(CN)_5(pyrazine)]$ and $K_2[IrCl_5(H_2O)]$ in a small amount of $H_2O$ in a hot water bath at 80° C. for 2 hours. The volume was partially reduced with flowing nitrogen, and ethyl alcohol was added to precipitate the final product. The dimer was recrystallized by dissolving in a minimum amount of water and precipitated with ethyl alcohol. The product was assigned as $K_5[IrCl_5(pyrazine)Ru(CN)_5]$ by IR, UV/VIS, and NMR spectroscopies and by CHN chemical analyses.

Preparation of MC-45

$[Rh(CN)_5(thiazole)]^{2-}$: The synthesis of this compound was similar to literature methods described by G. L. Geoffroy, M. S. Wrighton, G. S. Hammond and H. B. Gray [*Inorg. Chem.* 13(2), 430–434, (1974)] with slight changes as described here. 0.5 g of $K_3[Rh(CN)_6]$ was dissolved in 100 ml $H_2O$ and adjusted to a pH of 2 with $HClO_4$. This solution was irradiated with a mercury lamp in a quartz tube for 24 hours. The solution was then evaporated down to 5 ml and chilled. The $KClO_4$ was filtered and 1 ml of thiazole in 1 ml of ethanol was added. This solution was again irradiated with the Hg lamp, this time for an hour The volume was reduced, and ethanol was added to produce the final product. The precipitate which was formed was filtered and washed with ethanol. The identity of the compound was confirmed by IR, UV/Vis and NMR spectroscopies.

Preparation of MC-46

$[Rh_2Cl_{10}(pyz)]^{4-}$: $Na_4[Rh_2Cl_{10}(pyrazine)]$ was prepared by reacting $Na_3RhCl_6.12H_2O$ with pyrazine in a 2 to 1.05 (5% excess pyrazine) molar ratio at 100 C in a minimum amount of $H_2O$ for 1 hour. Acetone was added to the cooled solution to give an oil and an orange colored liquid with some suspended solid material which was decanted. The oil was washed several times with acetone and decanted. The acetone was removed with a $N_2$ flow to give a sticky red substance which was then air dried in an oven at 100° C. for 1 hour to give a dark red material. This was recrystallized twice by dissolving in a minimum amount of $H_2O$ and precipitated with ethyl alcohol. The final material was filtered, washed with ethyl alcohol, and air dried. The product was assigned as $Na_4[Rh_2Cl_{10}(pyrazine)]$ by IR, UV/Vis and NMR spectroscopies and by CHN chemical analyses.

Preparation of MC-44

$[Ru(CN)_5(pyz)Fe(CN)_5]^{6-}$: $Na_3K_3[Ru(CN)_5(pyrazine)Fe(CN_5]$ was similarly prepared by stirring equimolar amounts of $K_3[Ru(CN)_5(pyrazine)]$ and $Na_3[Fe(CN)_5(NH_3)].3H_2O$ in a small amount of $H_2O$ at room temperature for 24 hours. The volume was decreased with flowing nitrogen, and ethyl alcohol added to precipitate the final product. The product was assigned as $Na_3K_3[Ru(CN)_5(pyrazine)Fe(CN)_5]$ by IR, UV/VIS and NMR spectroscopies and by CHN chemical analyses.

Preparation of MC-47

$[RhCl_3(oxazole)_3]$: 0.5 g of $(NH_4)_2[RhCl_5(H_2O)]$ was reacted with 0.5 ml oxazole in 15 ml $H_2O$ for 3 days. The solution was then added to a large amount of acetone whereupon a white precipitate appeared. The precipitate ($NH_4Cl$) was filtered off. A yellow solid was obtained after evaporating the solvent from the filtrate. This yellow solid was washed with cold acetone in which it was slightly soluble. Slow evaporation of the acetone solution provided bright yellow crystals. The yellow product was assigned as $RhCl_3$(oxazole)3 by Infrared, UV/Vis, and NMR spectroscopies and CHN chemical analysis.

Preparation of MC-48

$[Fe(CN)_5TQ]3-$: The synthesis of this compound is similar to reported methods of various $Na_xFe(CN)_5L$ compounds [H. E. Toma and J. M. Malin, Inorg. Chem. 12(5), 1039–1045, (1973)]. 0.5 g of $Na_3[Fe(CN)_5(NH_3)].3\ H_2O$ was dissolved in 5 ml $H_2O$ and added to 0.26 g of s-triazolo [4,3-a] quinoline in 5 ml ethanol. The solution was mixed for 1 week then evaporated to 2 ml and precipitated by adding to ethanol. This provided an oil and a light brown precipitate. The precipitate was filtered and the solution was decanted from the oil. The oil was dissolved in a small amount of water and added to a large excess of ethanol. This afforded more brown precipitate. The precipitates were washed with ethanol and analyzed using IR, UV/Vis and NMR spectroscopies and CHN chemical analysis.

Preparation of MC-49

$[IrCl_4(thiazole)_2]^{1-}$: The bis-thiazole complex was synthesized from $K_3IrCl_6$ and an excess of thiazole in a homogeneous aqueous solution at ca. 85° C. with a reaction time of 2 hours. 5 grams of $K_3IrCl_6$, 4 grams of thiazole, and 45 ml of $H_2O$ were employed in the reaction. After reducing the volume by 50% with $N_2$, the aqueous solution was poured into a volume of acetone 4 times the $H_2O$ volume and $KIrCl_4(tz)_2$ precipitated. Solid $KIrCl_4(thiazole)_2$ has a pale orange color. The material was filtered and washed with acetone. Due to the high solubility in water, the pale orange bis-substituted material has been assigned as the cis-isomer.

Preparation of MC-50

$[IrBr_5(thiazole)]^{2-}$: $K_3IrBr_6$ was the iridium source for the preparation of the monothiazole complex $K_2IrBr_5$(thiazole). 2 grams of $K_3IrBr_6$ and 0.9 grams of thiazole were dissolved in a minimum amount of water and allowed to set at room temperature for 24 hours. During this time the solution assumed a light green color and the addition of an equal volume of acetone precipitated a lustrous green precipitate. This was filtered, washed with 50% water/50% acetone, acetone, and air dried. The material was characterized as $K_2IrBr_5$(thiazole).

Preparation of MC-51

$[IrBr_4(thiazole)2]^{1-}$: 12 grams of $K_3IrBr_6$ were added to 60 ml of water in a 200 ml round bottom flask followed by the addition of 6 grams of thiazole. The reaction was initially heterogeneous, but with warming to 85° C. and stirring, the iridium salt dissolved. The stoppered flask was maintained at 85° C. for 1 hour during which time the color changed from the dark greenish color of $IrBr_6^{3-}$ to a clear bright orange color characteristic of $IrBr_4(thiazole)_2^-$. A fibrous orange precipitate of $KIrBr_4(thiazole)_2$ started forming near the end of the reaction. After 1 hour at 85° C., the reaction flask was placed in the refrigerator to quench the reaction and precipitate more of the bis-thiazole complex. The reaction flask was removed after about an hour and the volume decreased about 30% with a $N_2$ flow and then put back into the refrigerator overnight. The precipitated material was filtered off the next morning and washed with about 20 ml of ice cold water and then acetone and air dried. This orange colored material is quite soluble in water and assumed to be the cis isomer.

$KIrBr_4(thiazole)_2$ was recrystallized by dissolving the material in a minimum amount of warm water (ca. 60° C.) and filtering. The filtrate was then decreased in volume by 50% and pure $KIrBr_4(thiazole)_2$ precipitated with an equal volume of acetone.

Preparation of MC-52

$[IrCl_4(H_2O)(tz)]^{1-}$: $KIrCl_4(H_2O)$(thiazole) was synthesized by the uv-photolysis of $K_2IrCl_5$(tz) in water. 3.5 grams of $K_2IrCl_5$(thiazole) were dissolved in 50 ml of DI water in a 50 ml round bottom quartz flask. This was then placed in a water bath (a larger quartz beaker) in order to absorb the infra-red output of the uv-lamp and keep the reaction at ambient temperature (if the reaction gets as high as 50° C., a some of the $IrCl_5(thiazole)^{2-}$ will decompose releasing free thiazole). The reaction times were limited to four hour units to keep the reaction from getting too far above room temperature. One of the reaction runs was in $D_2O$, and $^1H$ NMR was used to monitor both the disappearance of the starting material $K_2IrCl_5$(thiazole) and the appearance of the monoaquated product $K_2IrCl_4(H_2O)$(thiazole). It was found that in ca. 16 hours, 100% of $K_2IrCl_5$(thiazole) had reacted under our experimental conditions. The main photochemical reaction products are $KIrCl_4(H_2O)$(thiazole) and KCl, but a few other NMR peaks are observed that are weak and not identified. These unidentified species do not end up in the final product, because they are more soluble in water and in water/acetone solutions than $KIrCl_4(H_2O)$(thiazole). $KIrCl_4(H_2O)$(thiazole) itself is very soluble in water, and a volume of acetone about 10 times the volume of water present is needed to precipitate the monoaquo complex. Under these conditions, KCl is also precipitated (but not the unidentified species). If the reaction solution is reduced in volume to near dryness, some of the aquo complex anates reforming $K_2IrCl_5$(thiazole).

$Ag(CF_3COO)$ (silver trifluoroacetate, AgTFA) was added to the reaction vessel to precipitate the free chloride as AgCl. The solution was filtered after the addition of AgTFA to remove the AgCl, and the filtrate evaporated to near dryness. Either acetone or ethyl alcohol was then added to precipitate $KIrCl_4(H_2)$ (tz) which was filtered, washed with acetone, and allowed to air dry.

The material that results from using AgTFA to precipitate the free chloride is further purified by passing a concentrated solution of the material through a column of Sephadex. 2.5 grams of material were dissolved in 5 ml water and passed through ca. 10 inch of Sephadex G-25 in a 100 ml buret. The material separated into observable bands although there were no clear separations between the bands. The first band collected was small and the color was greenish. This band amounted to about 2 ml. The second band was reddish and amounted to only about 2 ml also. The third band was the major band and with elution with water gave about 20 ml of a reddish brown solution which was evaporated to dryness with $N_2$, redissolved in a minimum amount of water, and precipitated with ethyl alcohol to give pure $KIrCl_4(H_2O)$(thiazole).

Preparation of MC-53

$[IrCl_4(4\text{-methylthiazole})_2]^{1-}$: $KIrCl_4(4\text{-methylthiazole})_2$ was synthesized by the room temperature reaction of excess 4-methylthiazole with $K_3IrCl_6$. Typically, 5 grams of $K_3IrCl_6$ and 5 grams of 4-methylthiazole were added together in ca. 100 ml of water in a 250 ml round bottom flask. The mixture was stirred until all the iridium salt dissolved, and then the solution was allowed to stand for 12 days. An orange precipitate slowly formed, and after the 12 days, an equal volume of acetone (100 ml) was added to the flask to precipitate additional orange material. The orange solid was filtered and washed with a 50% water/50% acetone solution and then acetone and air dried. The orange precipitate is not very soluble in water but may be recrystallized by dissolving the orange material in a minimum amount of water at ca. 50° C. and precipitating with acetone. The recrystallized orange material was $KIrCl_5(4\text{-methylthiazole})_2$. $KIrCl_4(4\text{-methylthiazole})_2$ can also be readily synthesized in aqueous solution at 70° C. Due to its low solubility, the material was assumed to be the trans-isomer.

Preparations of MC-54 and MC-55

$[IrCl_5(5\text{-methylthiazole})]^{2-}$: The room temperature reaction of 5-methylthiazole with $K_3IrCl_6$ in an aqueous media produced the monosubstituted species $K_2IrCl_5(5\text{-methylthiazole})$. 5 grams of $K_3IrCl_6$ were dissolved in 75 ml of water, and 5 grams of 5-methylthiazole were added. The solution was allowed to remain at ambient temperature for 12 days and then filtered. The volume of the filtrate was reduced with $N_2$ about 30%, and a volume of acetone 3 times the water volume added to precipitate a pale orange colored solid. This was filtered using a very fine glass filter frit, washed with a 50% acetone/50% water mixture, and then acetone, and air dried. The material was recrystallized by dissolving the material in a minimum amount of water at ambient temperature, filtering the material through a fine frit filter, and then reprecipitating with acetone. The pale orange colored material is the monosubstituted complex $K_2IrCl_5(5\text{-methylthiazole})$.

$[IrCl_4(5\text{-methylthiazole})_2]^{1-}$: When the reaction between $K_3IrCl_6$ and 5-methylthiazole was carried out at 60° C. for a period of 8 hours, an orange crystalline material precipitated when the solution was cooled to room temperature. This has been identified as the bis-substituted complex $KIrCl_4(5\text{-methylthiazole})_2$.

Preparation of MC-56

$[IrCl_4(4,5\text{-dimethylthiazole})_2]^{1-}$: The room temperature reaction of 5 grams of $K_3IrCl_6$ and 5 grams of 4,5-dimethylthiazole resulted in the synthesis of the bis-substituted complex $KIrCl_4(4,5\text{-dimethylthiazole})_2$. This complex was very soluble in water compared to $KIrCl_4(4\text{-methylthiazole})_2$, which was assigned the trans-isomer due to its low solubility in water. It is believed that $KIrCl_4(4,5\text{-dimethylthiazole})_2$ is a cis isomer.

Preparation of MC-57

$[IrCl_4(2\text{-bromothiazole})_2]^{1-}$: $KIrCl_4(2\text{-bromothiazole})_2$ was synthesized by the room temperature reaction of 5 grams of $K_3IrCl_5$ and 5 grams of 2-bromothiazole in a 5% acetone/95 % water mixture. The mixture was allowed to set for 3 weeks during which time a pale orange material slowly formed and precipitated out of solution. Additional material was precipitated with an equal volume of acetone, filtered, washed with a 50% acetone/50% water mixture, then acetone, and air dried. The material was identified as $KIrCl_5(2\text{-bromothiazole})_2$.

Preparation of MC-58

$[IrCl_4(2\text{-methyl-2-thiazoline})_2]^{2-}$: The reaction of 5 grams of $K_3IrCl_6$ and 5 grams of 2-methyl-2-thiazoline in a rapidly stirred aqueous solution produced the solid $KIrCl_4(2\text{-methylthiazoline})_2$ with precipitation using acetone. Small amounts of 2-methyl-2-thiazoline were difficult to remove from the precipitate, but tetrahydrofuran removed the majority of the impurity leaving, only trace amounts.

Preparation of MC-59–64

$[IrCl_5L]^{2-}$: An aqueous solution of $K_3IrCl_6$ was stirred at ambient temperature with an excess of the organic liquid ligand L for several days. The $K_2IrCl_5L$ complex was precipitated by adding the aqueous solution to a water miscible organic solvent, such as acetone or ethyl alcohol. The materials were filtered, washed with a 50:50 volume ratio of water and acetone, then acetone, and air dried.

Preparation of MC-65

$[IrCl_5(2,5\text{-dimethylpyrazine})]^{2-}$: The reaction of 5 grams of $K_2IrCl_5(H_2O)$ and 5 grams of 2,5-dimethylpyrazine was conducted in 50 ml of water at 6° C. (held at temperature by refrigeration) was conducted over 10 days. The reaction solution was poured into 500 ml of acetone, and the small amount of unreacted $K_2IrCl_5(H_2O)$ remaining was removed through filtration. The orange aqueous filtrate was evaporated to dryness at room temperature and then washed with diethylether and then ethyl alcohol. The material was then added to methyl alcohol and initially dissolved and then reprecipitated to give a very pure solid with the stoichiometry of $K_2IrCl_5(2,5\text{-dimethylpyridine}).\frac{1}{3}CH_3OH$.

Preparation of MC-66

$[IrCl_5(4\text{-Methylpyrazinium})]^{1-}$: The room temperature reaction between 5 grams of $K_3IrCl_6$ and 5 grams of N-methylpyrazine iodide in 50 ml of water for ten days yielded the sought coordination complex, which was precipitated with acetone. The complex precipitated was less soluble than the corresponding potassium salt.

EXAMPLES

The invention can be better appreciated by reference to the following specific examples:

Comparative Dopants

Except for comparative dopant complexes CD-7 and CD-8, the comparative dopant (CD) complexes listed in Table I below were purchased from commercial sources. CD-7 and CD-8 were prepared as reported by M. Delephine, *Ann. Chim.*, 19, 145 (1923).

TABLE I

| | |
|---|---|
| CD-1 | EDTA |
| CD-2 | $[Fe(EDTA)]^{-1}$ |
| CD-3 | $[IrCl_6]^{-2}$ |
| CD-4 | $K_2C_2O_4.H_2O$ |
| CD-5 | $[Fe(CN)_6]^{-4}$ |
| CD-6 | $[Fe(C_2O_4)_3]^{-3}$ |
| CD-7 | $[cis\text{-}IrCl_2(C_2O_4)_2]^{-3}$ |
| CD-8 | $[Ir(C_2O_4)_3]^{-3}$ |

Example 1

The purpose of this example is to demonstrate the incorporation of C—C, H—C or C—N—H organic ligands within a silver halide grain structure.

An emulsion F19 was prepared as described below in the F Series Examples, doped with 43.7 molar parts per million (mppm) of dopant MC-14c.

Electron paramagnetic resonance spectroscopic measurements were made on emulsion F19 at temperatures between 5° and 300° K., using a standard X-band homodyne EPR spectrometer and standard cryogenic and auxiliary equipment, such as that described in Electron Spin Resonance, 2nd Ed., *A Comprehensive Treatise on Experimental Techniques*, C. P. Poole, Jr., John Wiley & Sons, New York, 1983. These measurements provided detailed structural information about the microscopic environment of the dopant ion, and, in this example, showed that all or most of the iron added during precipitation was incorporated in the silver chloride grain crystal structure in the Fe(II) valence state, and all of the incorporated Fe(II) ions had their ligands intact so that $[Fe(CN)_5\text{bipyridyl})]^{3-}$ replaced a $[AgCl_6]^{5-}$ moiety.

No EPR signals were observed from the doped sample unless it was exposed to light or strong oxidants, such as gaseous chlorine. After exposure to band-to-band light excitation (365 nm) between 260° K. and room temperature, EPR signals were observed at 5°–8° K. These signals were not observed from the undoped control sample after light exposure. Discernible in these signals were powder pattern lineshapes like those typically observed from a randomly oriented ensemble of low symmetry paramagnetic species in a powder or frozen solution. The strongest powder patterns had gl features at 2.924 (Site I), 2.884 (Site II) and 2.810 (Site III), each with a linewidth at half maximum of 1.0±0.1 mT, shown below to be from four distinct kinds of $[Fe(CN)_5(\text{bipyridyl})]^{2-}$ complexes in which the metal ions have low spin $d^5$ electronic configurations.

By analogy to previous studies of substitutional low spin $d^5$ transition metal complexes in the silver halides and structurally related crystals, such as described in D. A. Corrigan, R. S. Eachus, R. E. Graves and M. T. Olm, *J. Chem. Phys.* 70, 5676 (1979) for $(RuCl_6)^{3-}$ centers in AgCland $(RuBr)_6^{3-}$ centers in AgBr, and R. S. Eachus and M. T. Olm, *Rad. Elf.* 73, 69 (1983) for $(OsCl_6)^{3-}$ in AgCl and $(OsBr_6)^{3-}$ centers in AgBr, these $[Fe(CN)_5(\text{bipyridyl})]^{2-}$ complexes differ in the arrangement of the associated silver ion vacancies which are necessary to provide charge neutrality in the silver chloride lattice. The $g_2$ feature corresponding to the major structural center (Site I) was at 2.286. The other three $g_2$ signals were at 2.263 (Site II), 2.213 (Site III) and 2.093 (Site IV). The value of $g_3$ for the major $[Fe(CN)_5(bipyridyl)]^{2-}$ complex in AgCl (Site I) was found to be 1.376. The $g_3$ features from the three secondary bipyridyl complexes were not resolved in our experiments. The g values determined for the $[Fe(CN)_5(bipyridyl)]^{2-}$ complex with silver ion vacancies present in the highest concentration (Site I) are consistent with the assignment to a rhombic, low spin Fe(III) complex substituting for $(AgCl_6)^{5-}$ in the cubic silver chloride lattice.

The powder pattern EPR spectrum was also observed after the doped, unexposed silver chloride emulsion was placed in an oxidizing atmosphere of chlorine gas. The observations that this pattern was absent before exposure and was produced by the oxidizing atmosphere confirmed that the $[Fe(CN)_5(bipyridyl)]$ complex dopant was incorporated with the metal ion in the Fe(II) state, which is invisible to EPR measurements, and that the Fe(II) ion trapped a hole (was oxidized) to produce the Fe(III) oxidation state during exposure to chlorine or light.

It was established that the dopant was incorporated primarily as $[Fe(CN)_5(bipyridyl)]^{3-}$ with the ligands surrounding the ferrous ion intact by comparing the observed EPR spectra with those obtained upon doping silver chloride powders with the most chemically-feasible, ligand-exchanged contaminants of the dopant salt that might be produced during synthesis of the dopant or precipitation of the emulsion. The species $[Fe(CN)_6]^{4-}$, $[Fe(CN)_5(H_2O)]^{3-}$ $[Fe(CN)_5Cl]^{4-}$ and $[Fe_2(CN)_{10}]^{6-}$ were investigated. The EPR spectra of the corresponding Fe(III) species produced in the silver chloride grains by band-to-band excitation or exposure to chlorine were quite distinct from those assigned to the four $[Fe(CN)_5(bipyridyl)]^{2-}$ dopant complexes.

From the foregoing it was concluded that the bipyridyl ligand was sufficiently stable in aqueous solution to minimize its exchange with chloride or water during coprecipitation. Considering the observation of a well-resolved EPR powder pattern from the doped emulsion, the high yields of the low spin Fe(III) photoproducts, and the propensity of low spin Fe(III) ions for six-fold coordination, it is clear that $Fe(CN)_5(bipyridyl)]^{3-}$ is incorporated substitutionally in silver chloride, replacing a $[AgCl_6]^{5-}$ moiety. Despite the presence of the bulky organic ligand, it is not occluded as a separate phase or adsorbed as a surface species.

Example 2

The A Series

These examples have as their purpose to demonstrate reduced dye desensitization and reduced high intensity reciprocity failure (HIRF) in octahedral (i.e., regular {111}) silver bromide emulsions as a result of introducing during precipitation metal coordination complexes satisfying the requirements of the invention. These examples demonstrate favorable comparisons to emulsions prepared in the absence of metal coordination complexes and to emulsions prepared in the presence of iron hexacyanide (CD-5).

Five solutions were prepared as follows:

| | |
|---|---|
| Solution A: | |
| Gelatin (bone) | 40 g |
| D. W. | 1500 g |
| Solution B: | |
| 2.5N Sodium bromide | |
| Solution C | |
| 2.5N Silver nitrate | |
| Solution D | |
| Gelatin (phthalated) | 50 g |
| D. W. | 300 g |
| Solution E | |
| Gelatin (bone) | 119 g |
| D. W. | 1000 g |

Emulsion A1 was prepared as follows: Solution A was adjusted to a pH of 3 at 40° C. with 2N $HNO_3$ and the temperature was adjusted to 70° C. The pAg of solution A was adjusted to 8.19 with solution B. Solutions B and C were run into solution A with. stirring at a constant rate of 1.25 ml/min for four minutes. The addition rate was accelerated to 40 ml/min over the next 40 minutes. The resulting mixture was cooled to 40° C. Solution D was then added with stirring and the mixture was held for 5 minutes. The pH was then adjusted to 3.35 and the gel was allowed to settle. The temperature was dropped to 15° C. for 15 minutes and the liquid layer was decanted. The depleted liquid volume was then restored with distilled water and the pH was readjusted to 4.5. The mixture was redispersed with stirring at 40° C. and the pH was adjusted to 5. The pH was then readjusted to 3.75 and once again the gel was allowed to settle, the mixture was cooled and the liquid layer decanted. The temperature was readjusted to 40° C. and solution E was added. The final pH and pAg were approximately 5.6 and 8.06 respectively. Control emulsions prepared in this fashion had a narrow distributions of sizes and morphologies; emulsion grains were octahedral in shape with edge lengths of 0.5 μm±0.05 μm.

Doped emulsion A la was prepared as described for emulsion A1 except that during the accelerated portion of the reagent addition, after 603 cc of solution B had been added, a dopant solution was substituted for solution B. After the dopant solution was depleted, it was replaced by solution B.

| Dopant Anion | Dopant Solution for Emulsion A1a | |
|---|---|---|
| CD-5 | $K_4Fe(CN)_6$ | 12.04 mg |
| | Solution B | 181 cc |

Doped emulsions prepared in this fashion were monodispersed in size and shape and had octahedral edge lengths of 0.5 microns ±0.05 microns. The resulting doped emulsion A1a nominally contained a total of 11 molar parts per million (mppm) of dopant in the outer 72% to 93.5% of the grain volume; i.e., the emulsion had an undoped shell of approximate thickness 40 to 100 Å.

Doped emulsion A1b was prepared as described for emulsion A1, except that the dopant solution was modified to introduce a total of 55 molar parts per million (mppm) of (comparison dopant CD-5) in the outer 72% to 93.5% of the grain volume.

Doped emulsion A2 was prepared as described for emulsion A1, except that the dopant solution was modified to introduce a total of 5.2 molar parts per million (mppm) of dopant MC-14b and 2.6 mppm of MC-37 in the outer 72% to 93.5% of the grain volume. The initial 0 to 72% of the grain volume and the final 93.5% to 100% of the grain volume were undoped.

Doped emulsion A3 was prepared as described for emulsion A2, except that the dopant solution was modified to introduce 11 mppm of dopant MC-37 into the outer 72% to 93.5% of the grain volume.

Doped emulsion A4 was prepared as described for emulsion A2, except that the dopant solution was modified to introduce 2.6 mppm of dopant MC-14c and 3.9 mppm of dopant MC-38 into the outer 72% to 93.5% of the grain volume.

Doped emulsion A5 was prepared as described for emulsion A2, except that the dopant solution was modified to introduce 12.9 mppm of dopant MC-14c and 19.4 mppm of dopant MC-38 into the outer 72% to 93.5% of the grain volume.

Doped emulsion A6 was prepared as described for emulsion A2, except that the dopant solution was modified to introduce 6.6 mppm of dopant MC-38 into the outer 72% to 93.5% of the grain volume.

Doped emulsion A7 was prepared as described for emulsion A2, except that the dopant solution was modified to introduce 28.9 mppm of dopant MC-38 into the outer 0.5% to 93.5% of the grain volume. Analysis of this emulsion by inductively coupled plasma atomic emission spectropscopy (ICP-AES) showed that the Fe level was, within experimental error, the same as in emulsions prepared like A7 but doped with the conventional dopant anion $(Fe(CN)_6)^{4-}$ (60.7%±4.6% vs 73.6%± 9.8%).

Doped emulsion A8 was prepared as described for emulsion A2, except that the dopant was modified to introduce 5.6 mppm of dopant MC-48 into the outer 72% to 93.5% of the grain volume.

Doped emulsion A9 was prepared as described for emulsion A2, except that the dopant solution was modified to introduce 10.3 mppm of dopant MC-15a into the outer 72% to 93.5% of the grain volume.

Doped emulsion A10 was prepared as described for emulsion A2, except that the dopant was dissolved in 181 cc of water, and this was added to the emulsion through a third jet so as to introduce 6.6 mppm of dopant MC-38 into the outer 72% to 93.5% of the grain volume.

Doped emulsion A11 was prepared as described for emulsion A2, except that the dopant solution was modified to introduce 55.3 mppm of dopant MC-141 into the outer 50% to 93.5% of the grain volume.

Doped emulsion A12 was prepared as described for emulsion A2, except that the dopant solution was modified to introduce 26 mppm of dopant MC-39 into the outer 72% to 93.5% of the grain volume.

Doped emulsion A13 was prepared as described for emulsion A2, except that the dopant solution was modified to introduce 55 mppm of dopant MC-14n into the outer 72% to 93.5% of the grain volume.

Doped emulsion A14 was prepared as described for emulsion A2, except that the dopant solution was modified to introduce 11 mppm of dopant $[Fe(EDTA)]^{-1}$ (CD-2) into the outer 72% to 93.5% of the grain volume.

Doped emulsion A15 was prepared as described for emulsion A2, except that the dopant solution was modified to introduce 55.3 mppm of dopant $[Fe(C_2O_4)_3]^{3-}$(CD-6) into the outer 50% to 93.5% of the grain volume.

Doped emulsion A16 was prepared as described for emulsion A2, except that the dopant solution was modified to introduce 55 mppm of dopant MC-15a into the outer 50% to 93.5% of the grain volume. Ion coupled plasma mass spectrometry (ICP-MS) analysis showed that Ru incorporation was at least as high as that measured in an identical emulsion doped with the comparative dopant anion $[Ru(CN)_6]^{4-}$.

Photographic Comparisons

Portions of emulsions A1, A1a, A1b, A4, A5 and A6 were sensitized by the addition of 28 micromole/mole Ag of sodium thiosulfate and 22 micromole/mole Ag of bis (1,4,5-triethyl-1,2,4-triazolium-3-thiolate gold(I) tetrafluroborate, followed by a digestion for 40 minutes at 70° C. The chemically sensitized emulsions were divided into 3 portions. The red spectral sensitizing dye (DYE A) (5,5'-dichloro-3,3',9-triethylthiacarbocyanine p-toluenesulfonate) was added from methanolic solution at levels of 0.50 and 0.75 millimole per Ag mole to two of the portions after which the samples were held at 40° C. for one hour.

Coatings of each of emulsion were made at 21.5 mg Ag/dm$^2$ and 54 mg gelatin/dm$^2$ with a gelatin overcoat layer containing 10.8 mg gelatin/dm$^2$ a surfactant and a hardener, on a cellulose acetate support. Some coatings of each sensitized emulsion were exposed for 0.1 second to 365 nm on a standard sensitometer and then developed for 6 minutes in Kodak Rapid X-Ray™ developer, a hydroquinone-Elon™(N-methyl-p-aminophenol hemisulfate) surface developer at 21° C. Other coatings were evaluated for reciprocity response by giving them a series of calibrated (total energy) exposures ranging from 1/10,000th of a second to 1 second, These were also developed for 6 minutes at 21° C. in a hydroquinone-Elon™ surface developer.

The photographic response of emulsions A, A1a, A1b, A4, A5 and A6 are shown in Tables A-I to A-III.

TABLE A-I

| Emul. | Dopant | Metal ion conc. (PPM) | Δ Dmin 0.50 dye level | Δ speed 0.50 dye level | Δ Dmin 0.75 dye level | Δ speed 0.75 dye level |
|---|---|---|---|---|---|---|
| A1 | none | none | 0 | 0 | 0 | 0 |
| A1a | CD-5 | 11 | 2 | 14 | 4 | 18 |
| A1b | CD-5 | 55 | 16 | 51 | 17 | 60 |

TABLE A-II

| Emul. | Dopant | Metal ion conc. (PPM) | Δ Dmin 0.50 dye level | Δ speed 0.50 dye level | Δ Dmin 0.75 dye level | Δ speed 0.75 dye level |
|---|---|---|---|---|---|---|
| A1 | none | none | 0 | 0 | 0 | 0 |
| A1a | CD-5 | 11 | 2 | 14 | 4 | 18 |
| A4 | MC-38, MC-14c | 10.5 | −2 | 30 | .1 | 47 |
| A6 | M-38 | 13.2 | 9 | 49 | 5 | 82 |

TABLE A-III

| Emul. | Dopant | Metal ion conc. (PPM) | Δ Dmin 0.50 dye level | Δ speed 0.50 dye level | Δ Dmin 0.75 dye level | Δ speed 0.75 dye level |
|---|---|---|---|---|---|---|
| A1 | none | none | 0 | 0 | 0 | 0 |
| A1b | CD-5 | 55 | 16 | 51 | 17 | 60 |
| A5 | MC-38 | 51.7 | –4 | 42 | –2 | 72 |

Δ Dmin is the difference in minimum optical density between the undoped control and the doped emulsion, × 100. Smaller values indicate less increase in Dmin attributable to doping.
Δ A speed is the difference in speed (measured at 0.15 optical density) between the undoped control and the doped emulsion, × 100. Larger values indicate larger speed increases attributable to doping.

Results for two dye levels, corresponding to about 60 and 90% dye coverage of the available grain surface area, are shown in Tables AI–III. It is desirable to increase dye level as much as possible in order to increase the amount of light absorbed by the emulsions and thereby increase sensitivity. Unfortunately, for many commonly used dyes, as the dye level is increased, a maximum in sensitivity is reached at dye levels corresponding to much less than 100% coverage of the grain surface. Increasing the dye level beyond this maximum either gives no additional speed or causes a speed loss. At these higher dye levels, the dye itself is a cause of desensitization. It is known that emulsions doped with a preferred class of hexacoordination complexes of transition metals, capable of forming sensitivity enhancing shallow electron trapping sites, show an increased resistance to dye desensitization as evidenced by improved speed of the dyed, doped emulsions compared to dyed, undoped emulsions (see Bell, Reed, Olm U.S. Pat. No. 5,132,203). One problem encountered with these doped emulsions is that, as more dopant is added to increase resistance to dye desensitization, the level of Dmin increases. This is demonstrated by the results from the comparative examples in Table A-I.

Table A-II shows that emulsions doped with the invention compounds, MC-14c (discussed in the example above) and MC-38, show improved resistance to dye desensitization, and also show either improved resistance to dye desensitization or lower Dmin or both when compared to the comparison emulsion A1a.

Table A-III demonstrates that an emulsion doped with the invention compound MC-38 does not exhibit increased Dmin at high dopant levels, unlike the emulsion doped with (CD-5).

A portion of each of the emulsions described above was optimally chemically sensitized by the addition of sodium thiosulfate and bis (1,4,5-triethyl-1,2,4-triazolium-3-thiolate gold(I) tetrafluroborate, followed by a digestion for 40 minutes at 70° C. The chemically sensitized emulsions were divided into 4 portions. The red spectral sensitizing dye (DYE A) (5,5'-dichloro-3,3',9-triethylthiacarbocyanine p-toluenesulfonate) was added from methanolic solution at levels of 0.25, 0.50 and 0.75 millimole per Ag mole to three of the portions after which the samples were held at 40° C. for one hour.

Doped Emulsion A6 and control Emulsion A1 were also chemically and spectrally sensitized as described above, except that the green spectral sensitizer 5,6,5',6'-dibenzo-1,1'-diethyl-2,2'-tricarbocyanine iodide (Dye B) was used in place of Dye A at levels of 0.0375 and 0.075 mmole/mole of silver.

These emulsions were coated, exposed and evaluated as described above. The results are given in Tables A-IV to A-VII.

TABLE A-IV

Difference. in Log Relative Speed times 100, between Doped, Dyed (Dye A) Emulsions and Undoped, Dyed Control[a]

| Emulsion | Dopant | 0.25 mmole dye/Ag mole | 0.50 mmole dye/Ag mole | 0.75 mmole dye/Ag mole |
|---|---|---|---|---|
| A1 | none | 0 | 0 | 0 |
| A2 | MC-14b, MC-37 | 6 | 32 | 62 |
| A3 | MC-37 | 39 | 43 | 60 |
| A4 | MC-14c MC-38 | 20 | 12 | 44 |
| A5 | MC-14c MC-38 | 14 | 27 | 122 |
| A6 | MC-38 | 16 | | 79 |
| A7 | MC-38 | 6 | 9 | 26 |
| A8 | MC-48 | 30 | 56 | 82 |
| A9 | MC-15a | 20 | 33 | 58 |
| A10 | MC-38 | 32 | 111 | 92 |
| A11 | MC-141 | –5 | 57 | 10 |
| A12 | MC-39 | 22 | 107 | 68 |
| A13 | MC-14n | 25 | 109 | 61 |

[a]The larger the speed number the greater the improvement in dyed speed in the doped emulsion over the undoped control. Speed measured at 0.15 optical density above Dmin.

TABLE A-V

Difference between Relative Log Speeds times 100, obtained at 0.01 and $10^{-5}$ sec exposure, measured at $D_{min}$ Plus 0.15 density. (Dye A)*

| Emulsion | Dopant | 0.25 mmole dye/Ag mole | 0.50 mmole dye/Ag mole | 0.75 mmole dye/Ag mole |
|---|---|---|---|---|
| A1 | none | 20 | 24 | 16 |
| A2 | MC-14b, MC-37 | 12 | 6 | –7 |
| A5 | MC-14c, MC-38 | 4 | 3 | 3 |
| A6 | MC-38 | 15 | 13 | 1 |

*Smaller values indicate less HIRF.

TABLE A-VI

Difference in Log Relative Speed times 100, between Doped, Dyed Emulsions (Dye B) and Undoped, Dyed Control, Comparative Examples.

| Emulsion | Dopant | 0.0375 mmole dye/Ag mole | 0.075 mmole dye/Ag mole |
|---|---|---|---|
| A1 | None | 0 | 0 |
| A6 | MC-38 | 49 | 55 |

The speed increases of the dyed doped invention emulsions relative to the dyed undoped control are shown in Table A-IV and Table A-VI. As the level of Dye A or Dye B was increased in the sensitized control emulsion, the overall speed of the emulsion decreased. The dyed doped invention emulsions showed higher speed than the dyed undoped control emulsion in all cases. Similarly, as can be seen from Table A-V, high intensity reciprocity failure was improved in the doped invention emulsions compared to the undoped control emulsion.

TABLE A-VII

Difference In Log Relative Speed Times 100, Between Doped, Dyed Emulsions (Dye A) And Undoped, Dyed Control, Comparative Examples.*

| Emul. | Dopant | 0.00 mmole dye/Ag mole | 0.25 mmole dye/Ag mole | 0.50 mmole dye/Ag mole | 0.75 mmole dye/Ag mole |
|---|---|---|---|---|---|
| A1 | NONE | 0 | 0 | 0 | 0 |
| A14 | (CD-2) | 0 | 6 | −53 | −35 |
| A15 | (CD-6) | 3 | −5 | −55 | −31 |

*The larger the speed number, the greater the improvement in dyed speed in the doped emulsion over the undoped control. Speed measured at 0.15 optical density above Dmin.

Comparative Emulsions A14 and A15 were doped with dopant anions $[Fe(EDTA)]^{-1}$ (CD-2) and $[Fe(C_2O_4)_3]^{3-}$ (CD-6), respectively. Dopant anions (CD-2) and (CD-6) do not satisfy the requirements of this invention. ICP-AES measurements of the Fe content in degelled emulsion A14 showed no significant increase in Fe level above background levels despite the addition of the iron-containing comparative dopant $[Fe(EDTA)]^{-1}$ (CD-2). This failure to incorporate Fe was reflected by the failure to see a significant change in undyed speed as a result of doping with (CD-2) and the observation of significantly reduced dyed speeds in the doped emulsion A14. The latter change is attributed to the presence of unincorporated dopant on the grain surface. The observation of similar effects in emulsion A15 indicate that no part of dopant $[Fe(C_2O_4)_3]^{3-}$ (CD-6) was effectively incorporated into the silver bromide grain.

Example 3

The B Series

These examples have as their purpose to demonstrate reduced dye desensitization and reduced high intensity reciprocity failure (HIRF) in octahedral (i.e., regular {111}) silver bromoiodide emulsions as a result of introducing during precipitation metal coordination complexes satisfying the requirements of the invention.

Emulsion B1 The double jet precipitation method described in Example A was modified to produce $AgBr_{0.97}I_{0.03}$ octahedral emulsions with edge lengths of 0.5 μm±0.05 μm and with the iodide distributed uniformly throughout the emulsion grain.

Emulsion B2 was precipitated like Emulsion B1, except that 13.4 mppm total of dopant anion MC-38 was introduced into the outer 72 to 93.5% of the grain volume. The initial 0 to 72% of the grain volume and the final 93.5% to 100% of the grain volume was undoped.

A portion of each of these emulsions was optimally chemically sensitized by the addition of 100 mg/Ag mole of sodium thiocyanate, 16 μmole/Ag mole of sodium thiosulfate and bis (1,4,5-triethyl-1,2,4-triazolium-3-thiolate gold(I) tetrafluroborate at 40° C., followed by a digestion for 22 minutes at 70° C. The chemically sensitized emulsions were divided into 3 portions. The red spectral sensitizing dye (DYE A) (5,5'-dichloro-3,3',9-triethylthiacarbocyanine p-toluenesulfonate) was added, from methanolic solution at levels of 0.50 and 0.75 millimoles per Ag mole to two of the portions after which the samples were held at 40° C. for one hour.

Photographic Comparison

Emulsions B were coated and exposed as described for Emulsions A.

TABLE B-I

Difference in Log Relative Speed times 100, between Doped, Dyed Emulsion and Undoped, Dyed Control*

| Emulsion | Dopant | 0.50 mmole dye/Ag mole | 0.75 mmole dye/Ag mole |
|---|---|---|---|
| B1 | none | 0 | 0 |
| B2 | MC-38 | 36 | 43 |

*The larger the speed number the greater the improvement in dyed speed in the doped emulsion over the undoped control.

TABLE B-II

Difference between relative log speeds times 100, obtained at 0.01 and $10^{-5}$ sec exposure, measured at $D_{min}$ plus 0.15 density.*

| Emulsion | Dopant | 0.50 mmole dye/Ag mole | 0.75 mmole dye/Ag mole |
|---|---|---|---|
| B1 | none | 25 | 41 |
| B2 | MC-38 | 9 | 11 |

*Results are improved as differences diminish.

As the level of Dye A was increased in the sensitized control emulsion, the overall speed of the emulsion decreased. The dyed doped emulsion showed higher speed than the dyed undoped control emulsion in all cases. The speed increases of the dyed doped emulsion relative to the dyed undoped control are shown in Table B-I. Similarly, as can be seen from Table B-II, high intensity reciprocity failure generally increased with the addition of dye in control emulsions. High intensity reciprocity failure was improved in the doped emulsions.

Example 4

The C Series

These examples demonstrate the effectiveness of cobalt coordination complexes with organic ligands to reduce photographic speed while otherwise retaining emulsion characteristics—e.g., $D_{min}$ and contrast.

Emulsion C1 The double jet precipitation method used for Emulsion A7 was used to produce the monodispersed, 0.5 μm edge length, octahedral AgBr grains, except that the dopant solution was modified to introduce a total of 11 mppm of dopant anion MC-17 into the outer 72–92.5% of the grain volume.

This emulsion was chemically sensitized by the addition of sodium thiosulfate and bis (1,4,5-triethyl-1,2,4-triazolium-3-thiolate gold(I) tetrafluroborate, followed by a digestion for 40 minutes at 70° C. The levels of these sensitizers necessary to give optimum speed and minimum density were determined for emulsions C1 and A1 and these were used for the coatings described below.

Photographic Comparison

Emulsion C1was coated and exposed as described for Emulsions A.

The photographic parameters of emulsion C1 are compared to those of a control emulsion A1 in Table C-I. It can be seen that this level and placement of dopant MC-17 is useful for decreasing the speed of the emulsion without modifying curve shape.

| Emulsion | Dopant | $D_{min}$ | Speed | Contrast |
|---|---|---|---|---|
| A1 | none | 0.10 | 306 | 1.58 |
| C1 | MC-17 | 0.10 | 237 | 1.57 |

Example 5

The D Series

These examples have as their purpose to demonstrate the effectiveness of coordination complexes with aliphatic sulfoxide ligands to increase the contrast of silver bromide emulsions.

Emulsion D1: The double jet precipitation method used for Emulsion A2 was used to produce the monodispersed, 0.5 μm edge length, octahedral AgBr grains, except that the dopant solution was modified to introduce a total of 46.7 mppm of dopant anion MC-14rr into the outer 0.5 to 93.5% of grain volume. This emulsion was optimally sulfur and gold chemically sensitized employing a digestion for 40 minutes at 70° C.

Emulsion D2 was prepared like emulsion D1, except that the dopant solution was modified to introduce a total of 100 mppm of dopant anion MC-14rr into the outer 72% to 93.5% of the grain volume. This emulsion was optimally sulfur and gold chemically sensitized employing a digestion for 40 minutes at 70° C.

The criterion for optimum chemical sensitization was maximum speed and higher contrast with low minimum density. The same chemical sensitization was given to a sample of control emulsion A1 and these emulsions were used for the coatings described below.

Photographic Comparison

Emulsions D1 and D2 were coated and exposed as described for the A Series Emulsions.

The photographic parameters of emulsions D1 and D2 are compared to those of a control emulsion A1 in Table D-I. It can be seen that dopant MC-14rr was useful for increasing the contrast of the doped emulsions compared to the undoped control.

TABLE D-I

Dmin, Log Relative Speed times 100 and Contrast for Emulsions A1, D1 and D2

| Emulsion | Dopant | $D_{min}$ | Speed | Contrast |
|---|---|---|---|---|
| A1 | none | 0.10 | 271 | 1.94 |
| D1 | MC-14rr | 0.10 | 235 | 2.25 |
| D2 | MC-14rr | 0.10 | 213 | 2.61 |

Example 6

The E Series

These examples have as their purpose to demonstrate the effectiveness of coordination complexes of rhodium and at least one organic ligand to increase the contrast of regular cubic grain silver bromochloride emulsions.

Emulsion E1 was prepared as follows:

| | |
|---|---|
| Solution A: | |
| Gelatin (bone) | 180 g |
| D. W. | 7200 g |
| Solution B: | |
| 1.2 N in Sodium bromide | |
| 2.8 N in Sodium chloride | |
| Solution C | |
| 2.0 N Silver nitrate | |
| Solution D | |
| Gelatin (bone) | 180 g |
| D. W. | 1000 g |

Solution A was adjusted to a pH of 3 at 35° C., and pAg was adjusted to 7.87 with a NaCl solution. Solutions B and C were run into solution A with stirring. Solutions B and C were run in at rates of about 17.3 and 30 ml/min, respectively, for the first 3 minutes. The addition rate of solution C was then ramped from 30 to 155 ml/min and solution B was ramped from 17.3 to 89.3 ml/min in 12.5 min. Solutions C and B were then run in at 155 ml/min and 89.3 ml/min respectively for 21 min. The pAg was controlled at 7.87 during the addition of solutions B and C. The temperature was then raised to 40° C. and the pAg adjusted to 8.06. The emulsion was washed until the pAg measured 7.20. The emulsion was concentrated and solution D was added. The pAg was adjusted to 7.60 and the pH adjusted to 5.5.

The $AgCl_{0.70}Br_{0.30}$ emulsions prepared had a narrow distribution of grain sizes and morphologies; emulsion grains were cubic shape with edge lengths of 0.17 μm.

Emulsion E1 was chemically sensitized by the addition of 0.812 mg/Ag mole of 4,4'-phenyldisulfide diacetanilide from methanolic solution, $13.35\times10^{-6}$ mole/Ag mole of 1,3-di(carboxymethyl)-1,3-dimethyl-2-thiourea disodium monohydrate and $8.9\times10^{-6}$ mole/Ag mole potassium tetrachloroaurate(III), followed by a digestion for 10 minutes at 65° C.

Emulsion E2 was prepared and sensitized as for emulsion E1, except that the salt solution was modified so as to introduce a total of 0.14 mppm of dopant anion MC-46 through the entire emulsion grain.

Photographic Comparison

Coatings of each of the above optimally sensitized emulsions were made at 21.5 mg Ag/dm$^2$ and 54 mg gelatin/dm$^2$ with a gelatin overcoat layer made at 10.8 mg gelatin/dm$^2$ a surfactant and a hardener, on a cellulose acetate support. Some coatings of each sensitized emulsion were exposed for 0.1 second to 365 nm on a standard sensitometer and then developed for 6 minutes in a hydroquinone-Elon™ (N-methyl-p-aminophenol hemisulfate) surface developer at 21° C.

The photographic parameters of emulsions E1 and E2 are shown in Table E-I. It can be seen that dopant MC-46 was useful for increasing emulsion contrast and for reducing Dmin.

TABLE E-I

Dmin, Log Relative Speed times 100 and Contrast for Emulsions E

| Emulsion | Dopant | $D_{min}$ | Speed | Contrast |
|---|---|---|---|---|
| E1 | none | 0.04 | 235 | 3 |

TABLE E-I-continued

| Emulsion | Dopant | Dmin, Log Relative Speed times 100 and Contrast for Emulsions E $D_{min}$ | Speed | Contrast |
|---|---|---|---|---|
| E2 | MC-46 | 0.03 | 171 | 3.6 |

Example 7

The F Series

These examples have as their purpose to demonstrate the effectiveness of coordination complexes of iridium and/or iron and at least one organic ligand to increase speed and reduce reciprocity failure of regular cubic grain silver chloride emulsions.

Control Emulsion F1 was prepared in the absence of any dopant salt. A reaction vessel containing 5.7 liters of a 3.95% by weight gelatin solution was adjusted to 46° C., pH of 5.8 and a pAg of 7.51 by addition of a NaCl solution. A solution of 1.2 grams of 1,8-dihydroxy-3,6-dithiaoctane in 50 ml of water was then added to the reaction vessel. A 2M solution of $AgNO_3$ and a 2M solution of NaCl were simultaneously run into the reaction vessel with rapid stirring, each at a flow rate of 249 ml/min. with controlled pAg of 7.51. The double jet precipitation continued for 21.5 minutes, after which the emulsion was cooled to 38° C., washed to a pAg of 7.26, and then concentrated. Additional gelatin was introduced to achieve 43.4 grams of gelatin/Ag mole, and the emulsion was adjusted to pH of 5.7 and pAg of 7.50. The resulting silver chloride emulsion had a cubic grain morphology and a 0.34 μm average edge length.

Emulsion F2 was prepared similarly as Emulsion F1, except as follows: During the precipitation, an iridium containing dopant was introduced via dissolution into the chloride stream in a way that introduced a total of 0.32 mppm of dopant MC-27a into the outer 93% to 95% of the grain volume. A shell of pure silver chloride (5% of the grain volume) was then precipitated to cover the doped band.

Emulsion F3 was precipitated as described for Emulsion F2, except that dopant MC-27a was added at a level of 0.16 ppm into the outer 93% to 95% of the grain volume.

Emulsion F4 was precipitated as described for Emulsion F2, except that dopant MC-32d was introduced at a total level of 0.32 mppm into the outer 93% to 95% of the grain volume. Analyses for iridium incorporation were performed by ICP-MS. The iridium levels in this emulsion were at least as high as those detected in a comparative emulsion doped with the conventional iridium dopant anions, $(IrCl_6)^{3-}$ or $(IrCl_6)^{2-}$.

Emulsion F5 was precipitated as described for Emulsion F2, except that dopant MC-32d was introduced at a total level of 0.10 mppm into the outer 93% to 95% of the grain volume.

Emulsion F6 was precipitated as described for Emulsion F2, except that MC-41 was introduced at a total level of 0.32 mppm into the outer 93% to 95% of the grain volume. Analyses for iridium incorporation were performed by ICP-MS. The iridium levels in this emulsion were at least as high. as those detected in comparative emulsions prepared doped with the conventional iridium dopant anions, $(IrCl_6)^{3-}$ or $(IrCl_6)^{2-}$.

Emulsion F7 was precipitated as described for Emulsion F2, except that dopant MC-41 was introduced at a total level of 0.16 mppm into the outer 93% to 95% of the grain volume.

Emulsion F8 was precipitated as described for Emulsion F2, except that dopant MC-31 was introduced at a total level of 0.16 mppm into the outer 93% to 95% of the grain volume.

Emulsion F9 was precipitated as described for Emulsion F2, except that dopant MC-29a was introduced at a total level of 0.32 mppm into the outer 93% to 95% of the grain volume. The iridium levels in this emulsion were at least as high as those detected in a comparative emulsions doped with the conventional iridium dopant anions, $(IrCl_6)^{3-}$ or $(IrCl_6)^{2-}$.

Emulsion F10 was precipitated as described for Emulsion F2, except that dopant MC-29b was introduced at a total level of 0.32 mppm into the outer 93% to 95% of the grain volume.

Emulsion F11 was precipitated as described for Emulsion F2, except that dopant MC-29c was introduced at a total level of 0.32 mppm into the outer 93% to 95% of the grain volume.

Emulsion F12 was precipitated as described for Emulsion F2, except that dopant MC-42 was introduced at a total level of 0.32 mppm into the outer 93% to 95% of the gra mn volume.

Emulsion F13 was precipitated as described for Emulsion F2, except that dopant MC-43 was introduced at a total level of 0.32 mppm into the outer 93% to 95% of the grain volume.

Emulsion F14 was precipitated as described for Emulsion F2, except that dopant MC-14rr was introduced at a total level of 25 mppm into the outer 79.5% to 92% of the grain volume.

Emulsion F15 was precipitated as described for Emulsion F2, except that dopant MC-14rr was introduced at a total level of 43.7 mppm into the outer 7.9% to 95% of the grain volume. Analysis of this emulsion by ICP-AES showed that, within experimental error, the incorporated Fe level was the same as in similarly prepared emulsions doped with the conventional dopant anion $[Fe(CN)_6]^{4-}$.

Emulsion F16 was precipitated as described for Emulsion F2, except that EDTA (CD-1) was introduced as a dopant at a total level of 43.7 mppm into the outer 7.9% to 95% of the grain volume. Analysis of this emulsion by ICP-AES showed that the Fe level was less than the detection limit of this technique (3 mppm Fe in AgCl).

Emulsion F17 was precipitated as described for Emulsion F2, except that dopant Fe(EDTA)(CD-2) was introduced at a total level of 43.7 mppm into the outer 7.9% to 95% of the grain volume. Analysis of this emulsion by ICP-AES showed that the Fe level was less than the detection limit of this technique (3 mppm Fe in AgCl).

Emulsion F18 was precipitated as described for Emulsion F2, except that dopant $[Fe(CN)_6]^{4-}$ (CD-5) was introduced at a total level of 21.8 mppm into the outer 7.9% to 95% of the grain volume.

Emulsion F19 was precipitated as described for Emulsion F2, except that dopant MC-14c was introduced through a third jet from a 0.1 molar aqueous $KClO_4$ solution and at a total level of 43.7 mppm into the outer 7.9% to 95% of the grain volume. The emulsion was studied by EPR spectroscopy, and the results were as described above in Example 1.

Emulsion F20 was precipitated as described for emulsion F2, except that dopant MC-41 was introduced at a total level of 21.8 mppm into the outer 7.9 to 95% of the grain volume. This emulsion was examined by EPR spectroscopy, as described in Example 1, in order to demonstrate the incorporation of organic ligands within the silver halide grain structure. Exposure of the emulsion F20 at between 180° and 240° K. produced a distinct EPR spectrum, with well resolved iridium and chlorine hyperfine structure. The spectrum could unequivocally be assigned to an iridium (II) ion at a silver position in the silver halide lattice. The EPR g-values were as follows: $g_1$=2.911±0.001, $g_2$=2.634±0.001, $g_3$=1.871±0.001. These are significantly different from those measured previously for $(IrCl_6)_{4-}$ in a AgCl matrix ($g_1$=$g_2$=2.772±0.001, $g_3$=1.883±0.001) or for $(IrCl_5H_2O)_{3-}$ in a AgCl matrix ($g_1$=3.006±0.001, $g_2$=2.702±0.001, $g_3$ ≦2.0. Since no EPR signals from these possible contaminants were observed in emulsion F20, it was concluded that the dopant complex MC-41, $(IrCl_5thiazole)^{2-}$, was incorporated intact. On exposure 9.7 $[IrCl_5(thiazole)]^{2-}$ trapped an electron to give $[IrCl_5(thiazole)]_{3-}$, which was detected by EPR.

Emulsion F21 was precipitated as described for emulsion F2, except that dopant MC-29a was introduced at a total level of 21.8 mppm into the outer 7.9 to 95% of the grain volume. The emulsion was examined by EPR spectroscopy, as described in Example 1. Exposure of emulsion F21 at 210° K. produced a distinctive EPR spectrum with well resolved indium and chlorine hyperfine structure. The spectrum could unequivocally be assigned to an iridium (II) ion at a silver position the silver halide lattice. The EPR parameters were as follows: $g_1$=3.043±0.001, $g_2$=2.503±0.001 and $g_3$= 1.823±0.005. These were significantly different from those measured previously for $(IrCl_6)^{4-}$ or $(IrCl_5H_2O)^{3-}$ in a AgCl matrix (see parameters listed above). Since no EPR signatures from these possible contaminants were observed in emulsion F21, it was concluded that dopant complex MC-31a, $[IrCl_5(pyrazine)]^{2-}$, was incorporated intact. On exposure, $[IrCl_5(pyrazine)]^{2-}$trapped an electron to give $[IrCl_5(pyrazine)]^{3-}$, which was detected by EPR.

The resulting emulsions were each divided into several portions.

Those portions designated portions (I) were chemically and spectrally sensitized by the addition of 30 mg/Ag mole of a colloidal dispersion of gold sulfide followed by digestion at 60° C. for 30 minutes. Following digestion each portion I was cooled to 40° and 300 mg/mole of 1-(3-acetamidophenyl)-5-mercapto-tetrazole were added and held for 10 minutes, followed by 20 mg/mole of red spectral sensitizing dye anhydro-3-ethyl-9,11-neopentylene-3'-(3-sulfopropyl)thiadicarbocyanine hydroxide (Dye C) and a 20 minute hold.

Those portions designated portions (Ia) were treated as for portions (I), except that no dye was added and the final 20 minute hold was eliminated.

Those portions designated portions (II) were chemically and spectrally sensitized as described for portions (I), except that 50 rather than 30 mg/Ag mole of a colloidal dispersion of gold sulfide was added for each emulsion.

Those portions designated portions (III) were chemically and spectrally sensitized by the addition of aurous bis(1,4,5-triazolium-1,2,4-trimethyl-3-thiolate) tetrafluoroborate, at 5, 7.5 or 10 mg per silver mole and di(carboxymethyl)-dimethyl thiourea, at 0.75 mg per silver mole followed by heat digestion and anti-foggant and dye addition as described for portions (I).

Portions (IV) were chemically and spectrally sensitized by the addition of 8.4 mg/Ag mole of a colloidal dispersion of gold sulfide, followed by digestion at 30 minutes at 60° C. The emulsion was then treated as for portion I, except that 1.3 grams of KBr per silver mole were added prior to the dye addition.

Photographic Comparison

Sensitized portions (I, Ia, II and III) of the F series emulsions described above were coated onto cellulose acetate film support at 21.53 mg/dm$^2$ silver chloride and 53.92 mg/dm$^2$ gelatin. A gelatin overcoat layer comprised of 10.76 mg/dm$^2$ gelatin and a hardener, bis(vinylsulfonylmethyl) ether, at a level of 1.5% by wt., based of total gelatin. Samples of these coated photographic elements were evaluated by exposure for 1/10 second to 365 nm radiation, followed by development for 12 minutes in Kodak DK-50™ developer. Additionally, samples of the coatings were evaluated for reciprocity failure by giving them a series of calibrated (total energy) whitelight exposures ranging from 1/10,000th of a second to 10 seconds, followed by development as above.

Sensitized portions (IV) of the F series emulsions described above were coated onto a photographic paper support at silver and gel levels of 1.83 and 8.3 mg/dm$^2$, respectively. A gelatin overcoat containing 4.2 mg/dm$^2$ of Coupler C1 and 1.5% by weight based on total gelatin of the hardener bis(vinylsulfonylmethyl) ether was applied over the emulsion.

Coupler C1

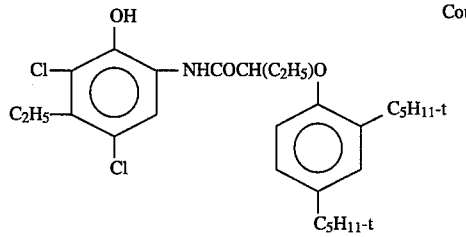

These coated photographic elements were evaluated by exposure for 1/10 second followed by development for 45 seconds in Kodak Ektacolor RA-4™ developer.

Additionally, the coatings were evaluated for reciprocity by giving them a series of calibrated (total energy) white light exposures ranging from 1/10,000th of a second to 10 seconds, followed by development as above. In Tables F-I, F-II and F-III high intensity reciprocity failure (HIRF) and low intensity reciprocity failure (LIRF) are reported as the difference between relative log speeds times 100 measured a minimum density plus 0.15 optical density obtained at exposures of $10^{-4}$ and $10^{-1}$ second for HIRF and $10^{-1}$ and 10 seconds for LIRF. In all reciprocity failure investigations, regardless of the exact measurement points selected for comparison, ideal performance is for no speed difference—e.g., HIRF or LIRF are ideally zero or as near zero as attainable.

TABLE F-I

| Emulsion | Dopant | Sensitization | HIRF | LIRF |
|---|---|---|---|---|
| F1 | control | I | 24 | 21 |
| F2 | MC-27a | I | 12 | 17 |
| F3 | MC-27a | I | 14 | 19 |
| F5 | MC-33d | I | 10 | 14 |
| F6 | MC-41 | I | 0 | 6 |
| F7 | MC-41 | I | 2 | 14 |
| F8 | MC-31 | I | 14 | 15 |
| F9 | MC-29a | I | 3 | 20 |
| F10 | MC-29b | I | 14 | 18 |
| F11 | MC-29c | I | 15 | 19 |
| F12 | MC-42 | I | 2 | 19 |
| F13 | MC-43 | I | 23 | 22 |

TABLE F-II

| Emulsion | Dopant | Sensitization | HIRF | LIRF |
|---|---|---|---|---|
| F1 | control | II | 26 | 16 |
| F2 | MC-27a | II | 15 | 15 |

TABLE F-II-continued

| Emulsion | Dopant | Sensitization | HIRF | LIRF |
|---|---|---|---|---|
| F3 | MC-27a | II | 16 | 14 |

TABLE F-III

| Emulsion | Dopant | Sensitization | HIRF | LIRF |
|---|---|---|---|---|
| F1 | control | III, 10 mg/mole Au(I) salt | 19 | 13 |
| F2 | MC-27a | III, 10 mg/mole Au(I) salt | 13 | 9 |
| F3 | MC-27a | III, 5 mg/mole Au(I) salt | 1 | 5 |

TABLE F-IV

Reciprocity Data for Format IV

| Emulsion | Dopant | Sensitization | Speed RF[a] | Shoulder Δ density[b] | Toe Δ density[c] |
|---|---|---|---|---|---|
| F1 | control | IV | −40 | −0.33 | 0.11 |
| F2 | MC-27a | IV | −36 | −0.05 | 0.04 |
| F4 | MC-32d | IV | −29 | −0.23 | 0.03 |
| F6 | MC-41 | IV | −27 | −0.23 | 0.07 |
| F7 | MC-41 | IV | −33 | −0.20 | 0.09 |
| F9 | MC-29a | IV | −27 | −0.38 | 0.13 |

[a] = Speed RF is taken as the speed difference of equivalent exposures (intensity x time) of 0.1 and 100 sec duration. Zero is the ideal difference.
[b] = Shoulder Δ density is the difference in density at a point 0.3 log E slow of the 1.0 optical density speed point for two equivalent exposures, the first of 0.1 sec duration and the second of 100 sec duration. Zero is the ideal difference.
[c] = Toe Δ density is the difference in density at a point 0.3 log E fast of the 1.0 optical density speed point for two equivalent exposures, the first of 0.1 sec duration and the second of 100 sec duration. Zero is the ideal difference.

TABLE F-V

| Emulsion | Dopant | Sensitization | Dmin | Relative Log (inertial) E |
|---|---|---|---|---|
| F1 | control | I | 0.06 | 150 |
| F14 | MC-14rr | I | 0.04 | 164 |
| F16 | EDTA (CD-1) | I | 0.06 | 154 |
| F17 | $[Fe(EDTA)]^{1-}$ (CD-2) | I | 0.07 | 151 |
| F18 | $[Fe(CN)6]^{4-}$ (CD-5) | I | 0.06 | 161 |
| F1 | control | Ia | 0.06 | 167 |
| F14 | MC-14rr | Ia | 0.04 | 191 |
| F16 | CD-1 | Ia | 0.06 | 172 |
| F17 | CD-2 | Ia | 0.07 | 172 |
| F18 | CD-5 | Ia | 0.06 | 170 |

The photographic characteristics of emulsions F are given in Tables F-I, F-II, F-III, F-IV and F-V. For portions III, the best Au(I) level for each emulsion was chosen based on the photographic results and these are the results shown in Table F-III.

Tables F-I, F-II and F-III show significant reductions in HIRF to be produced by the incorporation as a grain dopant of iridium complexes containing an acetonitrile, pyridazine, thiazole or pyrazine ligand. Additionally these complexes are capable of significantly reducing LIRF.

The results in Table F-IV show that an iron pentacyano complex containing an organic ligand is capable of producing performance characteristics in the emulsion that are superior to those obtained using an iron hexacyanide complex as a dopant. Further, it is demonstrated that EDTA used alone or as a ligand for iron does not produce the performance advantages demonstrated for the dopant satisfying the requirements of the invention.

Example 8

The G Series

These examples demonstrate that ripening Lippmann silver bromide emulsions doped with coordination complexes satisfying the requirements of the invention onto silver chloride cubic grain emulsions produces doped emulsions with improved reciprocity, thermal stability and latent image keeping properties.

The series G emulsions used conventional precipitation techniques employing thioether silver halide ripening agents of the type disclosed in McBride U.S. Pat. No. 3,271,157.

Substrate Emulsion S1 was prepared as follows: A reaction vessel containing 8.5 liters of a 2.8% by weight gelatin aqueous solution and 1.8 grams of 1,8-dihydroxy-3,6-dithiaoctane was adjusted to a temperature of 68.3° C., pH of 5.8 and a pAg of 7.35 by addition of NaCl solution. A 3.75 molar solution containing 1658.0 grams of $AgNO_3$ in water and a 2.75 molar solution containing 570.4 grams of NaCl in water were simultaneously run into the reaction vessel with rapid stirring, each at a flow rate of 84 ml/min. The double jet-precipitation continued for 31 minutes at a controlled pAg of 7.35. A total of 9.76 moles of silver chloride were precipitated, the silver chloride having a cubic morphology of 0.6 μm average cube length.

A series of Lippmann bromide carrier emulsions were prepared as a means of introducing the dopant complex into the emulsion grain during the chemical/spectral sensitization step.

Undoped Lippmann control Emulsion L1 was prepared as follows: A reaction vessel containing 4.0 liters of a 5.6% by weight gelatin aqueous solution was adjusted to a temperature of 40° C., pH of 5.8 and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring, each at a constant flow rate of 200 ml/min. The double jet precipitation continued for 3 minutes at a controlled pAg of 8.86, after which the double jet precipitation was continued for 17 minutes during which the pAg was decreased linearly from 8.86 to 8.06. A total of 10 moles of silver bromide (Lippmann bromide) was precipitated, the silver bromide having average grain sizes of 0.05 μm.

Emulsion L2 was prepared exactly as Emulsion L1, except a solution of 0.217 gram of $[IrCl_6]^{2-}$ (CD-3) in 25 ml water was added at a constant flow rate beginning at 50% and ending at 90% of the precipitation. This triple jet precipitation produced 10 moles of a 0.05 μm particle diameter emulsion.

Emulsion L3 was prepared exactly as Emulsion L1, except a solution of 0.528 gram of MC-29a in 25 ml water was added at a constant flow rate beginning at 50% and ending at 90% of the precipitation. This triple jet precipitation produced 10 moles of a 0.05 μm particle diameter emulsion.

Emulsion L4 was prepared exactly as Emulsion L1, except a solution of 0.488 gram of MC-31 in 25 ml water was added at a constant flow rate beginning at 50% and ending at 90% of the precipitation. This triple jet precipitation produced 10 moles of a 0.05 μm particle diameter emulsion.

Doped and chemically and spectrally sensitized emulsions were prepared as follows:

Control Emulsion G1 was prepared as follows: A 50 millimole (mmole) sample of Emulsion S1 was heated to 40° C. and spectrally sensitized by the addition of 14 milligrams (mg) of the blue spectral sensitizing dye, Dye D, anhydro-5-chloro-3,3'-di(3-sulfopropyl)naphtho[1,2-d]thiazolothiacyanine hydroxide triethylammonium salt.

This was followed by the addition of 0.45 mmoles of Emulsion L1. The temperature was raised to 60° C. to accelerate recrystallization of the Lippmann bromide onto the grain surfaces of Emulsion G1. To the emulsion were added 0.13 mg of sodium thiosulfate and 9.5 mg of 4-hydroxy-6-methyl-1,3,3a,7-tetraazaindene, and the emulsion was held at 60° C. for 30 to 50 minutes until optimal chemical sensitization was achieved. Addition of 1-(3-acetamidophenyl)-5-mercaptotetrazole followed to complete the finishing operation.

Comparative and example emulsions, identified in Table G-I, were prepared as described for emulsion G1, except that the 0.45 mmole of Emulsion L1 used for emulsion G1 was replaced by equivalent amounts of a combination of emulsion L1 and emulsions L2, L3 or L4 as outlined in Table G-I.

TABLE G-I

| | | Component Emulsions used in preparation of G Series Emulsions | | | |
|---|---|---|---|---|---|
| Emulsion | Total amount of Lippmann Emulsion (mmole) | Amount of L1 (mmole) | Amount of L# (mmole) | Dopant complex incorporated | Nominal Dopant level in Epitaxy (mppm) |
| G2a comp. | 0.45 | 0.40 | 0.05, L2 | CD-3 | 5 |
| G2b comp. | 0.45 | 0.35 | 0.10, L2 | CD 3 | 10 |
| G2c comp. | 0.45 | 0.30 | 0.15, L2 | CD 3 | 15 |
| G3a inv. | 0.45 | 0.40 | 0.05, L3 | MC-29a | 5 |
| G3b inv. | 0.45 | 0.35 | 0.10, L3 | MC-29a | 10 |
| G3c inv. | 0.45 | 0.30 | 0.15, L3 | MC-29a | 15 |
| G4a inv. | 0.45 | 0.40 | 0.05, L4 | MC-31 | 5 |
| G4b inv. | 0.45 | 0.35 | 0.10, L4 | MC-31 | 10 |
| G4c inv. | 0.45 | 0.30 | 0.15, L4 | MC-31 | 15 |

The emulsions were coated on a photographic paper support as disclosed in U.S. Pat. No. 4,994,147 at 0.28 gram/m$^2$ silver with 0.002 gram/m$^2$ of 2,4-dihydroxy-4-methyl-1-piperidinocyclopenten-3-one and 0.02 gram/m$^2$ of KCl and 1.08 gram/m$^2$ yellow dye-forming coupler C2:

Coupler C2

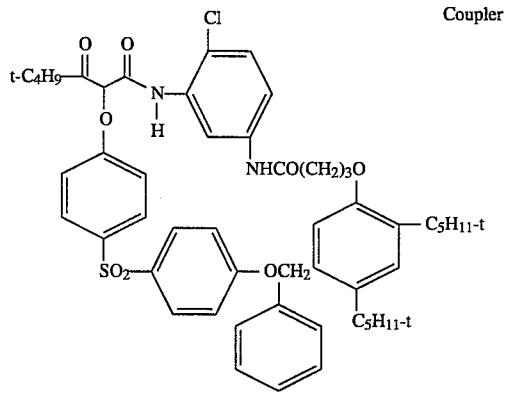

to give a layer with 0.166 gram/m$^2$ gelatin. A 1.1 gram/m$^2$ gelatin protective overcoat was applied along with bis(vinylsulfonylmethyl)ether gelatin hardener.

The coatings were exposed through a step tablet to a 3000° K. light source for various exposure times and processed as recommended in "Using KODAK EKTACOLOR RA Chemicals", Publication No. Z-130, published by Eastman Kodak Co., 1990, the disclosure of which is here incorporated by reference.

The photographic parameters obtained for these emulsions are shown in Tables G-II and G-III:

TABLE G-II

| | | Speed, Reciprocity and Keeping Parameters for Emulsions G | | | |
|---|---|---|---|---|---|
| Emulsion # | Dopant complex incorporated in Emulsion G | Nominal Dopant level in Epitaxy (mppm) | Speed[a] for 100 sec exposure | Speed RF | Incubation Δ speed[b] |
| G1 control | none | 0 | 154 | −61 | 17 |
| G3a inv. | MC-29a | 5 | 135 | −44 | 14 |
| G3b inv. | MC-29a | 10 | 123 | −29 | 13 |
| G3c inv. | MC-29a | 15 | 116 | −30 | 14 |
| G4a inv. | MC-31 | 5 | 152 | −63 | 14 |
| G4b inv. | MC-31 | 10 | 147 | −57 | 19 |
| G4c inv. | MC-31 | 15 | 143 | −48 | 17 |

[a] = Speed is based on the light exposure required to obtain an optical density of 1.0.

TABLE G-II-continued

| Emulsion # | Dopant complex incorporated in Emulsion G | Nominal Dopant level in Epitaxy (mppm) | Speed[a] for 100 sec – exposure | Speed RF | Incubation Δ speed[b] |
|---|---|---|---|---|---|
| | | Speed, Reciprocity and Keeping Parameters for Emulsions G | | | |

[b] = Incubation Δ speed is the speed difference between a coating stored for 3 weeks at 49° C. and 50% relative humidity conditions and a check coating stored at −18° C. and 50% relative humidity conditions. Ideally the difference should be zero.

TABLE G-III

| Emulsion # | Dopant complex incorporated in Emuls. G | Nominal Dopant level in Epitaxy (mppm) | Heat Sensitivity Δ[a] Speed[b] | Heat Sensitivity Δ[a] Toe[b,c] | Latent Image Keeping Δ[d] Speed[b] | Latent Image Keeping Δ[d] Toe[b,c] |
|---|---|---|---|---|---|---|
| | | Heat Sensitivity and Latent Image Keeping Parameters for Emulsions G | | | | |
| G1 control | none | 0 | 25 | −0.06 | −2 | −0.02 |
| G2a comp. | CD-3 | 5 | 8 | 0 | 14 | −0.01 |
| G2b comp. | CD-3 | 10 | 8 | 0 | 23 | −0.09 |
| G2c comp. | CD-3 | 15 | 9 | −0.02 | 32 | −.12 |
| G3a inv. | MC-29a | 5 | 13 | −0.05 | 2 | −0.01 |
| G3b inv. | MC-29a | 10 | 9 | −0.01 | 1 | −0.01 |
| G3c inv. | MC-29a | 15 | 8 | −0.02 | 3 | −0.02 |
| G4a inv. | MC-31 | 5 | 20 | −0.09 | 1 | −0.02 |
| G4b inv. | MC-31 | 10 | 16 | −0.06 | 1 | −0.01 |
| G4c inv. | MC-31 | 15 | 11 | −0.03 | 2 | −0.01 |

[a] = Heat sensitivity Δ measures the effect of temperature differences (40° C. versus 20° C.) at the time of exposure, taken as the difference in sensitometry.
[b] = Speed and Toe measured for a 0.1 sec exposure
[c] = Toe is the density of the sensitometric curve at an exposure scale value 0.3 log E less than that of the 1.0 optical density speed point.
[d] = Latent Image keeping Change is the effect of delay time between exposure and processing, taken as the (30' vs. 30") difference in sensitometry.

The results in Tables G-II and G-III demonstrate that emulsions doped with coordination complexes containing iridium and pyrazine have improved reciprocity performance and, unlike comparison dopant $IrCl_6]^{2-}$ (CD-3), show good heat sensitivity and latent image keeping properties.

Example 9

The H Series

These examples have as their purpose to demonstrate the effectiveness of coordination complexes of iridium and pyrazine ligands to reduce high and low intensity reciprocity failure in silver iodobromide tabular grain emulsions.

Each of the emulsions in this series contained $AgBr_{95.9}I_{4.1}$ tabular grains exhibiting a mean equivalent circular diameter of approximately 2.7 μm and a mean thickness of 0.13 μm.

Emulsion H1, an undoped control emulsion, was prepared as follows:

| | |
|---|---|
| Solution A: | |
| gelatin (bone) | 10 g |
| NaBr | 30 g |
| $H_2O$ | 5000 ml |
| Solution B: | |
| 0.393N $AgNO_3$ | 514 ml |
| Solution C: | |

-continued

| | |
|---|---|
| 2N NaBr | 359 ml |
| Solution D: | |
| 0.1286N $(NH_4)_2SO_4$ | 350 ml |
| Solution E: | |
| 2.5N NaOH | 40 ml |
| Solution F: | |
| 4N $HNO_3$ | 25 ml |
| Solution G: | |
| gelatin (bone) | 140.14 g |
| $H_2O$ | add to 1820 ml |
| Solution H: | |
| 2.709N NaBr | |
| 0.0413N KI | |
| Solution I: | |
| 2.75N $AgNO_3$ | 4304 ml |
| Solution J: | |
| 4.06N NaBr | 720 ml |
| Solution K: | |
| AgI | 0.36 mole |
| $H_2O$ | 760 ml |

Solution A was added to a reaction vessel. The pH of the reaction vessel was adjusted to 6 at 40° C. The temperature was raised to 65° C. and solutions B and C were added at rates of 64 ml/min and 15.3 ml/min, respectively for 1 min. Solutions D, E, F and G were then added consecutively. Solutions B and H were added at rates of 87 ml/min and 13.9 ml/min for 5 min while pAg was controlled at 9.07.

Solutions I and C were added, with continued pAg control, for the rates and times given below:

| Step | Solution I flow rate (ml/min) | Solution C flow rate (ml/min) | Time (min) |
|---|---|---|---|
| a | 15 increasing linearly to 40 | 16.2 increasing linearly to 42 | 25 |
| b | 40 increasing linearly to 98.1 | 42.2 increasing linearly to 102.3 | 31 |
| c | 100 | 104.7 | 1.5 |

Solutions J and K were then added consecutively. Solution I was then added at a rate of 50 ml/min over 24 min and solution C was used to control the pAg at 8.17. The emulsion was cooled to 40° C., washed to reach a pAg of 8.06 and concentrated.

Doped Emulsion H2 was prepared as described above, except that dopant MC-42 was introduced into the reaction vessel from an aqueous solution in the first part of step c. Dopant MC-42 was added in an amount needed to give a total dopant concentration of 0.025 mppm.

Doped Emulsion H3 was prepared as described above, except that dopant MC-31 was introduced into the reaction vessel from an aqueous solution in the first part of step c. Dopant MC-31 was added in an amount needed to give a total dopant concentration of 0.013 mppm.

Dope Emulsion H4 was prepared as described above, except that dopant MC-41 was introduced into the reaction vessel from an aqueous solution in the first part of step c. Dopant MC-41 was added in an amount needed to give a dopant concentration of 0.025 mppm.

Samples of emulsions Hi to H3 were sensitized by melting at 40° C., adding NaSCN at 100 mg/Ag mole, adding benzothiazolium tetrafluoroborate finish modifier at 30 mg/Ag mole, adding green sensitizing dyes Dye E and Dye F in an amount sufficient to provide from 65%–80% monolayer dye coverage in a 3:1 molar ratio of Dye E:Dye F, adding gold sensitizer in the form of sodium aurous (I) dithiosulfate dihydrate at 1.75 mg/Ag mole, adding sulfur sensitizer in the form of sodium thiosulfate at 0.87 mg/Ag mole. This mixture was then brought to 60° C. and held for 7 min. then chill set. Dye E was anhydro-5-chloro-9-ethyl-5'-phenyl-3'-(3-sulfobutyl)-3-(sulfopropyl)oxacarbocyanine hydroxide, sodium salt. Dye F was anhydro-6,6'-dichloro-1,1'-diethyl-3,3'-bis(3-sulfopropyl)-5,5'-bis(trifluoromethyl-)benzimidazole carbocyanine hydroxide, sodium salt.

The sensitized emulsion was combined with a coupler melt made up to provide a coating lay down of 53.82 mg/dm$^2$ gelatin, 21.53 mg/dm$^2$ Ag, 7.5 mg/dm$^2$ dye-forming coupler C3 and 1.75 g/Ag mole 5-methyl-s-triazole-[2-3-a]-pyrimidine-7-ol sodium salt onto a cellulose acetate photographic film support. The support had been previously coated with 3.44 mg/dm$^2$ Ag for antihalation and a 24.4 mg/dm$^2$ gelatin pad. The coupler containing emulsion layer was overcoated with 9.93 mg/dm$^{21}$gelatin and bis(vinylsulfonylmethyl)ether hardener at 1.75% by weight, based on gelatin.

Coupler C3

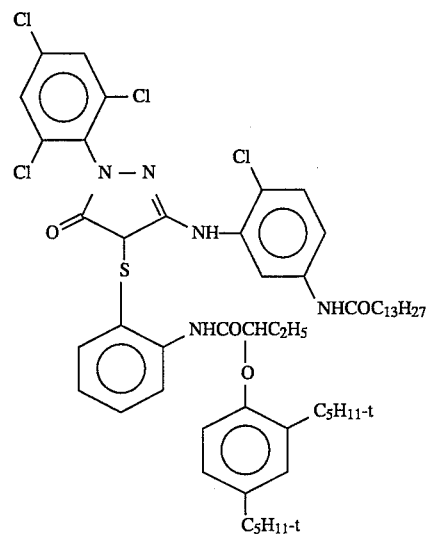

The coated photographic film samples were evaluated for reciprocity response by giving them a series of calibrated (total energy) exposures ranging from 1/10,000th of a second to 10 seconds, followed by development for 6 minutes in Kodak KRX™ developer, a hydroquinone-Elon™ (N-methyl-p-aminophenol hemisulfate) developer.

The results are tabulated in Tables H-I and H-II.

TABLE H-I

Reciprocity Response for Emulsions H

| Emulsion | Dopant | HIRF[a] | LIRF[b] |
|---|---|---|---|
| H1 | none | 15 | 46 |
| H2 | MC-42 | −8 | 23 |

TABLE H-II

Reciprocity Response for Emulsions H

| Emulsion | Dopant | LIRF[b] |
|---|---|---|
| H1 | none | 45 |
| H3 | MC-31 | 26 |

[a]= difference between relative log speeds times 100 obtained at 0.1 and $10^{-4}$ sec duration equivalent exposures, measured at optical density = 0.75 above Dmin. The ideal value is zero.

[b]= difference between relative log speeds times 100 obtained at 0.1 and 10 sec duration equivalent exposures, measured at optical density = 0.15 above Dmin. The ideal value is zero.

The reciprocity results demonstrate that iridium coordination complexes containing a pyrazine ligand were effective in reducing reciprocity failure, particularly low intensity reciprocity failure.

Portions of the undoped control emulsion H1 and the MC-41 doped example emulsion H4 were melted at 40° C., followed by adding NaSCN 120 mg/Ag mole, adding red spectral sensitizing dyes Dye G, anhydro-5,5'-dichloro-9-ethyl-3,3'-di(3-sulfopropyl)thiacarbocyanine hydroxide, and Dye H, anhydro-9-ethyl-5,5'-dimethyl-3,3'-di(3-sulfopropyl)-thiacarbocyanine hydroxide, triethylamine salt, in an amount sufficient to provide to 80% of monolayer dye coverage in a 9:1 molar ratio of Dye G:Dye H, adding gold sensitizer in the form of dithiosulfate dihydrate at 1.75 mg/Ag mole, adding sulfur sensitizer in the form of sodium thiosulfate at 3.5 mg/Ag mole, adding 20 mg/Ag mole of benzothiazolium tetrafluoroborate finish modifier. This mixture was brought to 60° C. and held for 20 min.

The sensitized emulsion portions were combined with a coupler melt made up to provide a coating laydown of 32.29 mg/dm$^2$, 10.76 mg/dm$^2$ Ag, 9.69 mg/dm$^2$ dye-forming coupler C4 onto a cellulose acetate photographic support.

Coupler C4

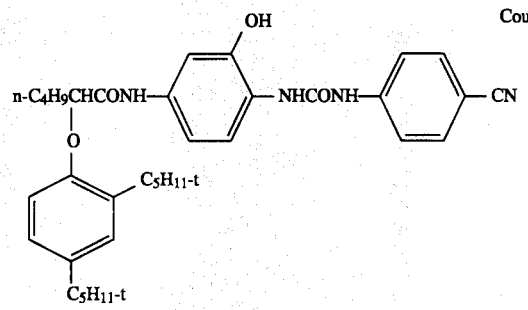

The support had been previously coated with 3.44 mg/dm$^2$ Ag for antihalation and a 24.4 mg/dm$^2$ gelatin pad. The coupler containing emulsion layer was overcoated with 9.93 mg/dm$^2$ gelatin and bis-(vinylsulfonylmethyl) ether hardener at 1.75% by weight, based on gelatin.

The coated photographic film samples were evaluated for reciprocity response by giving them a series of calibrated (total energy) exposures ranging from 1/100,000th of a second to 1 second, followed by development for 2 minutes 15 seconds in Kodak Flexicolor C-41™ developer.

The results are summarized in Table H-III.

TABLE H-III

Reciprocity Response for Emulsions H

| Emulsion | Dopant | LIRF[c] |
|---|---|---|
| H5 | none | 24 |
| H4 | MC-41 | 13 |

[c]= difference between relative log speeds times 100 obtained at 0.1 and 10 sec duration equivalent exposures, measured at optical density = 0.15 above Dmin. The ideal value is zero.

Example 10

The I Series

This series of examples is provided to demonstrate the effectiveness of iridium coordination complexes containing an oxalate ligand to increase photographic speed. The comparisons demonstrate that when more than half of the metal coordination sights are occupied by oxalate ligands no significant speed increase was realized.

The emulsions prepared for comparison in this example series were silver bromide regular octahedra that were doped by pAg cycling to produce a thin shell of doped silver bromide on the surface of the host grains.

Emulsion I1 A monodispersed one μm edge length octahedral AgBr emulsion was prepared by the double-jet technique described in Example series A, modified to produce the larger grain size by the presence of 500 mppm of the ripening agent 1,10-dithia4,7,13,16-tetraoxacyclooctadecane in the reaction vessel at the start of precipitation.

The emulsion was divided into 28 portions. These were sensitized with dopant salts of the series $[IrCl_{6-2n}(C_2O_4)_n]^{3-}$(n=1, MC-33; n-2, CD-7; and n=3, CD-8) as well as with $K_2C_2O_4 \cdot H_2O$ (CD-4) as follows: The pAg of the emulsion, measured at 40° C. was increased from 8.2 to 9.8 by the addition of 1.5 mole % NaBr (aq). The dopant salt was added from dilute aqueous solution in the amounts described in Table I-I. The emulsion was held at 40° C. for 15 minutes. Aqueous $AgNO_3$ was added in the amount of 1.5 mole %. The emulsion was held 15 minutes and then chilled. This procedure was designed to bury the dopant complex within a thin shell of AgBr.

The emulsion resulting from the above procedure was coated at 26.9 mg/dm$^2$ Ag and 75.35 mg/dm$^2$ gelatin on a cellulose acetate photographic film support. The resulting photographic element was exposed for 1/10th second to a 5500° K. color temperature light source through a graduated density filter and developed for 12 minutes in Kodak Rapid X-Ray™ developer, a hydroquinone-Elon™ (N-methyl-p-aminophenol hemisulfate) developer.

The photographic sensitivity imparted by these complexes is given in the Table I-I below:

TABLE I-I

Difference in Log Relative Speed times 100, between Doped (pAg cycled) Emulsion I1 and Undoped Control.

| Dopant # | Level (mppm) | (ΔLogE) × 100 |
|---|---|---|
| none-control i | 0 | 0 |
| none-control ii | 0 | −10 |
| none-control iii | 0 | 12 |
| MC-33 | 100 | 40 |
| " | 20 | 79 |
| " | 4 | 107 |
| " | 0.8 | 81 |
| " | 0.16 | 13 |
| " | 0.032 | −11 |
| " | 0.0064 | −4 |
| " | 0.0013 | 0 |
| CD-7 | 100 | −1 |
| " | 20 | −25 |
| " | 4 | −3 |
| " | 0.8 | −3 |
| " | 0.16 | −1 |
| " | 0.032 | 10 |
| CD-8 | 100 | −7 |
| " | 20 | −4 |
| " | 4 | −6 |
| " | 0.8 | 2 |
| " | .16 | −5 |
| CD-4 | 100 | 0 |
| " | 20 | 8 |
| " | 4 | 0 |
| " | .8 | 2 |
| " | .16 | 13 |
| " | .032 | 14 |
| " | .0064 | −1 |
| " | .0013 | 9 |

As can be seen from Table I-I, only the monooxalate complex (MC-33) showed any significant increase in photographic speed.

Examples 11–29

These examples have as their purpose to demonstrate the effectiveness of adding coordination complexes of iridium and at least one organic ligand to AgCl cubic grains. These emulsions demonstrate improved speed, reciprocity, heat sensitivity, and latent image keeping.

This series of emulsions used conventional precipitation techniques employing thioether silver halide ripening agents of the type disclosed in McBride U.S. Pat. No. 3,271,157.

Substrate Emulsion A was prepared as follows: A reaction vessel containing 5.7 1 of a 3.9% by weight gelatin solution and 1.2 g 1,8-dihydroxy-3,6-dithiaoctane was adjusted to 46° C., pH of 5.8 and a pAg of 7.51 by addition of a NaCl solution. A 2M solution of $AgNO_3$ and a 2M solution of NaCl were simultaneously run into the reaction vessel with rapid stirring, each at constant flow rates of 249 ml/min while controlling the pAg at 7.51. The emulsion was then washed to remove excess salts. The cubic emulsion grains had an edge length of about 0.38μm.

Substrate Emulsion B was prepared as follows: A reaction vessel containing 8.5 liters of a 2.8% by weight gelatin aqueous solution and 1.9 g 1,8-dihydroxy-3,6-dithiaoctane were adjusted to 68.3° C., pH of 5.8 and pAg of 7.35 by addition of NaCl solution. A 3.75M solution of $AgNO_3$ and a 3.75M solution of NaCl were added simultaneously with rapid stirring. The silver potential was controlled at 7.35 pAg. The emulsion was then washed to remove excess salts. The cubic emulsion grains had an average edge length of 0.6 μm.

Substrate Emulsion C was prepared as follows: A reaction vessel containing 7.15 liters of a 2.7% by weight gelatin solution and 1.9 g 1,8-dihydroxy-3,6-dithiaoctane was adjusted to 68.3° C. A 4M solution of $AgNO_3$ and a 4M solution of NaCl were added simultaneously with flow rates increasing from 48 ml/min. to 83 ml/min. The silver potential was controlled at 7.2 pAg. The emulsion was then washed to remove excess salts. The cubic emulsion grains had an edge length of 0.78 μm.

Substrate Emulsion D was prepared as follows: A reaction vessel containing 4.67 liters of a 2.7% by weight gelatin solution and 1.4 g 1,8-dihydroxy-3,6-dithiaoctane was adjusted to 68.3° C. A 1.35M solution of $AgNO_3$ and a 1.8M solution of NaCl were added simultaneously with flow rates increasing from 54 ml/min. to 312 ml/min. The silver potential was controlled at 7.2 pAg. The emulsion was then washed to remove excess salts. The cubic emulsion grains had an edge length of 1.0 μm.

Substrate Emulsions E–I were precipitated as described for substrate Emulsion A, except that the appropriate iridium containing dopant for Emulsions 11b–11f in Table 11-I, respectively, was introduced at a total of 0.28 mppm (mole part per million) into the outer 93% to 95% of the grain volume. A shell of pure silver chloride (5% of the grain volume) was then precipitated to cover the doped band.

Example 11

Control Emulsion 11a was prepared as follows: a 0.3 mole sample of substrate Emulsion A was heated to 40° C. and chemically and spectrally sensitized by the addition of a colloidal dispersion of gold sulfide followed by digestion at 65° C., addition of 1-(3-acetamidophenyl)-5-mercaptotetrazole and KBr. The portion was then cooled to 40° C., and red spectral sensitizing dye Dye C was added.

Emulsions 11b–11f were prepared as Emulsion 11a, except that substrate Emulsions E–I were used in place of Emulsion A.

The emulsions were coated on paper support using sizing methods disclosed in U.S. Pat. No. 4,994,147. Specifically, they were coated at 0.18 ram/$m^2$ silver, 0.422 gram/$m^2$ cyan-dye forming coupler C1, and with 0.166 gram/$m^2$ gelatin. A gelatin protective overcoat layer 1.1 grams/$m^2$ was applied along with bis(vinyl:Sulfonylmethyl)ether gelatin hardener.

The coatings were exposed through a step tablet to a 3000° K. light source for various exposure times and processed as recommended in "Using KODAK EKTACOLOR RA Chemicals", Publication No. Z-130, published by Eastman Kodak Co., 1990, the disclosure of which is here incorporated by reference. After processing, the Status A reflection densities of each coating were measured.

Sensitivity (speed) of the coatings is taken as the reciprocal of the relative amount of light in LogE×100 to produce a 1.0 optical density, where E is exposure in lux-seconds.

TABLE 11-I

| Emuls. # | Dopant Complex | Nominal Dopant Level (mppm) | Contrast RF-delta toe dens.[a] (0.5"–128") | Latent Image Keeping Toe Density change[b] |
|---|---|---|---|---|
| 11a | none | 0 | .063 | .004 |
| 11b | CD-3 | 0.28 | .082 | −.036 |
| 11c | MC-54 | 0.28 | .042 | .002 |
| 11d | MC-50 | 0.28 | .056 | 0 |
| 11e | MC-58 | 0.28 | .042 | .002 |
| 11f | MC-53 | 0.28 | .031 | −.010 |

[a]= Delta toe density is the difference in density at a point 0.3 logE fast of the 1.0 optical density speed point for two equivalent exposures, the first of 0.5 sec duration and the second of 128 sec duration. Zero is the ideal difference.

[b]= Latent Image Keeping (LIK) change is the effect of delay time between exposure and processing, taken as the (5' vs. 30") difference in toe density. Zero is the ideal.

The results in Table 11-I demonstrate that emulsions doped with transition metal complexes containing iridium and one or two substituted thiazole or thiazoline ligands have improved reciprocity performance. In particular, relative to an iridium hexachloride doped control emulsion, a remarkable improvement in latent image keeping performance is seen.

Example 12

Emulsion 12 was precipitated as described for substrate Emulsion A, except that MC-54 was introduced at a total level of 50 mppm into 3.5–95% of the grain volume. This emulsion was examined by EPR spectroscopy, in order to demonstrate the incorporation of organic ligands within the silver halide grain structure.

Exposure of Emulsion 12 to above-bandgap light at 140° K. produced a distinctive EPR spectrum. The spectrum could unequivocally be assigned to an iridium (II) ion in the silver halide lattice. The EPR g-values were as follows: $g_1$=2.897±0.001, $g_2$=2.645±0.001, $g_3$=1.843±0.001. These are significantly different from those measured previously for $(IrCl_6)^{4-}$ in a AgCl matrix ($g_1$=$g_2$=2.772±0.001, $g_3$=1.883±0.001) or for $[IrCl_5(H_2O)]^{3-}$ in a AgCl matrix ($g_1$=3.006±0.001, $g_2$=2.702±0.001, $g_3$<2.0). No EPR signals from these possible contaminants were observed from Emulsion 2. It was concluded that the dopant complex $[IrCl^5(5\text{-methylthiazole})]^{2-}$, was incorporated intact into the silver halide grain. On exposure to light, $[IrCl_5(5\text{-methylthiazole}]^{2-}$ trapped an electron to give $[IrCl_5(5\text{methylthiazole})]^{3-}$, which was detected by EPR. Well resolved $^{191}Ir$ and $^{193}Ir$ hyperfine splittings ($A_1$=6.5±0.5 mT, $A_2$=7.5±0.5 mT and $A_3$=7.3±0.5 mT) and superhyperfine splittings at $g_3$ from the magnetic $^{35}Cl$ and $^{37}Cl$ nuclei of one chloride ligand ($A'_3$=3.6±0.1 mT) were observed. This chloride is trans to the 5-methylthiazole ligand. These well resolved hyperfine and super hyperfine splittings imply that $[IrCl_5(5\text{-methylthiazole})]^{3-}$ was well dispersed in the silver chloride grain structure and probably substitutional for $(AgCl_6)^{5-}$.

Example 13

This example illustrates the use of a preformed fine grain silver halide (Lippmann) emulsion as a carrier of the dopant (termed a grain surface modifier), and as a source of the epitaxially deposited silver halide material.

Undoped Lippmann Emulsion L1 was prepared as previously described in Example 8.

Emulsion L5 was prepared exactly as Emulsion L1, except a solution of 0.533 gram of MC-41 in 25 ml water was added at a constant flow rate beginning at 50% and ending at 90% of the precipitation. This triple jet precipitation produced 10 moles of a 0.05 μm grain size emulsion.

Addition of dopant, epitaxially deposited bromide, spectral and chemical sensitization was as follows:

Control Emulsion 13a was prepared as follows: a 50 millimole (mmole) sample of substrate Emulsion B was heated to 40° C. and spectrally sensitized by the addition of 14 milligrams of the blue spectral sensitizing dye Dye D.

This was followed by the addition of 0.45 mmole of Emulsion L1. The temperature was raised to 60° C. to accelerate recrystallization of the Lippmann bromide, primarily onto corner and edges of the grain. To the emulsion were added 0.13 m g of sodium thiosulfate and 9.5 m g of 4-hydroxy-6-methyl-1,3,3a,7-tetraazaindene, and the emulsion was held at 60° C. until optimal chemical sensitization was achieved. Addition of 1-(3-acetamidophenyl)-5-mercaptotetrazole followed to complete the finishing operation.

Emulsion 13a was prepared and sensitized exactly as Emulsion 13a, except that 0.045 mmole of Emulsion L5 and 0.405 mmole of Emulsion L1 were added during the sensitization process instead of 0.45 mmole of Emulsion L1 alone.

Emulsion 13b was prepared and sensitized exactly as Emulsion 13a, except that 0.0675 mmole of Emulsion L5 and 0.3825 mmole of Emulsion L1 were added during the sensitization process instead of 0.45 mmole of Emulsion L1 alone.

In this way, epitaxially deposited sliver chlorobromide regions of Emulsions 13b and 13c were doped with a total of 0.09 mppm and 0.135 mppm of MC-41, respectively.

The emulsions were coated on paper support using sizing methods disclosed in U.S. Pat. No. 4,994,147. Specifically, they were coated at 0.28 gram/m$^2$ silver with 0.002 gram/m$^2$ of 2,4-dihydroxy-4-methyl-1-piperidinocyclopenten-3-one, 0.02 gram/m$^2$ of KCl, 0.78 m g/m$^2$ of potassium p-tolylsulfonate, 7.8 m g/m$^2$ of sodium p-tolylsulfinate, 1.08 grams/m$^2$ yellow dye-forming coupler C2, and with 0.166 gram/m$^2$ gelatin. A gelatin protective overcoat layer 1.1 grams/m$^2$ was applied along with bis(vinylsulfonylmethyl)ether gelatin hardener.

The coatings were exposed through a step tablet to a 3000° K. light source for various exposure times and processed as recommended in "Using KODAK EKTACOLOR RA Chemicals", Publication No. Z-130, cited above. After processing, the Status A reflection densities of each coating were measured.

The photographic parameters obtained for these emulsions are shown in Table 13-I. The results in Table 13-I demonstrate that emulsions with epitaxial regions doped with MC-41 have improved reciprocity and heat sensitivity performance.

TABLE 13-I

| Emuls. # | Dopant Complex/ Lippmann Bromide | Nominal Dopant Level (mppm) | Speed for a 0.5" exp.[a] | Speed HIRF[b] (0.031'–0.5") | Heat Sensitivity ΔSpeed[c] |
|---|---|---|---|---|---|
| 13a | none | 0 | 100 | −24 | 20 |
| 13b | MC-41 | 0.09 | 100 | −22 | 19 |

TABLE 13-I-continued

| Emuls. # | Dopant Complex/ Lippmann Bromide | Nominal Dopant Level (mppm) | Speed for a 0.5" exp.[a] | Speed HIRF[b] (0.031'–0.5") | Heat Sensitivity ΔSpeed[c] |
|---|---|---|---|---|---|
| 13c | MC-41 | 0.135 | 98 | −18 | 17 |

[a]= Speed is taken as the reciprocal of the relative amount of light (LogE × 100) required to obtain an optical density of 1.0.
[b]= Speed HIRF is taken as the speed difference of equivalent exposures (intensity × time) of 0.031 and 0.5 sec duration. Zero is the ideal.
[c]= Heat Sensitivity Delta Speed measures the effect of temperature differences (40 C. versus 20 C.) at the time of exposure, taken as the difference in sensitometry. Zero is the ideal.

Example 14

Control Emulsion 14a was prepared as follows: a 0.3 mole sample of substrate Emulsion C was heated to 40° C. and chemically sensitized by the addition of a colloidal dispersion of gold sulfide followed by digestion at 60° C., and spectrally sensitized by the addition of blue sensitizing dye Dye D.

This was followed by the addition of 1.8 mmoles of KBr. The addition of 1-(3-acetamidophenyl)-5-mercaptotetrazole completed the finishing operation.

Emulsions 14b, 14c and 14d were prepared and sensitized exactly as Emulsion 14a, except that 0.003 micromole of MC-41, MC-29a, MC-31, respectively, were added prior to the addition of KBr during the finishing operation.

The emulsions were coated, exposed, processed and the sensitometry read as described above in Example 13.

The photographic parameters obtained for these emulsions are shown in Table 14-I. The results in Table 14-I demonstrate that emulsions with epitaxial regions doped with coordination complexes containing iridium and either a thiazole or pyrazine ligand have improved reciprocity performance.

TABLE 14-I

| Emuls. # | Dopant Complex/ Solution Addition | Nominal Dopant Level (mppm) | Speed for a 2 sec. exposure[a] | Speed HIRF[b] (0.01"–2.0") |
|---|---|---|---|---|
| 14a | none | 0 | 184 | −14 |
| 14b | MC-41 | 0.01 | 183 | −11 |
| 14c | MC-29a | 0.01 | 147 | −4 |
| 14d | MC-31 | 0.01 | 169 | −12 |

[a]= Speed is taken as the reciprocal of the relative amount of light (LogE × 100) required to obtain an optical density of 1.0.
[b]= Speed HIRF is taken as the speed difference of equivalent exposures (intensity × time) of 0.31 and 2.0 sec duration. Zero is the ideal.

Examples 15–19

Examples 15–19 demonstrate the effectiveness of adding coordination complexes of iridium and at least one organic ligand into epitaxial regions of cubic AgCl emulsions coated in a tricolor multilayer format. These emulsions demonstrate improved reciprocity, heat sensitivity, and latent image keeping.

Example 15

Control Emulsion 15a was prepared as follows: a 10 mole sample of substrate Emulsion B was heated to 40° C., adjusted to a pH of 5.6, and chemically sensitized by the addition of a colloidal dispersion of gold sulfide followed by digestion at 65° C.

Additional finishing compounds were added in the sequence of 4,4'-bis[(4-chloro-6-o-chloroanilino-s-triazine-2-yl-amino]-2,2'-stilbene disulfonic acid sodium salt, red spectral sensitizing dye Dye C, 1-(3-acetamidophenyl)-5-mercaptotetrazole, and 0.06 mole of KBr.

Emulsions 15b, 15c and15d were prepared and sensitized exactly as Emulsion 15a, except that 11.1, 43.5, and 168.0 micromoles of MC-41, respectively, were added prior to the KBr addition during the finishing operation. Doped epitaxial regions were thereby produced.

The emulsions were coated in a conventional tricolor multilayer format along with the blue sensitive and green sensitive emulsions described below.

Blue Emulsion: A high chloride silver halide emulsion was precipitated be equimolar addition of silver nitrate and sodium chloride solutions into a well-stirred reactor containing gelatin peptizer and thioether ripener. The resultant emulsion contained cubic shaped grains of 0.78 μm average edgelength. The emulsion was optimally sensitized by the addition of a colloidal suspension of gold sulfide and heat treated at 60° C., during which time blue spectral sensitizing dye Dye D; 1-(3-acetamidophenyl)-5-mercaptotetrazole and KBr were added.

Green Emulsion: A high chloride silver halide emulsion was precipitated be equimolar addition of silver nitrate and sodium chloride solutions into a well-stirred reactor containing gelatin peptizer and thioether ripener. The resultant emulsion contained cubic shaped grains of 0.30 μm average edgelength. The emulsion was optimally sensitized by the addition of green sensitizing Dye E, a colloidal suspension of gold sulfide, heat digestion followed by the addition of 1-(3-acetamidophenyl)-5-mercaptotetrazole and KBr.

Coupler dispersions were emulsified by methods well known to the art, and the following layers were coated on a polyethylene resin coated paper support, sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl)stilbene and 4,4'-bis(2-benzoxazolyl) stilbene, 12.5% $TiO_2$, and 3% ZnO white pigment. The layers were hardened with bis(vinylsulfonyl-methyl)ether at 1.95% of the total gelatin weight.

| Layer 1: Blue Sensitive Layer | |
|---|---|
| Gelatin | 1.530 g/m$^2$ |
| Blue Sensitive Silver | 0.280 g Ag/m$^2$ |
| Yellow Dye-Forming Coupler C2 | 1.080 g/m$^2$ |
| Dibutyl phthalate | 0.260 g/m$^2$ |
| 2-(2-butoxyethoxy)ethyl acetate | 0.260 g/m$^2$ |
| 2,5-Dihydroxy-5-methyl-3-(1-piperidinyl)-2-cyclopenten-1-one | 0.002 g/m$^2$ |
| Potassium 2,5-dihydroxy-4-(1-methylheptadecyl)phenylsulfonate | 0.009 g/m$^2$ |
| Layer 2: Interlayer | |
| Gelatin | 0.753 g/m$^2$ |
| Dioctyl hydroquinone | 0.094 g/m$^2$ |
| Dibutyl phthalate | 0.282 g/m$^2$ |
| Disodium 4,5 Dihydroxy-m-benzenedisulfonate | 0.065 g/m$^2$ |
| Sodium isopropylnaphthylsulfonate (Alkanol XC ™) | 0.002 g/m$^2$ |
| Layer 3: Green Sensitive Layer | |
| Gelatin | 1.270 g/m$^2$ |
| Green Sensitive Silver | 0.263 g Ag/m$^2$ |

-continued

| | |
|---|---|
| Magenta Dye-Forming Coupler C5 | 0.389 g/m$^2$ |
| Dibutyl phthalate | 0.195 g/m$^2$ |
| 2-(2-butoxyethoxy)ethyl acetate | 0.058 g/m$^2$ |
| 2,3-Dihydro-2,2-dimethyl-7-n-heptadecyl-6-hydroxypyran | 0.166 g/m$^2$ |
| Dioctylhydroquinone | 0.039 g/m$^2$ |
| Phenylmercaptotetrazole | 0.001 g/m$^2$ |
| Layer 4: UV Interlayer | |
| Gelatin | 0.630 g/m$^2$ |
| 2-[3,5-di(1,1-dimethylpropyl)-2-hydroxyphenyl]-benzotriazole | 0.049 g/m$^2$ |
| 5-Chloro-2-(3-tert-butyl-2-hydroxy-5-methylphenyl)benzotriazole | 0.279 g/m$^2$ |
| Dioctyl hydroquinone | 0.080 g/m$^2$ |
| 1,4-Cyclohexylenedimethylene bis(2-ethylhexanoate) | 0.109 g/m$^2$ |
| Dibutyl phthalate | 0.129 g/m$^2$ |
| Layer 5: Red Sensitive Layer | |
| Gelatin | 1.087 g/m$^2$ |
| Red Sensitive Silver | 0.218 g Ag/m$^2$ |
| Cyan Dye-Forming Coupler C1 | 0.423 g/m$^2$ |
| Dibutyl phthalate | 0.232 g/m$^2$ |
| 2-(2-butoxyethoxy)ethyl acetate | 0.035 g/m$^2$ |
| Dioctyl hydroquinone | 0.004 g/m$^2$ |
| Layer 6: UV Overcoat | |
| Gelatin | 0.630 g/m$^2$ |
| 2-[3,5-di(1,1-dimethylpropyl)-2-hydroxyphenyl]-benzotriazole | 0.049 g/m$^2$ |
| 5-Chloro-2-(3-tert-butyl-2-hydroxy-5-methylphenyl)benzotriazole | 0.279 g/m$^2$ |
| Dioctyl hydroquinone | 0.080 g/m$^2$ |
| 1,4-Cyclohexylenedimethylene bis(2-ethylhexanoate) | 0.109 g/m$^2$ |
| Dibutyl phthalate | 0.129 g/m$^2$ |
| Layer 7: Surface Overcoat | |
| Gelatin | 1.076 g/m$^2$ |
| Poly(dimethylsiloxane) | 0.027 g/m$^2$ |
| SF-1 Alkanol XC ™ | 0.009 g/m$^2$ |
| SF-2 Sodium perfluorooctylsulfonate | 0.004 g/m$^2$ |
| Poly(oxyethylene)tridecanol (Tergitol 15-S-5 ™) | 0.003 g/m$^2$ |
| Tartrazine Yellow | 0.018 g/m$^2$ |
| Bis[3-carboxy-1-(4-sulfophenyl)pyrazolin-5-one-(4)]trimethine oxonol, pentasodium salt | 0.009 g/m$^2$ |
| Bis[3-acetyl-1-(2,5-disulfophenyl)-2-pyrazolin-5-one-(4)]pentamethine oxonol, pentasodium salt | 0.007 |

Coupler C5

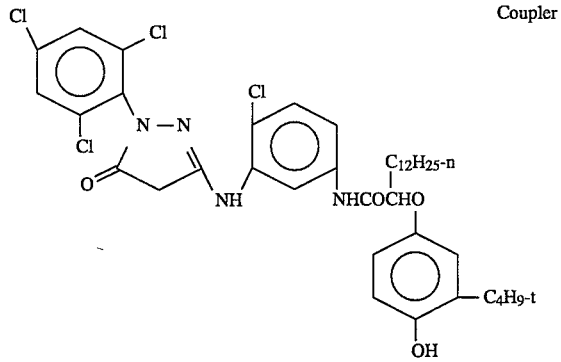

The multilayer coating described above was evaluated by exposure to a 3000° K. color temperature light source through a neutral density step tablet having an exposure range of 0 to 3 logE, and processing as recommended in "Using KODAK EKTACOLOR RA Chemicals", Publication No. Z-130, cited above. The Status A reflection densities of each coating were measured, and the sensitometric response of the red sensitive layer containing the doped epitaxial emulsions of the invention are shown in Table 15-I.

TABLE 15-I

| Emuls. # | Dopant Complex | Nominal Dopant Level (mppm) | Speed for a 0.5" exp.[a] | Speed LIRF (0.5"–128")[b] | Speed HIRF (0.031"–0.5")[c] | Contrast RF-Delta Toe density (0.5"–128")[d] |
|---|---|---|---|---|---|---|
| 15a | none | 0 | 235 | −21.4 | −8.0 | .066 |
| 15b | MC-41 | 1.11 | 220 | −19.3 | −8.0 | .063 |
| 15c | MC-41 | 4.35 | 207 | −11.9 | −6.3 | .036 |
| 15d | MC-41 | 16.8 | 118 | −3.8 | −5.9 | −.001 |

[a]= Speed is taken as the reciprocal of the relative amount of light (LogE × 100) required to obtain an optical density of 1.0.
[b]= Speed LIRF is taken as the speed difference of equivalent exposures (intensity × time) of 0.5 and 128 sec duration. Zero is the ideal.
[c]= Speed HIRF is taken as the speed difference of equivalent exposures (intensity × time) of 0.031 and 0.5 sec duration. Zero is the ideal.
[d]= Delta toe density is the difference in density at a point 0.3 logE fast of the 1.0 optical density speed point for two equivalent exposures, the first of 0.5 sec duration and the second of 128 sec duration. Zero is the ideal difference.

The results in Table 15-I demonstrate that emulsions containing epitaxial regions doped at a range of amounts of a coordination complex containing iridium and a thiazole ligand have improved speed reciprocity and contrast reciprocity performance when coated in a tricolor multilayer format.

Example 16

Example 15 was repeated, except that the Layer 3, the green sensitive layer, was replaced with alternate green sensitive layer I.

| Alternate Green Sensitive Layer I | |
|---|---|
| Gelatin | 1.230 g/m$^2$ |
| Green Sensitive Silver | 0.160 g Ag/m$^2$ |
| Magenta Dye-Forming Coupler C6 | 0.260 g/m$^2$ |
| Tris(2-ethylhexyl)phosphate | 0.520 g/m$^2$ |
| 2-Butoxy-1-(N,N-dibutylamino)-5-(1,1,3,3-tetramethylbutyl)benzene | 0.360 g/m$^2$ |
| ST-4 2,5-Dioctylhydroquinone | 0.060 g/m$^2$ |

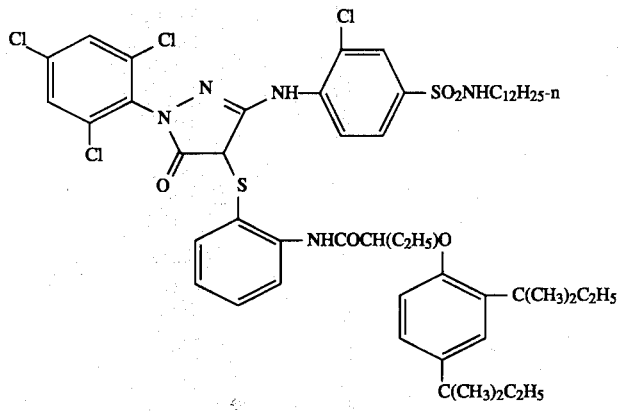

Coupler C6

The performance observed was similar to that of Example 15.

Example 17

Example 15 was repeated, except that the Layer 3, the green sensitive layer, was replaced with alternate green sensitive layer II.

| Alternate Green Sensitive Layer II | |
|---|---|
| Gelatin | 1.230 g/m$^2$ |
| Green Sensitive Silver | 0.150 g Ag/m$^2$ |
| Magenta Dye-Forming Coupler C7 | 0.215 g/m$^2$ |
| Dibutyl phthalate | 0.097 g/m$^2$ |
| Di(8-methylnononyl)phthalate | 0.086 g/m$^2$ |
| 1,1-Bis(5-tert-butyl-4-hydroxy-2-methylphenyl)butane | 0.161 g/m$^2$ |
| Compound C8 | 0.140 g/m$^2$ |

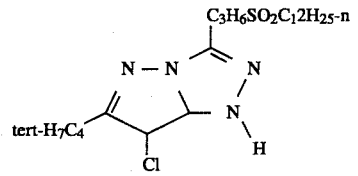

Coupler C7

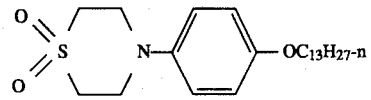

Compound C8

The performance observed was similar to that of Example 15.

Example 18

Example 15 was repeated, except that the Layer 3, the green sensitive layer, was replaced with alternate green sensitive layer III.

| Alternate Green Sensitive Layer III | |
|---|---|
| Gelatin | 1.230 g/m$^2$ |
| Green Sensitive Silver | 0.108 g Ag/m$^2$ |

-continued

| Alternate Green Sensitive Layer III | |
|---|---|
| Magenta Dye-Forming Coupler C9 | 0.140 g/m$^2$ |
| Tritolyl phosphate | 1.119 g/m$^2$ |
| 1,1'-Bis(3,3-dimethyl-5,5',6,6'-tetra-propoxyindane) | 0.129 g/m$^2$ |
| 2-Methyl-1,1-bis(2-hydroxy-3,5-dimethyl-phenyl)propane | 0.054 g/m$^2$ |
| 2,6-Dichloro-4-ethoxycarbonylphenyl hexadecanoate | 0.097 g/m$^2$ |
| Sodium 3,5-bis{3-[2,4-bis(1,1-dimethyl-propyl)phenoxy]propylcarbamoyl}-phenylsulfinate | 0.011 g/m$^2$ |

Coupler C9

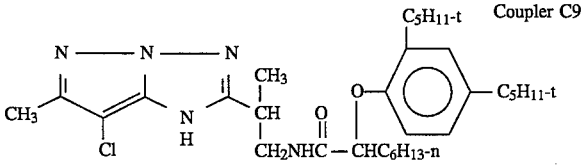

The performance observed was similar to that of Example 15.

Example 19

Example 15 was repeated, except that the Layer 3, the blue sensitive layer, was replaced with alternate blue sensitive layer I.

| Alternate Blue Sensitive Layer I | |
|---|---|
| Gelatin | 1.042 g/m$^2$ |
| Blue Sensitive Silver | 0.243 g Ag/m$^2$ |
| Yellow Dye-Forming Coupler C10 | 0.539 g/m$^2$ |
| Bis(3-tert-butyl-2-hydroxy-5-methyl-phenyl)methane hemiacetate | 0.237 g/m$^2$ |
| Sodium 2,5-dihydroxy-4-isooctadecyl-phenylsulfonate | 0.009 g/m$^2$ |
| Dibutyl phthalate | 0.301 g/m$^2$ |
| Glycerol | 0.162 g/m$^2$ |

Coupler C10

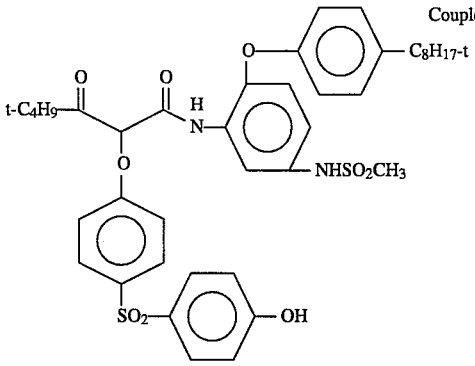

The performance observed was similar to that of Example 15.

Example 20

Example 15 was repeated, except that the Layer 3, the blue sensitive layer, was replaced with alternate blue sensitive layer II.

| Alternate Blue Sensitive Layer II | |
|---|---|
| Gelatin | 1.042 g/m$^2$ |
| Blue Sensitive Silver | 0.243 g Ag/m$^2$ |
| Yellow Dye-Forming Coupler C11 | 0.645 g/m$^2$ |
| Poly (N-tert-butylacrylamide) | 0.538 g/m$^2$ |
| Dibutyl phthalate | 0.269 g/m$^2$ |

Coupler C11

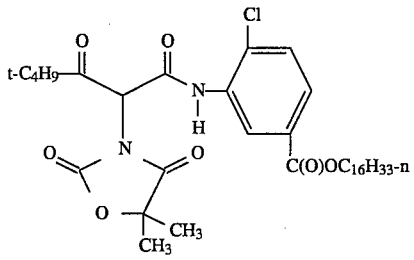

The performance observed was similar to that of Example 15.

Example 21

Control Emulsion 21a was prepared as follows: a 10 mole sample of substrate Emulsion A was heated to 40° C., adjusted to a pH of 4.3, and chemically sensitized by the addition of a colloidal dispersion of gold sulfide followed by digestion at 65° C.

Additional finishing compounds were added in the sequence of 1-(3-acetamidophenyl)-5-mercaptotetrazole, 0.12 mole of KBr, and red spectral sensitizing dye Dye C.

Control Emulsions 21b, 21c and 21d were prepared and sensitized exactly as Emulsion 21a, except that 3.7, 11.1, and 22.2 micromoles of $K_2IrCl_6$ (CD-3), respectively; were added prior to the KBr addition during the finishing operation. Doped epitaxial regions were thereby produced.

Emulsions 21e, 21f and 21g were prepared and sensitized exactly as Emulsion 21a, except that 3.7, 11.1, and 22.2 micromoles of $K_2IrCl_5$(thiazole) (MC-41), respectively; were added prior to the KBr addition during the finishing operation. Doped epitaxial regions were thereby produced.

The emulsions were coated and evaluated in a conventional tricolor multilayer format, along with blue sensitive and green sensitive emulsions, as described above in Example 15. The sensitometric response of the red sensitive layers containing the doped epitaxial emulsions of the invention are shown in Table 21-I.

TABLE 21-I

| Emuls. # | Dopant Com-plex | Nominal Dopant Level (mppm) | Speed for a 0.5" exp.[a] | Speed LIRF (0.5"–512")[b] | Latent Image Keeping[c] Speed | Latent Image Keeping[c] Toe |
|---|---|---|---|---|---|---|
| 21a | none | 0 | 130 | −7.5 | 2.8 | .01 |
| 21b | CD-3 | 0.37 | 130 | 1.6 | 4.1 | .02 |
| 21c | CD-3 | 1.12 | 119 | 11.0 | 4.3 | −.017 |
| 21d | Cd-3 | 2.24 | 109 | 13.3 | −8.4 | −.099 |

TABLE 21-I-continued

| Emuls. # | Dopant Com-plex | Nominal Dopant Level (mppm) | Speed for a 0.5" exp.[a] | Speed LIRF (0.5"–512")[b] | Latent Image Keeping[c] Speed | Toe |
|---|---|---|---|---|---|---|
| 21e | MC-41 | 0.37 | 131 | –0.1 | 2 | .006 |
| 21f | MC-41 | 1.12 | 132 | –0.2 | 1.7 | .008 |
| 21g | MC-41 | 2.24 | 125 | 8.2 | 2.1 | .007 |

[a]= Speed is taken as the reciprocal of the relative amount of light (LogE × 100) required to obtain an optical density of 1.0.
[b]= Speed LIRF is taken as the speed difference of equivalent exposures (intensity × time) of 0.5 and 128 sec duration. Zero is the ideal.
[c]= Latent Image Keeping (LIK) change is the effect of delay time between exposure and processing, taken as the (5' vs. 30") difference in sensitometry. Zero is the ideal.

The results in Table 21-I demonstrate that emulsions containing epitaxial regions doped at a range of amounts of a coordination complex containing iridium and a thiazole ligand have improved reciprocity, speed LIK and contrast LIK performance relative to an undoped control or a similar $K_2IrCl_6$ doped control.

Example 22

Control Emulsion 22a was prepared as follows: a 10 mole sample of substrate Emulsion A was heated to 40° C., adjusted to a pH of 4.9 and a pAg of 8.05, and spectrally and chemically sensitized by the addition of spectral sensitizing dye Dye E, a colloidal dispersion of gold sulfide, followed by digestion at 65° C.

Additional finishing compounds were added in the sequence of 1-(3-acetamidophenyl)-5-mercaptotetrazole, 4,4'-bis[(4,6-bis-p-chloroanilino-s-triazine-2-yl)amino]-2, 2'-stilbene disulfonic acid sodium salt, 0.16 mole of KBr, and red spectral sensitizing Dye C.

Control Emulsions 22b, 22c and 22d were prepared and sensitized exactly as Emulsion 22a, except that 3.7, 11.2, and 22.4 micromoles of $K_2IrCl_6$ (CD-3), respectively; were added prior to the KBr addition during the finishing operation. Doped epitaxial regions were thereby produced.

Emulsions 22e, 22f and 22g were prepared and sensitized exactly as Emulsion 22a, except that 3.7, 11.2, and 22.4 micromoles of $K_2IrCl_5$(thiazole) (MC-41), respectively; were added prior to the KBr addition during the finishing operation. Doped epitaxial regions were thereby produced.

The emulsions were coated and evaluated in a conventional tricolor multilayer format, along with blue sensitive and green sensitive emulsions, as described above in Example 15. The sensitometric response of the red sensitive layers containing the doped epitaxial emulsions of the invention are shown in Table 22-I

TABLE 22-I

| Emuls. # | Dopant Com-plex | Nominal Dopant Level (mppm) | Speed for a 0.5" exp.[a] | Speed LIRF (0.5"–512")[b] | Latent Image Keeping[c] Speed | Toe |
|---|---|---|---|---|---|---|
| 22a | none | 0 | 133 | –16.2 | 1.3 | .012 |
| 22b | CD-3 | 0.37 | 131 | –2.0 | 2.5 | .01 |
| 22c | CD-3 | 1.12 | 124 | 9.3 | 1.0 | –.012 |
| 22d | CD-3 | 2.24 | 130 | 13.7 | –7.1 | –.08 |
| 22e | MC-41 | 0.37 | 130 | –7.2 | 1.2 | .009 |
| 22f | MC-41 | 1.12 | 132 | –8.6 | 1.6 | .006 |
| 22g | MC-41 | 2.24 | 130 | 0.7 | 1.4 | .01 |

TABLE 22-I-continued

| Emuls. # | Dopant Com-plex | Nominal Dopant Level (mppm) | Speed for a 0.5" exp.[a] | Speed LIRF (0.5"–512")[b] | Latent Image Keeping[c] Speed | Toe |
|---|---|---|---|---|---|---|

[a]= Speed is based on the light exposure (0.5") required to obtain an optical density of 1.0.
[b]= Speed LIRF is taken as the speed difference of equivalent exposures (intensity × time) of 0.5 and 512 sec duration. Zero is the ideal.
[c]= Latent Image Keeping (LIK) change is the effect of delay time between exposure and processing, taken as the (5' vs. 30") difference in sensitometry. Zero is the ideal.

The results in Table 21-I demonstrate that emulsions containing epitaxial regions doped at a range of amounts of a coordination complex containing iridium and a thiazole ligand have improved reciprocity and contrast LIK performance relative to an undoped control. Relative to a $K_2IrCl_6$ doped control, the emulsions of the invention have improved reciprocity, speed LIK and contrast LIK performance.

Example 23

Control Emulsion 23a was prepared as follows: a 10 mole sample of substrate Emulsion B was heated to 40° C., adjusted to a pH of 4.5, and chemically sensitized by the addition of a colloidal dispersion of gold sulfide, followed by digestion at 60° C.

Additional finishing compounds were added in the sequence of blue spectral sensitizing dye Dye D; 1-(3-acetamidophenyl)-5-mercaptotetrazole, and 0.06 mole of KBr.

Control Emulsions 23b and 23c were prepared and sensitized exactly as Emulsion 23a, except that 0.8 and 9.2 micromoles of $K_2IrCl_6$ (CD-3), respectively; were added prior to the KBr addition during the finishing operation. Doped epitaxial regions were thereby produced.

Emulsions 23d and 23e were prepared and sensitized exactly as Emulsion 23a, except that 0.8 and 9.2 micromoles of $K_2IrCl_5$(thiazole) (MC-41), respectively; were added prior to the KBr addition during the finishing operation. Doped epitaxial regions were thereby produced.

The emulsions were coated in the conventional tricolor multilayer format described above in Example 15, except that the blue sensitive emulsions of this example were used along with the red sensitive emulsion described below.

Red Emulsion: A high chloride silver halide emulsion was precipitated be equimolar addition of silver nitrate and sodium chloride solutions into a well-stirred reactor containing gelatin peptizer and thioether ripener. The resultant emulsion contained cubic shaped grains of 0.38 mm average edgelength. The emulsion was optimally sensitized by the addition of a colloidal suspension of aurous sulfide, heat digestion followed by the addition of 1-(3-acetamidophenyl)-5-mercaptotetrazole, potassium bromide, KBr, and the red spectral sensitizing dye anhydro-3-ethyl-9,11-neopentalene-3'-(3-sulfopropyl)thiadicarbocyanine hydroxide (Dye I).

The coatings were evaluated as described in Example 15 above. The sensitometric response of the blue sensitive layers containing the doped epitaxial emulsions of the invention are shown in Table 23-I.

TABLE 23-I

| EMUL. # | Dopant Complex | Nominal Dopant Level (mppm) | Speed for a 0.5" exp.[a] | Speed LIRF (0.5"–512")[b] | Heat Sensitivity Speed[c] |
|---|---|---|---|---|---|
| 23a | none | 0 | 140 | −28 | −3.1 |
| 23b | CD-3 | 0.08 | 137 | −24 | −2.8 |
| 23c | CD-3 | 0.92 | 103 | −5 | 3.5 |
| 23e | MC-41 | 0.08 | 134 | −20 | −0.8 |
| 23f | MC-41 | 0.92 | 110 | 1 | −0.6 |

[a]= Speed is taken as the reciprocal of the relative amount of light (LogE × 100) required to obtain an optical density of 1.0.
[b]= Speed LIRF is taken as the speed difference of equivalent exposures (intensity × time) of 0.5 and 512 sec duration. Zero is the ideal.
[c]= Heat sensitivity delta speed measures the effect of temperature differences (40° C. vs. 20° C.) at the time of exposure (128 sec), taken as the difference in sensitometry.

The results in Table 23-1 demonstrate that emulsions containing epitaxial regions doped at a range of amounts of a coordination complex containing iridium and a thiazole ligand have improved reciprocity and heat sensitivity performance relative to an undoped control or a $K_2IrCl_6$ doped control.

Example 24

Control Emulsion 24a was prepared as follows: a 10 mole sample of substrate Emulsion D was heated to 40° C., adjusted to a pH of 5.6, chemically sensitized by the addition of a colloidal dispersion of gold sulfide, followed by digestion at 60° C.

Additional finishing compounds were added in the sequence of blue spectral sensitizing dye Dye D; 1-(3-acetamidophenyl)-5-mercaptotetrazole, and 0.1 mole of (Lippmann bromide) Emulsion L1.

Control Emulsions 24b, 24c and 24d were prepared and sensitized exactly as Emulsion 24a, except that 0.8, 4.6 and 9.2 micromoles of $K_2IrCl_6$ (CD-3), respectively; were added prior to the Lippmann bromide addition during the finishing operation. Doped epitaxial regions were thereby produced.

Emulsions 24e, 24f and 24g were prepared and sensitized exactly as Emulsion 24a, except that 0.8, 4.6 and 9.2 micromoles of $K_2IrCl_5$(thiazole) (MC-41), respectively; were added prior to the Lippmann bromide addition during the finishing operation. Doped epitaxial regions were thereby produced.

The emulsions were coated and evaluated in the conventional tricolor multilayer format described above in Example 23. The sensitometric response of the blue sensitive layers containing the doped epitaxial emulsions of the invention are shown in Table 24-I.

TABLE 24-I

| Emuls. # | Dopant Complex | Nominal Dopant Level (mppm) | Speed for a 0.5" exp.[a] | Speed LIRF (0.5"–512")[b] | Latent Image Keeping[c] Speed | Latent Image Keeping[c] Toe |
|---|---|---|---|---|---|---|
| 24a | none | 0 | 146 | 14.5 | 4.5 | .03 |
| 24b | CD-3 | 0.08 | 150 | −2.8 | 6.3 | .05 |
| 24c | CD-3 | 0.46 | 145 | −2.0 | 26.9 | .25 |
| 24d | CD-3 | 0.92 | 146 | −2.2 | 49.2 | .39 |
| 24e | MC-41 | 0.08 | 147 | −1.0 | 4.8 | .04 |
| 24f | MC-41 | 0.46 | 146 | −1.2 | 4.8 | .04 |
| 24g | MC-41 | 0.92 | 147 | 2.2 | 4.5 | .04 |

[a] = Speed is taken as the reciprocal of the relative amount of light (LogE × 100) required to obtain an optical density of 1.0.
[b] = Speed LIRF is taken as the speed difference of equivalent exposures (intensity × time) of 0.5 and 512 sec duration. Zero is the ideal.
[c] = Latent Image Keeping (LIK) change is the effect of delay time between exposure and processing, taken as the (5'vs. 30") difference in sensitometry. Zero is the ideal.

The results in Table 24-I demonstrate that emulsions containing epitaxial regions doped at a range of amounts of a coordination complex containing iridium and a thiazole ligand have improved speed and reciprocity performance relative to an undoped control. Relative to a $K_2IrCl_6$ doped control, the emulsions of the invention have improved reciprocity, speed LIK and contrast LIK performance.

Example 25

Control Emulsion 25a was prepared as follows: a 0.3 mole sample of substrate Emulsion C was heated to 40° C. and chemically sensitized by the addition of a colloidal dispersion of gold sulfide followed by digestion at 60° C., and spectrally sensitized by the addition of blue spectral sensitizing dye Dye D.

This was followed by the addition of 1-(3-acetamidophenyl)-5-mercaptotetrazole. The addition of 1.8 mmoles of KBr completed the finishing operation.

Emulsions 25b-h were prepared and sensitized exactly as Emulsion 25a, except that 0.126 micromole of the dopant complex listed in Table 25-I for these emulsions were added prior to the addition of KBr during the finishing operation.

The emulsions were coated, exposed, processed and the sensitometry read as described above in Example 13.

The photographic parameters obtained for these emulsions are shown in Table 25-I. The results in Table 25-I demonstrate that emulsions with epitaxial regions doped with coordination complexes containing iridium and either a thiazole derivative or pyrazine derivative ligand have improved reciprocity performance.

TABLE 25-I

| Emuls. # | Dopant Complex/ Solution addition | Nominal Dopant Level (mppm) | Contrast HIRF-delta toe dens.[a] (.02–2") | Contrast LIRF-delta toe dens.[b] (2–100") | Speed HIRF[c] (.02–2") |
|---|---|---|---|---|---|
| 25a | none | 0 | 0.062 | 0.078 | −7 |
| 25b | MC-54 | 0.42 | 0.051 | 0.012 | −5 |
| 25c | MC-52 | 0.42 | 0.056 | 0.059 | −4 |
| 25d | MC-57 | 0.42 | 0.049 | 0.069 | −1 |
| 25e | MC-60 | 0.42 | 0.004 | 0.008 | −1 |
| 25f | MC-65 | 0.42 | 0.057 | 0.055 | −3 |
| 25g | MC-62 | 0.42 | 0.006 | 0.008 | 0 |
| 25h | MC-56 | 0.42 | 0.053 | 0.054 | −4 |

[a] = Delta toe density is the difference in density at a point 0.3 log E fast of the 1.0 optical density speed point for two equivalent exposures, the first of 0.02 sec duration and the second of 2 sec duration. Zero is the ideal difference.
[b] = Delta toe density is the difference in density at a point 0.3 log E fast of the 1.0 optical density speed point for two equivalent exposures, the first of 2 sec duration and the second of 100 sec duration. Zero is the ideal difference.
[c] = Speed HIRF is taken as the speed difference of equivalent exposures (intensity × time) of 0.02 and 2 sec duration. Zero is the ideal.

Example 26

Control Emulsion 26a was prepared as follows: a 0.3 mole sample of substrate Emulsion C was heated to 40° C. and chemically sensitized by the addition of a colloidal dispersion of gold sulfide followed by digestion at 60° C., and spectrally sensitized by the addition of blue spectral sensitizing dye Dye D.

This was followed by the addition of 1-(3-acetamidophenyl)-5-mercaptotetrazole. The addition of 1.8 mmoles of KBr completed the finishing operation.

Emulsions 26b-d were prepared and sensitized exactly as Emulsion 26a, except that 0.126 micromole of the dopant complex listed in Table 26-I for these emulsions were added prior to the addition of KBr during the finishing operation.

The emulsions were coated, exposed, processed and the sensitometry read as described above in Example 13.

The photographic parameters obtained for these emulsions are shown in Table 26-I. The results in Table 26-I demonstrate that emulsions with epitaxial regions doped with coordination complexes containing iridium and either a thiazole derivative or pyrazine derivative ligand have improved reciprocity performance.

TABLE 26-I

| Emuls. # | Dopant Complex/ Solution Addition | Nominal Dopant Level (mppm) | Contrast HIRF-delta toe density[a] (0.01"–2.0") |
|---|---|---|---|
| 26a | none | 0 | 0.078 |
| 26b | MC-53 | 0.42 | 0.053 |
| 26c | MC-63 | 0.42 | 0.064 |
| 26d | MC-51 | 0.42 | −0.043 |

[a] = Delta toe density is the difference in density at a point 0.3 log E fast of the 1.0 optical density speed point for two equivalent exposures, the first of 2 sec duration and the second of 100 sec duration. Zero is the ideal difference.

Example 27

Control Emulsion 27a was prepared as follows: a 0.3 mole sample of substrate Emulsion C was heated to 40° C. and chemically sensitized by the addition of a colloidal dispersion of gold sulfide followed by digestion at 60° C., and spectrally sensitized by the addition of blue spectral sensitizing dye Dye D.

This was followed by the addition of 1-(3-acetamidophenyl)-5-mercaptotetrazole. The addition of 1.8 moles of KBr completed the finishing operation.

Emulsions 27b and 27c were prepared and sensitized exactly as Emulsion 27a, except that 0.126 micromole of the dopant complex listed in Table 27-I for these emulsions were added prior to the addition of KBr during the finishing operation.

The emulsions were coated, exposed, processed and the sensitometry read as described above in Example 13.

The photographic parameters obtained for these emulsions are shown in Table 27-I. The results in Table 26-I demonstrate the effectiveness of coordination complexes containing iridium and a pyrazine derivative ligand to increase contrast when doped into the epitaxial regions of the emulsion.

TABLE 27-I

| Emuls. # | Dopant Complex/ Solution Addition | Nominal Dopant Level (mppm) | Contrast @ Density = 1.0[a] |
|---|---|---|---|
| 27a | none | 0 | 2.80 |
| 27b | MC-66 | 0.42 | 4.67 |
| 27c | MC-59 | 0.42 | 4.38 |

[a] = Contrast is defined as the instantaneous slope at the 1.0 optical density point.

Example 28

Control Emulsion 28a was prepared as follows: a 0.3 mole sample of substrate Emulsion C was heated to 40° C. and chemically sensitized by the addition of a colloidal dispersion of gold sulfide followed by digestion at 60° C., and spectrally sensitized by the addition of blue spectral sensitizing dye Dye D.

This was followed by the addition of 1-(3'-acetamidophenyl)-5-mercaptotetrazole. The addition of 1.8 moles of KBr completed the finishing operation.

Emulsions 28b was prepared and sensitized exactly as Emulsion 28a, except that the dopant complex listed in Table 28-I for these emulsions were added prior to the addition of KBr during the finishing operation.

The emulsions were coated, exposed, processed and the sensitometry read as described above in Example 13.

The photographic parameters obtained for these emulsions are shown in Table 28-I. The results in Table 28-I demonstrate the effectiveness of coordination complexes containing iridium and either a pyrazine derivative ligand to decrease contrast when doped into the epitaxial regions of the emulsion.

TABLE 28-I

| Emuls. # | Dopant Complex/-Solution Addition | Nominal Dopant Level (mppm) | Contrast @ Density = 1.0[a] |
|---|---|---|---|
| 28a | none | 0 | 2.80 |
| 28b | MC-61 | 0.42 | 2.53 |
| 28c | MC-14j | 10.0 | 2.58 |

[a] = Contrast is defined as the instantaneous slope at the 1.0 optical density point.

Example 29

Control Emulsion 29a was prepared as follows: a 0.3 mole sample of substrate Emulsion C was heated to 40° C. and chemically sensitized by the addition of bis (1,4,5-triethyl-1,2,4-triazolium-3-thiolate) gold(I) tetrafluroborate followed by digestion at 60° C., and spectrally sensitized by the addition of blue dye Dye D.

This was followed by the addition of sodium thiosulfate, 1-(3-acetamidophenyl)-5-mercaptotetrazole, and sodium bromide to completed the finishing operation.

Emulsions 29b and 29c prepared and sensitized exactly as Emulsion 29a, except that 0.31 micromoles of $K_2IrCl_6$ (CD-3) and $K_2IrCl_5$(thiazole) (MC-41), respectively; were added prior to the addition of the dye during the finishing operation. Doped epitaxial regions were thereby produced.

The emulsions were coated, exposed, processed and the sensitometry read as described above in Example 3. The photographic parameters obtained for these emulsions are shown in Table 29-I.

TABLE 29-I

| Emuls. # | Dopant Complex/ Solution Addition | Nominal Dopant Level (mppm) | Speed for a 1 sec. exposure | Speed HIRF[b] (0.0001"–1.0") |
|---|---|---|---|---|
| 29a | none | 0 | 156 | −20 |
| 29b | CD-3 | 0.31 | 154 | −5 |
| 29c | MC-41 | 0.31 | 164 | −3 |

[a] = Speed is taken as the reciprocal of the relative amount of light (LogE × 100) required to obtain an optical density of 1.0.
[b] = Speed HIRF is taken as the speed difference of equivalent exposures (intensity × time) of 0.0001 sec and 1.0 sec duration. Zero is the ideal.

The results in Table 29-I demonstrate the effectiveness of a coordination complex containing iridium and a thiazole ligand doped into the epitaxial region of the emulsion to increase speed and improve reciprocity relative to either an undoped control emulsion or an $K_2IrCl_6$ doped control emulsion.

The invention has been described in detail with particular reference to preferred embodiments thereof, but it will be understood that variations and modifications can be effected within the spirit and scope of the invention.

What is claimed is:

1. A photographic silver halide emulsion comprised of radiation sensitive composite silver halide grains including host grain portions accounting for at least 50 percent of total silver and surface portions epitaxially deposited on the host grain portions wherein the epitaxially deposited surface portions on the host grain portions exhibit a face centered cubic crystal lattice structure containing a hexacoordination complex of a metal from periods 4, 5 and 6 of groups 3 to 14 inclusive of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands.

2. A photographic silver halide emulsion according to claim 1 wherein the host grain portions accounts for at least 90 percent of the total silver forming the grains.

3. A photographic silver halide emulsion according to claim 2 wherein the epitaxially deposited surface portions are nonuniformly distributed on the host grain portions.

4. A photographic silver halide emulsion according to claim 3 wherein the epitaxially deposited surface portions are located principally adjacent at least one of edges and corners of the host grain portions.

5. A photographic silver halide emulsion according to claim 1 wherein the composite silver halide grains contain at least 90 mole percent chloride, from 0 to 10 mole percent bromide and from 0 to 2 mole percent iodide, with the epitaxially deposited surface portions containing a higher concentration of halides other than chloride than the host grain portions.

6. A photographic silver halide emulsion according to claim 5 wherein the host grain portions consist essentially of silver chloride.

7. A photographic silver halide emulsion according to claim 5 wherein the epitaxially deposited surface portions contain at least 0.5 mole percent bromide.

8. A photographic silver halide emulsion according to claim 1 wherein the organic ligands contain up to 24 nonmetal atoms.

9. A photographic silver halide emulsion according to claim 8 wherein the organic ligands contain up to 18 nonmetal atoms.

10. A photographic silver halide emulsion according to claim 1 wherein the organic ligands are selected from among aliphatic and aromatic hydrocarbons, amines, phosphines, amides, imides, nitriles, aldehydes, ethers, ketones, organic acids, sulfoxides, and aliphatic and aromatic heterocycles including one or a combination of chalcogen and pnictide hetero ring atoms.

11. A photographic silver halide emulsion according to claim 1 wherein the metal ion dopant is chosen from among Group VIII metal dopants.

12. A photographic silver halide emulsion according to claim 1 wherein the organic ligand is comprised of a 5 or 6 membered heterocyclic ring.

13. A photographic silver halide emulsion according to claim 12 wherein the heterocylic ring contains at least one sulfur heterocyclic ring atom.

14. A photographic silver halide emulsion according to claim 12 wherein the heterocyclic ring contains from 1 to 3 nitrogen heterocyclic ring atoms.

15. A photographic silver halide emulsion according to claim 5 wherein the hexacoordination complex is an anionic complex satisfying the formula $$[MX_xY_yL_z] \quad (I)$$

or $[MZ_5L'Z'_5M']$ (II)

where

M and M' are independently selected group 8 or 9 metals;

X is Cl, Br or CN;

x is 3 or 5;

Y is $H_2O$;

y is 0 or 1;

L is an organic ligand containing at least one carbon-to-carbon bond, at least one carbon-to-hydrogen bond or at least one carbon-to-nitrogen-to-hydrogen bond sequence;

L' is an organic bridging ligand containing at least one carbon-to-carbon bond, at least one carbon-to-hydrogen bond or at least one carbon-to-nitrogen-to-hydrogen bond sequence;

z is 1 or 2; and

Z and Z' are independently selected from among X, Y and L, with the proviso that in at least three occurrences of each of Z and Z' they are X and in zero or 1 occurrence of each of Z and Z' they are $H_2O$.

16. A photographic emulsion according to claim 15 wherein L is a thiazole, thiazoline or pyrazine.

17. A photographic emulsion according to claim 15 wherein L' is a pyrazine, 4,4'-bipyridine, 3,8-phenanthroline, 2,7-diazapyrene or 1,4-[bis(4-pyridyl)]butadiyne.

18. A photographic silver halide emulsion according to claim 15 wherein the metal forming the coordination complex is present in a concentration ranging from $10^{-9}$ to $10^{-3}$ gram-atom per silver mole, based on total silver.

19. A photographic emulsion according to claim 15 wherein M in formula (I) and at least one of M and M' in formula (II) is iridium and iridium is present in a concentration of $10^{-9}$ to $10^{-5}$ gram atom per silver mole.

20. A photographic emulsion according to claim 15 wherein M and M' are selected from the group 8 metals iron and ruthenium and the group 8 metals are present in a concentration of from $10^{-7}$ to $10^{-3}$ gram atom per silver mole.

* * * * *